US012326069B2

(12) United States Patent
Eitschberger et al.

(10) Patent No.: US 12,326,069 B2
(45) Date of Patent: Jun. 10, 2025

(54) PERFORATING GUN AND ALIGNMENT ASSEMBLY

(71) Applicant: DynaEnergetics Europe GmbH, Troisdorf (DE)

(72) Inventors: Christian Eitschberger, Munich (DE); Thilo Scharf, Letterkenny (IE); Gernot Uwe Burmeister, Austin, TX (US)

(73) Assignee: DynaEnergetics Europe GmbH (DE)

( * ) Notice: Subject to any disclaimer, the term of this patent is extended or adjusted under 35 U.S.C. 154(b) by 0 days.

(21) Appl. No.: 18/249,645

(22) PCT Filed: Oct. 20, 2021

(86) PCT No.: PCT/EP2021/079019
§ 371 (c)(1),
(2) Date: Apr. 19, 2023

(87) PCT Pub. No.: WO2022/084363
PCT Pub. Date: Apr. 28, 2022

(65) Prior Publication Data

US 2023/0383625 A1 Nov. 30, 2023

Related U.S. Application Data

(60) Provisional application No. 63/093,883, filed on Oct. 20, 2020.

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC .... E21B 43/116; E21B 43/117; E21B 43/118; E21B 43/119; E21B 43/1193
See application file for complete search history.

(56) References Cited

U.S. PATENT DOCUMENTS

| | | | |
|---|---|---|---|
| 2,147,544 | A | 2/1939 | Potts |
| 2,708,408 | A | 5/1955 | Sweetman |
| RE25,407 | E | 6/1963 | Lebourg |
| 3,154,632 | A | 10/1964 | Browne |
| RE25,846 | E | 8/1965 | Campbell |
| 3,327,792 | A | 6/1967 | Boop |
| D227,763 | S | 7/1973 | Hand |

(Continued)

FOREIGN PATENT DOCUMENTS

| | | | |
|---|---|---|---|
| CA | 2821506 | A1 | 1/2015 |
| CA | 3022946 | A1 | 11/2017 |

(Continued)

OTHER PUBLICATIONS

Merriam Webster Dictionary.*

(Continued)

*Primary Examiner* — Yanick A Akaragwe
(74) *Attorney, Agent, or Firm* — WOMBLE BOND DICKINSON (US) LLP

(57) ABSTRACT

A perforating gun and alignment assembly includes a perforating gun housing formed from a singular and monolithic piece of metal material, and an alignment ring rotatably secured to the housing. A shaped charge positioning device is positioned in a chamber of the housing.

11 Claims, 51 Drawing Sheets

(56) References Cited

U.S. PATENT DOCUMENTS 4,411,491 A 10/1983 Larkin et al.
4,491,185 A 1/1985 McClure
4,541,486 A 9/1985 Wetzel et al.
4,574,892 A 3/1986 Grigar et al.
4,660,910 A 4/1987 Sharp et al.
4,676,528 A 6/1987 Gray
4,747,201 A 5/1988 Donovan et al.
4,776,393 A 10/1988 Forehand et al.
4,830,120 A 5/1989 Stout
4,850,438 A 7/1989 Regalbuto
5,027,708 A 7/1991 Gonzalez et al.
5,050,691 A 9/1991 Moses
5,052,489 A 10/1991 Carisella et al.
5,088,413 A 2/1992 Huber
5,322,019 A 6/1994 Hyland
5,358,418 A 10/1994 Carmichael
5,436,791 A 7/1995 Turano et al.
5,603,384 A 2/1997 Bethel et al.
5,775,426 A 7/1998 Snider et al.
5,778,979 A 7/1998 Burleson et al.
5,911,277 A 6/1999 Hromas et al.
5,992,289 A 11/1999 George et al.
5,992,523 A 11/1999 Burleson et al.
D418,210 S 12/1999 Roesch
6,006,833 A 12/1999 Burleson et al.
6,012,525 A 1/2000 Burleson et al.
6,014,933 A 1/2000 Umphries et al.
6,050,353 A 4/2000 Logan et al.
6,056,058 A 5/2000 Gonzalez
6,062,310 A 5/2000 Wesson et al.
6,070,662 A 6/2000 Ciglenec et al.
6,112,666 A 9/2000 Murray et al.
6,158,532 A 12/2000 Logan et al.
6,263,283 B1 7/2001 Snider et al.
6,269,875 B1 8/2001 Harrison, III et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,354,374 B1 3/2002 Edwards et al.
6,378,438 B1 4/2002 Lussier et al.
6,385,031 B1 5/2002 Lerche et al.
6,386,108 B1 5/2002 Brooks et al.
6,397,947 B1 6/2002 Behrmann et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,464,511 B1 10/2002 Watanabe et al.
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,506,083 B1 1/2003 Bickford et al.
6,516,901 B1 2/2003 Falgout
6,520,258 B1 2/2003 Yang et al.
6,582,251 B1 6/2003 Burke et al.
6,595,290 B2 7/2003 George et al.
6,618,237 B2 9/2003 Eddy et al.
6,651,747 B2 11/2003 Chen et al.
6,659,180 B2 12/2003 Moss
6,675,896 B2 1/2004 George
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,776,668 B1 8/2004 Scyoc et al.
6,779,605 B2 8/2004 Jackson
6,820,693 B2 11/2004 Hales et al.
6,822,542 B2 11/2004 Clark et al.
6,837,310 B2 1/2005 Martin
6,843,317 B2 1/2005 Mackenzie
6,851,471 B2 2/2005 Barlow et al.
6,851,476 B2 2/2005 Gray et al.
6,902,414 B2 6/2005 Dopf et al.
7,013,977 B2 3/2006 Nordaas
7,044,230 B2 5/2006 Starr et al.
7,074,064 B2 7/2006 Wallace
7,093,664 B2 8/2006 Todd et al.
7,104,323 B2 9/2006 Cook et al.
7,107,908 B2 9/2006 Forman et al.
7,114,564 B2 10/2006 Parrott et al.
D532,947 S 11/2006 Muscarella
7,147,068 B2 12/2006 Vail, III
7,168,494 B2 1/2007 Starr et al.
7,182,625 B2 2/2007 Machado et al.
7,193,156 B2 3/2007 Alznauer et al.
7,193,527 B2 3/2007 Hall
7,210,524 B2 5/2007 Sloan et al.
7,234,521 B2 6/2007 Shammai et al.
7,237,626 B2 7/2007 Gurjar et al.
7,243,722 B2 7/2007 Oosterling et al.
7,255,183 B2 8/2007 Cramer
7,278,491 B2 10/2007 Scott
7,297,004 B1 11/2007 Shuhart et al.
7,306,038 B2 12/2007 Challacombe
7,347,278 B2 3/2008 Lerche et al.
7,347,279 B2 3/2008 Li et al.
7,350,448 B2 4/2008 Bell et al.
7,353,879 B2 4/2008 Todd et al.
7,357,083 B2 4/2008 Takahara et al.
7,360,487 B2 4/2008 Myers, Jr. et al.
7,364,451 B2 4/2008 Ring et al.
7,387,162 B2 6/2008 Mooney, Jr. et al.
7,404,725 B2 7/2008 Hall et al.
7,441,601 B2 10/2008 George et al.
7,455,104 B2 11/2008 Duhon et al.
7,473,104 B1 1/2009 Wertz
7,476,132 B2 1/2009 Xu
7,493,945 B2 2/2009 Doane et al.
7,510,017 B2 3/2009 Howell et al.
7,540,758 B2 6/2009 Ho
7,544,102 B2 6/2009 Oda
7,565,927 B2 7/2009 Gerez et al.
7,568,429 B2 8/2009 Hummel et al.
7,591,212 B2 9/2009 Myers, Jr. et al.
7,647,978 B2 1/2010 Scott
7,661,474 B2 2/2010 Campbell et al.
7,690,925 B2 4/2010 Goodman
7,726,396 B2 6/2010 Briquet et al.
7,735,578 B2 6/2010 Loehr et al.
7,736,261 B2 6/2010 Wittkopp et al.
7,748,447 B2 7/2010 Moore
7,752,971 B2 7/2010 Loehr
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,789,153 B2 9/2010 Prinz et al.
7,810,430 B2 10/2010 Chan et al.
7,815,440 B2 10/2010 Hsieh et al.
7,886,842 B2 2/2011 Howard et al.
7,901,247 B2 3/2011 Ring
7,908,970 B1 3/2011 Jakaboski et al.
7,929,270 B2 4/2011 Hummel et al.
7,934,453 B2 5/2011 Moore
7,980,874 B2 7/2011 Finke et al.
8,028,624 B2 10/2011 Mattson
8,061,425 B2 11/2011 Hales et al.
8,066,083 B2 11/2011 Hales et al.
8,069,789 B2 12/2011 Hummel et al.
8,074,713 B2 12/2011 Ramos et al.
8,074,737 B2 12/2011 Hill et al.
8,079,296 B2 12/2011 Barton et al.
8,091,477 B2 1/2012 Brooks et al.
8,127,846 B2 3/2012 Hill et al.
8,136,439 B2 3/2012 Bell
8,141,434 B2 3/2012 Kippersund et al.
8,151,882 B2 4/2012 Grigar et al.

(56) References Cited

U.S. PATENT DOCUMENTS

| | | | |
|---|---|---|---|
| 8,157,022 | B2 | 4/2012 | Bertoja et al. |
| 8,181,718 | B2 | 5/2012 | Burleson et al. |
| 8,182,212 | B2 | 5/2012 | Parcell |
| 8,186,259 | B2 | 5/2012 | Burleson et al. |
| 8,230,788 | B2 | 7/2012 | Brooks et al. |
| 8,256,337 | B2 | 9/2012 | Hill et al. |
| 8,336,437 | B2 | 12/2012 | Barlow et al. |
| 8,336,635 | B2 | 12/2012 | Greenlee et al. |
| 8,387,533 | B2 | 3/2013 | Runkel |
| 8,388,374 | B2 | 3/2013 | Grek et al. |
| 8,395,878 | B2 | 3/2013 | Stewart et al. |
| 8,408,286 | B2 | 4/2013 | Rodgers et al. |
| 8,413,727 | B2 | 4/2013 | Holmes |
| D682,384 | S | 5/2013 | Jaureguizar |
| 8,439,114 | B2 | 5/2013 | Parrott et al. |
| 8,451,137 | B2 | 5/2013 | Bonavides et al. |
| 8,468,944 | B2 | 6/2013 | Givens et al. |
| 8,490,686 | B2 | 7/2013 | Rodgers et al. |
| 8,596,378 | B2 | 12/2013 | Mason et al. |
| 8,661,978 | B2 | 3/2014 | Backhus et al. |
| 8,678,666 | B2 | 3/2014 | Scadden et al. |
| 8,684,083 | B2 | 4/2014 | Torres et al. |
| 8,695,506 | B2 | 4/2014 | Lanclos |
| D712,013 | S | 8/2014 | Mather et al. |
| 8,807,003 | B2 | 8/2014 | Le et al. |
| 8,807,206 | B2 | 8/2014 | Walker |
| 8,833,441 | B2 | 9/2014 | Fielder et al. |
| 8,863,665 | B2 | 10/2014 | DeVries et al. |
| 8,869,887 | B2 | 10/2014 | Deere et al. |
| 8,875,787 | B2 | 11/2014 | Tassaroli |
| 8,875,796 | B2 | 11/2014 | Hales et al. |
| 8,881,816 | B2 | 11/2014 | Glenn et al. |
| 8,884,778 | B2 | 11/2014 | Lerche et al. |
| 8,931,569 | B2 | 1/2015 | Fagley et al. |
| 8,943,943 | B2 | 2/2015 | Tassaroli |
| 8,960,093 | B2 | 2/2015 | Preiss et al. |
| 8,960,288 | B2 | 2/2015 | Sampson |
| 9,065,201 | B2 | 6/2015 | Borgfeld et al. |
| 9,080,433 | B2 | 7/2015 | Lanclos et al. |
| 9,145,763 | B1 | 9/2015 | Sites, Jr. |
| 9,145,764 | B2 | 9/2015 | Burton et al. |
| 9,181,790 | B2 | 11/2015 | Mace et al. |
| 9,194,219 | B1 | 11/2015 | Hardesty et al. |
| 9,206,675 | B2 | 12/2015 | Hales et al. |
| 9,270,051 | B1 | 2/2016 | Christiansen et al. |
| 9,284,819 | B2 | 3/2016 | Tolman et al. |
| 9,284,824 | B2 | 3/2016 | Fadul et al. |
| 9,297,242 | B2 | 3/2016 | Zhang et al. |
| 9,317,038 | B2 | 4/2016 | Ozick et al. |
| 9,347,755 | B2 | 5/2016 | Backhus et al. |
| 9,359,863 | B2 | 6/2016 | Streich et al. |
| 9,383,237 | B2 | 7/2016 | Wiklund et al. |
| 9,428,979 | B2 | 8/2016 | Bell et al. |
| 9,466,916 | B2 | 10/2016 | Li et al. |
| 9,476,289 | B2 | 10/2016 | Wells |
| 9,484,646 | B2 | 11/2016 | Thomas |
| 9,494,021 | B2 | 11/2016 | Parks et al. |
| 9,523,265 | B2 | 12/2016 | Upchurch et al. |
| 9,523,271 | B2 | 12/2016 | Bonavides et al. |
| 9,581,422 | B2 | 2/2017 | Preiss et al. |
| 9,587,439 | B2 | 3/2017 | Lamik-Thonhauser et al. |
| 9,593,548 | B2 | 3/2017 | Hill et al. |
| 9,598,942 | B2 | 3/2017 | Wells et al. |
| 9,605,937 | B2 | 3/2017 | Eitschberger et al. |
| 9,617,814 | B2 | 4/2017 | Seals et al. |
| 9,634,427 | B2 | 4/2017 | Lerner et al. |
| 9,677,363 | B2 | 6/2017 | Schacherer et al. |
| 9,689,223 | B2 | 6/2017 | Schacherer et al. |
| 9,695,673 | B1 | 7/2017 | Latiolais |
| 9,702,211 | B2 | 7/2017 | Tinnen |
| 9,702,680 | B2 | 7/2017 | Parks et al. |
| 9,709,373 | B2 | 7/2017 | Hikone et al. |
| 9,784,549 | B2 | 10/2017 | Eitschberger |
| 9,845,666 | B2 | 12/2017 | Hardesty et al. |
| 9,903,192 | B2 | 2/2018 | Entchev et al. |
| 9,926,750 | B2 | 3/2018 | Ringgenberg |
| 10,066,921 | B2 | 9/2018 | Eitschberger |
| 10,077,641 | B2 | 9/2018 | Rogman et al. |
| 10,151,152 | B2 | 12/2018 | Wight et al. |
| 10,273,788 | B2 | 4/2019 | Bradley et al. |
| 10,309,199 | B2 | 6/2019 | Eitschberger |
| 10,352,136 | B2 | 7/2019 | Goyeneche |
| 10,385,629 | B2 | 8/2019 | Spence et al. |
| 10,428,595 | B2 | 10/2019 | Bradley et al. |
| 10,429,161 | B2 | 10/2019 | Parks et al. |
| 10,458,213 | B1 | 10/2019 | Eitschberger et al. |
| 10,472,901 | B2 | 11/2019 | Engel et al. |
| 10,472,938 | B2 | 11/2019 | Parks et al. |
| 10,594,102 | B2 | 3/2020 | Pratt et al. |
| D892,278 | S | 8/2020 | Eitschberger |
| 10,844,697 | B2 | 11/2020 | Preiss et al. |
| D904,475 | S | 12/2020 | Preiss |
| 11,732,556 | B2 | 8/2023 | Eitschberger |
| 2004/0216866 | A1* | 11/2004 | Barlow ..... E21B 43/119 166/55 |
| 2005/0279513 | A1 | 12/2005 | Eppink |
| 2006/0082152 | A1 | 4/2006 | Neves |
| 2007/0084336 | A1 | 4/2007 | Neves |
| 2008/0264639 | A1 | 10/2008 | Parrott et al. |
| 2009/0301723 | A1 | 12/2009 | Gray |
| 2010/0011945 | A1 | 1/2010 | Loehr |
| 2011/0024116 | A1 | 2/2011 | McCann et al. |
| 2012/0152542 | A1 | 6/2012 | Le |
| 2012/0241169 | A1 | 9/2012 | Hales et al. |
| 2012/0247769 | A1 | 10/2012 | Schacherer et al. |
| 2013/0008639 | A1 | 1/2013 | Tassaroli et al. |
| 2013/0126237 | A1 | 5/2013 | Burton et al. |
| 2013/0133889 | A1 | 5/2013 | Schacherer et al. |
| 2013/0199843 | A1 | 8/2013 | Ross |
| 2016/0084048 | A1 | 3/2016 | Harrigan et al. |
| 2016/0108722 | A1 | 4/2016 | Whitsitt et al. |
| 2016/0168961 | A1 | 6/2016 | Parks et al. |
| 2016/0202033 | A1 | 7/2016 | Shahinpour et al. |
| 2016/0273902 | A1 | 9/2016 | Eitschberger |
| 2016/0281466 | A1 | 9/2016 | Richards |
| 2016/0333675 | A1 | 11/2016 | Wells et al. |
| 2016/0356132 | A1 | 12/2016 | Burmeister et al. |
| 2017/0211363 | A1 | 7/2017 | Bradley et al. |
| 2017/0241244 | A1 | 8/2017 | Barker et al. |
| 2017/0268320 | A1 | 9/2017 | Angman et al. |
| 2017/0268860 | A1 | 9/2017 | Eitschberger |
| 2017/0314373 | A9 | 11/2017 | Bradley et al. |
| 2018/0119529 | A1 | 5/2018 | Goyeneche |
| 2018/0202789 | A1 | 7/2018 | Parks et al. |
| 2018/0202790 | A1 | 7/2018 | Parks et al. |
| 2018/0252054 | A1 | 9/2018 | Stokes |
| 2018/0318770 | A1 | 11/2018 | Eitschberger et al. |
| 2019/0048693 | A1 | 2/2019 | Henke et al. |
| 2019/0049225 | A1 | 2/2019 | Eitschberger |
| 2019/0153827 | A1 | 5/2019 | Goyeneche |
| 2019/0162056 | A1 | 5/2019 | Sansing |
| 2019/0195054 | A1 | 6/2019 | Bradley et al. |
| 2019/0211655 | A1 | 7/2019 | Bradley et al. |
| 2019/0219375 | A1 | 7/2019 | Parks et al. |
| 2019/0257158 | A1 | 8/2019 | Langford et al. |
| 2019/0366272 | A1 | 12/2019 | Eitschberger et al. |
| 2020/0032626 | A1 | 1/2020 | Parks et al. |
| 2020/0048996 | A1 | 2/2020 | Anthony et al. |
| 2020/0063553 | A1 | 2/2020 | Zemla et al. |
| 2020/0072029 | A1 | 3/2020 | Anthony et al. |
| 2020/0199983 | A1 | 6/2020 | Preiss et al. |
| 2020/0217635 | A1 | 7/2020 | Eitschberger |
| 2020/0248535 | A1 | 8/2020 | Goyeneche |
| 2020/0362652 | A1 | 11/2020 | Eitschberger et al. |
| 2020/0362654 | A1 | 11/2020 | Eitschberger et al. |
| 2020/0399995 | A1 | 12/2020 | Preiss et al. |
| 2021/0301599 | A1 | 9/2021 | Mulhern et al. |
| 2023/0045109 | A1 | 2/2023 | Goyeneche |
| 2023/0212927 | A1 | 7/2023 | Cook et al. |

FOREIGN PATENT DOCUMENTS

| | | |
|---|---|---|
| CN | 201209435 | 3/2009 |
| CN | 201428439 | 3/2010 |

(56) References Cited

FOREIGN PATENT DOCUMENTS

| | | | |
|---|---|---|---|
| CN | 103485750 | A | 1/2014 |
| CN | 103993861 | A | 8/2014 |
| CN | 208870580 | U | 5/2019 |
| CN | 110424930 | A | 11/2019 |
| EP | 0160449 | A1 | 11/1985 |
| EP | 0180520 | B1 | 5/1991 |
| GB | 2548101 | A | 9/2017 |
| JP | 1363909 | | 5/2009 |
| JP | 1387855 | | 4/2010 |
| KR | 3008491620000 | | 4/2016 |
| RU | 78521 | U1 | 11/2008 |
| RU | 93521 | U1 | 4/2010 |
| RU | 2633904 | C1 | 10/2017 |
| WO | 8802056 | A1 | 3/1988 |
| WO | 1988002056 | A1 | 3/1988 |
| WO | 1994009246 | A1 | 4/1994 |
| WO | 1999005390 | A1 | 2/1999 |
| WO | 0133029 | A3 | 5/2001 |
| WO | 0159401 | A1 | 8/2001 |
| WO | 2001059401 | A1 | 8/2001 |
| WO | 2001096807 | A2 | 12/2001 |
| WO | 2008098052 | A3 | 10/2008 |
| WO | 2009091422 | A2 | 7/2009 |
| WO | 2009091422 | A3 | 3/2010 |
| WO | 2010104634 | A1 | 9/2010 |
| WO | 2012006357 | A2 | 1/2012 |
| WO | 2012135101 | A2 | 10/2012 |
| WO | 2012106640 | A3 | 11/2012 |
| WO | 2012149584 | A1 | 11/2012 |
| WO | 2014046670 | A1 | 3/2014 |
| WO | 2014089194 | A1 | 6/2014 |
| WO | 2015006869 | A1 | 1/2015 |
| WO | 2015028204 | A2 | 3/2015 |
| WO | 2015134719 | A1 | 9/2015 |
| WO | 2016100269 | A1 | 6/2016 |
| WO | 2017062444 | A1 | 4/2017 |
| WO | 2018009223 | A1 | 1/2018 |
| WO | 2018057949 | A1 | 3/2018 |
| WO | 2018213768 | A1 | 11/2018 |
| WO | 2019071027 | A1 | 4/2019 |
| WO | 2019148009 | A2 | 8/2019 |
| WO | 2020154061 | A1 | 7/2020 |
| WO | 2021198193 | A1 | 10/2021 |
| WO | 2022135749 | A1 | 6/2022 |

OTHER PUBLICATIONS

United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.

United States District Court for the Southern District of Texas Houston Division, Case 4:19-cv-01611 for U.S. Pat. No. 9,581,422B2, Plaintiff's Complaint and Exhibits, dated May 2, 2019, 26 pgs.

United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.

United States District Court for the Southern District of Texas; Joint Claim Construction Statement for Civil Action No. 3:20-cv-00376; dated Jul. 8, 2021; 14 pages.

United States District Court for the Southern District of Texas; Joint Claim Construction Statement for Civil Action No. 4:20-cv-02123; dated Aug. 27, 2021; 14 pages.

United States District Court for the Western District of Texas; Order Granting in Part & Denying on Part Defendants' Motion to Dismiss for Improper Venue or to Transfer Venue Pursuant to 28 U.S.C. § 1404(a) for Civil Action No. 6:20-CV-01110-ADA; dated Aug. 5, 2021; 16 pages.

United States Patent and Trademark Office, Case IPR2018-00600 for U.S. Pat. No. 9,581,422 B2, Reply In Support of Patent Owner's Motion to Amend, dated Mar. 21, 2019, 15 pgs.

United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.

United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.

United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.

United States Patent and Trademark Office, Case IPR2018-00600 for U.S. Pat. No. 9,581,422 B2, Patent Owner's Motion to Amend, dated Dec. 6, 2018, 53 pgs.

United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.

United States Patent and Trademark Office, Case IPR2018-00600 for U.S. Pat. No. 9,581,422 B2, Patent Owner's Request for Hearing, dated Sep. 18, 2019, 19 pgs.

United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.

United States Patent and Trademark Office, Case IPR2018-00600 for U.S. Pat. No. 9,581,422 B2, Patent Owner's Sur-reply, dated Mar. 21, 2019, 28 pgs.

United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.

United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.

United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.

United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.

United States Patent and Trademark Office, Final Office Action of U.S. Appl. No. 16/359,540, dated Aug. 14, 2019, 9 pages.

United States Patent and Trademark Office, Final Written Decision of Case IPR2018-00600 for U.S. Pat. No. 9,581,422 B2, Paper No. 42, dated Aug. 20, 2019, 31 pgs.

United States Patent and Trademark Office, Non-Final Office Action of U.S. Appl. No. 16/451,440, dated Oct. 24, 2019, 22 pages.

United States Patent and Trademark Office, Non-Final Office Action of U.S. Appl. No. 14/767,058, dated Jul. 15, 2016, 9 pages.

United States Patent and Trademark Office, Non-Final Office Action of U.S. Appl. No. 15/117,228, dated May 31, 2018, 9 pages.

United States Patent and Trademark Office, Non-Final Office Action of U.S. Appl. No. 15/617,344, dated Jan. 23, 2019, 5 pages.

United States Patent and Trademark Office, Non-Final Office Action of U.S. Appl. No. 15/788,367, dated Oct. 22, 2018, 6 pages.

United States Patent and Trademark Office, Non-Final Office Action of U.S. Appl. No. 15/920,800, dated Dec. 27, 2019, 6 pages.

United States Patent and Trademark Office, Non-Final Office Action of U.S. Appl. No. 15/920,812, dated Dec. 27, 2019, 6 pages.

United States Patent and Trademark Office, Non-Final Office Action of U.S. Appl. No. 15/920,812, dated May 27, 2020, 5 pages.

United States Patent and Trademark Office, Non-Final Office Action of U.S. Appl. No. 16/026,431, dated Jul. 30, 2019, 10 pages.

United States Patent and Trademark Office, Non-Final Office Action of U.S. Appl. No. 16/359,540, dated May 3, 2019, 11 pages.

United States Patent and Trademark Office, Non-Final Office Action of U.S. Appl. No. 16/455,816, dated Nov. 5, 2019, 17 pages.

United States Patent and Trademark Office, Notice of Allowance for U.S. Appl. No. 15/920,800, dated Jul. 7, 2020, 7 pages.

United States Patent and Trademark Office, Notice of Allowance for U.S. Appl. No. 16/585,790, dated Jun. 19, 2020, 16 pages.

United States Patent and Trademark Office, Office Action of U.S. Appl. No. 16/540,484, dated Oct. 4, 2019, 12 pgs.

United States Patent and Trademark Office, Office Action of U.S. Appl. No. 16/585,790, dated Nov. 12, 2019, 9 pgs.

(56) References Cited

OTHER PUBLICATIONS

United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Pat. No. 438305A, issued on Oct. 14, 1890 to T.A. Edison, 2 pages.
United States Patent and Trademark Office: Image File Wrapper for U.S. Pat. No. 10,458,213; dated Feb. 11, 2019; 333 pages.
United States Patent and Trademark Office; Final Office Action of U.S. Appl. No. 16/809,729, dated Nov. 3, 2020; 19 pages.
United States Patent and Trademark Office; Decision Granting Institution of Post-Grant Review 35 U.S.C. § 324 for PGR2021-00078; dated Nov. 1, 2021; 87 pages.
United States Patent and Trademark Office; Ex Parte Quayle Action for U.S. Appl. No. 16/809,729; dated Jun. 20, 2022; 4 pages.
United States Patent and Trademark Office; Ex Parte Quayle Action for U.S. Appl. No. 16/924,504; dated Aug. 18, 2021; 9 pages.
United States Patent and Trademark Office; Ex Parte Quayle Action for U.S. Appl. No. 17/352,728; dated Jun. 20, 2022; 6 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 16/540,484; dated Apr. 27, 2022; 12 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/004,966; dated Mar. 12, 2021; 18 pages.
United States Patent and Trademark Office; Final Office Action for U.S. Appl. No. 17/162,579; dated Jul. 15, 2022; 15 pages.
United States Patent and Trademark Office; Final Office Action for U.S. Appl. No. 17/352,728; dated Mar. 9, 2022; 9 pages.
United States Patent and Trademark Office; Final Office Action of U.S. Appl. No. 16/540,484; dated Mar. 30, 2020; 11 pgs.
United States Patent and Trademark Office; U.S. Pat. No. 9,581,422 as of Aug. 23, 2017, 700 pages.
United States Patent and Trademark Office; Information Disclosure Statement for U.S. Appl. No. 16/293,508; dated Dec. 10, 2020; 7 pages.
United States Patent and Trademark Office; Non-Final Office Action for U.S. Appl. No. 16/542,890; issued Nov. 4, 2019; 15 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/540,484; dated Aug. 9, 2021; 12 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/007,574; dated May 6, 2022; 10 pages.
United States Patent and Trademark Office; Non-Final Office Action for U.S. Appl. No. 17/123,972; dated Mar. 3, 2022; 9 pages.
United States Patent and Trademark Office; Non-Final Office Action for U.S. Appl. No. 17/162,579; dated Feb. 28, 2022; 16 pages.
United States Patent and Trademark Office; Non-Final Office Action for U.S. Appl. No. 17/181,280; dated Apr. 19, 2021; 18 pages.
United States Patent and Trademark Office; Non-Final Office Action for U.S. Appl. No. 17/206,416; dated May 19, 2021; 10 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 11 pages.
United States Patent and Trademark Office; Non-Final Office Action for U.S. Appl. No. 17/383,816; dated Jan. 25, 2022; 23 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 29/733,080; Oct. 20, 2020; 10 pages.
United States Patent and Trademark Office; Notice of Allowance for U.S. Appl. No. 16/858,041; dated Oct. 22, 2020; 10 pages.
United States Patent and Trademark Office; Notice of Allowance for U.S. Appl. No. 29/733,325; dated Oct. 23, 2020; 7 pages.
United States Patent and Trademark Office; Notice of Allowance for U.S. Appl. No. 15/920,812, mailed Aug. 18, 2020; 5 pages.
United States Patent and Trademark Office; Notice of Allowance for U.S. Appl. No. 16/387,696; issued on Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 16/379,341; dated Jan. 19, 2021; 8 pages.
United States Patent and Trademark Office; Notice of Allowance for U.S. Appl. No. 16/423,789; dated Jul. 23, 2020 7 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 16/886,257; dated Sep. 15, 2021; 9 pages.
United States Patent and Trademark Office; Notice of Allowance for U.S. Appl. No. 17/004,966; dated Nov. 8, 2021; 12 pages.
United States Patent and Trademark Office; Notice of Allowance for U.S. Appl. No. 17/007,574; dated May 21, 2021; 8 pages.
United States Patent and Trademark Office; Notice of Allowance for U.S. Appl. No. 17/176,335; dated Jul. 13, 2022; 7 pages.
United States Patent and Trademark Office; Notice of Allowance for U.S. Appl. No. 17/181,280; dated Sep. 15, 2021; 14 pages.
United States Patent and Trademark Office; Notice of Allowance for U.S. Appl. No. 17/206,416; dated Sep. 9, 2021; 8 pages.
United States Patent and Trademark Office; Notice of Allowance for U.S. Appl. No. 17/221,219; dated Jan. 13, 2022; 11 pages.
United States Patent and Trademark Office; Restriction Requirement for U.S. Appl. No. 17/007,574; dated Oct. 23, 2020; 6 pages.
United States Patent and Trademark Office; Office Action and Response to Office Action for U.S. Appl. No. 16/585,790; dated Nov. 12, 2019 and Feb. 12, 2020; 24 pages.
United States Patent and Trademark Office; Office Action for U.S. Appl. No. 17/004,966; dated Dec. 8, 2020; 30 pages.
United States Patent and Trademark Office; Prosecution History for U.S. Pat. No. 10,352,136; 246 pages.
United States Patent and Trademark Office; Office Action of U.S. Appl. No. 16/540,484, dated Aug. 20, 2020, 10 pgs.
United States Patent and Trademark Office, for U.S. Pat. No. 10,429,161; 263 pages.
United States Patent and Trademark Office, for U.S. Pat. No. 10,472,938; 485 pages.
United States Patent and Trademark Office; Notice of Allowance for U.S. Appl. No. 29/755,354; dated Feb. 11, 2021; 6 pages.
United States Patent Trial and Appeal Board; Decision Denying Institution of Post-Grant Review; PGR No. 2020-00072; dated Jan. 19, 2021; 38 pages.
Yellow Jacket Oil Tools, Orienting Sub, 2019, 2 pgs., https://www.yjoiltools.com/Wireline-Subs/Orienting-Sub.
United States Patent and Trademark Office; U.S. Appl. No. 62/736,298; dated Sep. 25, 2018; 120 pages.
United States Patent and Trial Appeal Board; Final Written Decision on IPR2018-00600; issued Aug. 20, 2019; 31 pages.
United States Patent Trial and Appeal Board; Institution Decision for PGR 2020-00080; dated Feb. 12, 2021; 15 pages.
United States Patent Trial and Appeal Board; Record of Oral Hearing held Feb. 18, 2020 for IPR dated 2018-00600; dated Feb. 18, 2020; 27 pages.

(56) References Cited

OTHER PUBLICATIONS

Vigor Petroleum; Perforating Gun Accessories Product Description; https://www.vigordrilling.com/completion-tools/perforating-gun-accessories.html; 2021; 1 page.
WETECHNOLOGIES; Downhole Connectors, High Pressure HP / HT & Medium Pressure MP /MT; dated Apr. 3, 2016; http://wetechnologies.com/products/hp-ht-downhole/; 2 pages.
Williams, John; Declaration of Dr. John Williams; dated Oct. 18, 2021; 9 pages.
WIPO, International Search Report for International Application No. PCT/CA2014/050673, mailed Oct. 9, 2014, 3 pgs.
WIPO, Written Opinion of International Searching Authority for PCT Application No. PCT/CA2014/050673, mailed Oct. 9, 2014, 4 pgs.
Wooley, Gary R.; Declaration in Support of Petition for Post Grant Review of U.S. Pat. No. 10,844,697 for PGR2021-00097; dated Jul. 17, 2021; 90 pages.
Wooley, Gary R; Declaration of Gary R. Wooley, PH.D. Regarding Claim Construction for Civil Action No. 6:21-cv-00225-ADA; dated Oct. 6, 2021; 67 pages.
Wooley, Gary; Declaration of Gary E. Wooley for Civil Action Nos. 6:20-cv-01110-ADA and 6:20-CV-01201-ADA; dated Oct. 18, 2021; 12 pages.
Wooley, Gary; Declaration of Gary R. Wooley for Civil Action No. 3:20-cv-00376; dated Jul. 8, 2021; 11 pages.
Wooley, Gary; Declaration of Gary R. Wooley for Civil Action No. 3:21-cv-00192-M; dated Aug. 17, 2021; 18 pages.
Wooley, Gary; Rebuttal Declaration of Gary R. Wooley, Ph.D. Regarding Claim Construction; dated Nov. 10, 2021; 34 pages.
Wooley, Gary; Transcript of Gary Wooley for Civil Action No. 3:21-cv-00192-M; dated Sep. 2, 2021; 26 pages.
Yellow Jacket Oil Tools, LLC; Defendant Yellow Jacket Oil Tools, LLC's Answer to Plaintiffs' First Amended Complaint for Civil Action No. 6:20-cv-01110; dated Aug. 10, 2021; 13 pages.
Yellowjacket Oil Tools, LLC and G&H Diversified Manufacturing, LP; Defendants' Preliminary Invalidity Contentions for Civil Action No. 6:20-cv-01110-ADA; dated May 6, 2021; 20 pages.
Yellowjacket Oil Tools, LLC and G&H Diversified Manufacturing, LP; Defendants' Preliminary Invalidity Contentions for Civil Action No. 6:20-cv-01110-ADA; dated Aug. 30, 2021; 21 pages.
Yellowjacket Oil Tools, LLC and G&H Diversified Manufacturing, LP; Exhibit A-9 Selective perforation: A Game Changer in Peforating Technology—Case Study; dated Aug. 30, 2021; 13 pages.
Yellowjacket, G&H and Nextier, Invalidity Chart in Litigation re Schlumberger SafeJet, dated as early as Aug. 30, 2021, 13 pgs.
Yellowjacket, G&H and Nextier, Invalidity Chart in Litigation re U.S. Pat. No. 10,844,697, "New Select-Fire System" Publication and Select-Fire System by *BakerHughes* vs. *Asserted Claims*, dated as early as Aug. 30, 2021, 33 pgs.
Yellowjacket, G&H and Nextier, Invalidity Chart in Litigation re U.S. Pat. No. 10,844,697, *New Select-Fire System* vs. *Asserted Claims*, dated as early as Aug. 30, 2021, 33 pgs.
Yellowjacket, G&H and Nextier, Invalidity Chart in Litigation re U.S. Pat. No. 10,844,697, U.S. Patent Publication No. 2013/0126237 A1 to *Burton* vs *Asserted Claims*, dated as early as Aug. 30, 2021, 3 pgs.
Yellowjacket, G&H and Nextier, Invalidity Chart in Litigation re U.S. Pat. No. 10,844,697, U.S. Patent Publication No. 2016/0084048 A1 to *Harrigan et al.* vs. *Asserted Claims*, dated as early as Aug. 30, 2021, 4 pgs.
Yellowjacket, G&H and Nextier, Invalidity Chart in Litigation re U.S. Pat. No. 10,844,697, *U.S. Appl. No. 61/733,129* vs. *Asserted Claims*, dated as early as Aug. 30, 2021, 55 pgs.
Yellowjacket, G&H and Nextier, Invalidity Chart in Litigation re U.S. Pat. No. 10,844,697, U.S. Appl. No. 61/819,196 to *Harrigan et al.* vs. *Asserted Claims*, dated as early as Aug. 30, 2021, 26 pgs.
Yellowjacket, G&H and Nextier, Invalidity Chart in Litigation re U.S. Pat. No. 10,844,697, *U.S. Pub. No. 2012/0247771* vs. *Asserted Claims*, dated as early as Aug. 30, 2021, 30 pgs.
Yellowjacket, G&H and Nextier, Invalidity Chart in Litigation re U.S. Pat. No. 10,844,697, U.S. Pat. No. 10,077,641 to *Rogman* vs. *Asserted Claims*, dated as early as Aug. 30, 2021, 36 pgs.
Yellowjacket, G&H and Nextier, Invalidity Chart in Litigation re U.S. Pat. No. 10,844,697, U.S. Pat. No. 3,173,229 to *Gene T. Boop* vs. *Asserted Claims*, dated as early as Aug. 30, 2021, 12 pgs.
Yellowjacket, G&H and Nextier, Invalidity Chart in Litigation re U.S. Pat. No. 10,844,697, U.S. Pat. No. 4,457,383 to *Gene T. Boop* vs. *Asserted Claims*, dated as early as Aug. 30, 2021, 22 pgs.
Yellowjacket, G&H and Nextier, Invalidity Chart in Litigation re U.S. Pat. No. 10,844,697, *U.S. Pat. No. 6,506,083* vs. *Asserted Claims*, dated as early as Aug. 30, 2021, 3 pgs.
Yellowjacket, G&H and Nextier, Invalidity Chart in Litigation re U.S. Pat. No. 10,844,697, U.S. Pat. No. 6,582,251 to *Burke et al.* vs. *Asserted Claims*, dated as early as Aug. 30, 2021, 3 pgs.
Yellowjacket, G&H and Nextier, Invalidity Chart in Litigation re U.S. Pat. No. 10,844,697, U.S. Pat. No. 7,226,303 to *Shaikh* vs. *Asserted Claims*, dated as early as Aug. 30, 2021, 4 pgs.
Yellowjacket, G&H and Nextier, Invalidity Chart in Litigation re U.S. Pat. No. 10,844,697, U.S. Pat. No. 7,762,331 to *Goodman* vs. *Asserted Claims*, dated as early as Aug. 30, 2021, 4 pgs.
Yellowjacket, G&H and Nextier, Invalidity Chart in Litigation re U.S. Pat. No. 10,844,697, U.S. Pat. No. 8,387,533 to *Runkel* vs. *Asserted Claims*, dated as early as Aug. 30, 2021, 5 pgs.
Yellowjacket, G&H and Nextier, Invalidity Chart in Litigation re U.S. Pat. No. 10,844,697, U.S. Pat. No. 8,943,943 to *Carlos Jose Tassaroli* vs. *Asserted Patents*, dated as early as Aug. 30, 2021, 7 pgs.
Yellowjacket, G&H and Nextier, Invalidity Chart in Litigation re U.S. Pat. No. 10,844,697, U.S. Pat. No. 9,065,201 to *Borgfeld et al.*vs. *Asserted Claims*, dated as early as Aug. 30, 2021, 3 pgs.
Yellowjacket, G&H and Nextier, Invalidity Chart in Litigation re U.S. Pat. No. 10,844,697, U.S. Pat. No. 9,874,083 to *Logan* vs. *Asserted Claims*, dated as early as Aug. 30, 2021, 18 pgs.
G&H Diversified Manufacturing, LP; Defendant G&H Diversified Manufacturing, LP's Opening Claim Construction Brief; dated Oct. 18, 2021; 25 pages.
G&H Diversified Manufacturing, LP; Defendants' Preliminary Invalidity Contentions for Civil Action No. 3:20-cv-00376; dated May 6, 2021; 20 pages.
G&H Diversified Manufacturing, LP; Plaintiff and Counterclaim Defendant G&H Diversified Manufacturing, LP and Counterclaim Defendant Yellow Jacket Oil Tools, LLC's First Supplemental Proposed Constructions; dated Jun. 24, 2021; 7 pages.
G&H Diversified Manufacturing, LP; Plaintiff and Counterclaim Defendant G&H Diversified Manufacturing, LP and Counterclaim Defendant Yellow Jacket Oil Tools, LLC's Proposed Constructions; dated Jun. 10, 2021; 7 pages.
G&H Diversified Manufacturing, LP; Redated Petition for Post Grant Review for PGR2021-00078; dated May 10, 2021; 20 pages.
G&H Diversified Manufacturing, LP; Reply to Preliminary Response for PGR No. PGR2021-00078; dated Sep. 14, 2021; 18 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office, Examination Report for GB App. No. GB1600085.3, mailed Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; Apr. 13, 2018; 3 pages.
GB Intellectual Property Office; Notification of Grant for GB Appl. No. 1717516.7; Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; mailed Dec. 21, 2017; 5 pages.
German Patent Office, Office Action for German Patent Application No. 10 2013 109 227.6, which is in the same family as PCT Application No. PCT/EP2014/065752, see p. 5 for references cited, May 22, 2014, 8 p. .

(56) References Cited

OTHER PUBLICATIONS

Gilliat et al.; New Select-Fire System: Improved Reliability and Safety in Select Fire Operations; 2012; 16 pgs.
Global Wireline Market; Exhibit 2010 of PGR 2020-00072; dated Oct. 15, 2019; 143 pages.
GR Energy Operating GP LLC, GR Energy Services Management, LP and GR Energy Services, LLC; *Exhibit A U.S. Pat. No. 10,844,697* vs *Castel*; dated Aug. 30, 2021; 88 pages.
GR Energy Operating GP LLC, GR Energy Services Management, LP and GR Energy Services, LLC; *Exhibit B U.S. Pat. No. 10,844,697* vs *Goodman*; dated Aug. 30, 2021; 36 pages.
GR Energy Operating GP LLC, GR Energy Services Management, LP and GR Energy Services, LLC; *Exhibit C U.S. Pat. No. 10,844,697* vs *Hromas*; dated Aug. 30, 2021; 27 pages.
GR Energy Operating GP LLC, GR Energy Services Management, LP and GR Energy Services, LLC; *Exhibit D U.S. Pat. No. 10,844,697* vs *Boop 768*; dated Aug. 30, 2021; 35 pages.
GR Energy Operating GP LLC, GR Energy Services Management, LP and GR Energy Services, LLC; *Exhibit E U.S. Pat. No. 10,844,697* vs *Boop 792*; dated Aug. 30, 2021; 52 pages.
GR Energy Operating GP LLC, GR Energy Services Management, LP and GR Energy Services, LLC; *Exhibit F U.S. Pat. No. 10,844,697* vs *Boop 378*; dated Aug. 30, 2021; 34 pages.
GR Energy Operating GP LLC, GR Energy Services Management, LP and GR Energy Services, LLC; *Exhibit G U.S. Pat. No. 10,844,697* vs *Bickford*; dated Aug. 30, 2021; 7 pages.
GR Energy Operating GP LLC, GR Energy Services Management, LP and GR Energy Services, LLC; *Exhibit H U.S. Pat. No. 10,844,697* vs *Black*; dated Aug. 30, 2021; 33 pages.
GR Energy Operating GP LLC, GR Energy Services Management, LP and GR Energy Services, LLC; *Exhibit I U.S. Pat. No. 10,844,697* vs *Rogman*; dated Aug. 30, 2021; 59 pages.
GR Energy Operating GP LLC, GR Energy Services Management, LP and GR Energy Services, LLC; *Exhibit J U.S. Pat. No. 10,844,697* vs *Burton*; dated Aug. 30, 2021; 57 pages.
GR Energy Operating GP LLC, GR Energy Services Management, LP and GR Energy Services, LLC; *Exhibit K U.S. Pat. No. 10,844,697* vs *Borgfeld*; dated Aug. 30, 2021; 36 pages.
GR Energy Operating GP LLC, GR Energy Services Management, LP and GR Energy Services, LLC; *Exhibit L U.S. Pat. No. 10,844,697* vs *Boop '383*; dated Aug. 30, 2021; 24 pages.
GR Energy Operating GP LLC, GR Energy Services Management, LP and GR Energy Services, LLC; *Exhibit M U.S. Pat. No. 10,844,697* vs *Boop '992*; dated Aug. 30, 2021; 14 pages.
GR Energy Operating GP LLC, GR Energy Services Management, LP and GR Energy Services, LLC; *Exhibit N U.S. Pat. No. 10,844,697* vs *Deere*; dated Aug. 30, 2021; 14 pages.
GR Energy Operating GP LLC, GR Energy Services Management, LP and GR Energy Services, LLC; *Exhibit O U.S. Pat. No. 10,844,697* vs *Harrigan Provisional*; dated Aug. 30, 2021; 26 pages.
GR Energy Operating GP LLC, GR Energy Services Management, LP and GR Energy Services, LLC; *Exhibit P U.S. Pat. No. 10,844,697* vs *Burke '251*; dated Aug. 30, 2021; 7 pages.
GR Energy Operating GP LLC, GR Energy Services Management, LP and GR Energy Services, LLC; *Exhibit Q U.S. Pat. No. 10,844,697* vs *Runkel*; dated Aug. 30, 2021; 7 pages.
GR Energy Operating GP LLC, GR Energy Services Management, LP and GR Energy Services, LLC; *Exhibit R U.S. Pat. No. 10,844,697* vs *Tassaroli*; dated Aug. 30, 2021; 10 pages.
GR Energy Operating GP LLC, GR Energy Services Management, LP and GR Energy Services, LLC; *Exhibit S U.S. Pat. No. 10,844,697* vs *Harrigan '048*; dated Aug. 30, 2021; 7 pages.
GR Energy Operating GP LLC, GR Energy Services Management, LP and GR Energy Services, LLC; *Exhibit T U.S. Pat. No. 10,844,697* vs *Select-Fire System*; dated Aug. 30, 2021; 36 pages.
GR Energy Operating GP LLC, GR Energy Services Management, LP and GR Energy Services, LLC; *Exhibit U U.S. Pat. No. 10,844,697* vs *New Select-Fire System*; dated Aug. 30, 2021; 37 pages.
GR Energy Operating GP LLC, GR Energy Services Management, LP and GR Energy Services, LLC; *Exhibit V U.S. Pat. No. 10,844,697* vs *EWAPS*; dated Aug. 30, 2021; 17 pages.
GR Energy Operating GP LLC, GR Energy Services Management, LP and GR Energy Services, LLC; *Exhibit W U.S. Pat. No. 10,844,697* vs *SafeJet System*; dated Aug. 30, 2021; 17 pages.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
GR Energy Services Operating GP LLC, GR Energy Services Management, LP and GR Energy Services, LLC; Gr Energy's Opening Claim Construction Brief; dated Oct. 18, 2021; 23 pages.
Harrison Jet Guns; Image of "xtra penetrator".
Heard, Preston; Declaration for PGR2021-00078; dated Aug. 19, 2021; 5 pages.
Horizontal Wireline Services, LLC and Allied Wireline Services, LLC; Defendants' Opening Claim Construction Brief; dated Oct. 18, 2021; 27 pages.
Horizontal Wireline Services, LLC and Allied Wireline Services, LLC; Defendants' Preliminary Invalidity Contentions for Civil Action No. 6:21-cv-00349-ADA; dated Aug. 30, 2021; 22 pages.
Horizontal Wireline Services, LLC and Allied Wireline Services, LLC; *Exhibit A1 U.S. Pat. No. 5, 155,293 to Barton* vs. *Asserted Claims of U.S. Pat. No. 10,844,697*; dated Aug. 30, 2021; 21 pages.
Horizontal Wireline Services, LLC and Allied Wireline Services, LLC; Exhibit A23 Amit Govil, "Selective Perforation: A Game Changer in Perforating Technology—Case Study," *2012 European and West African Perforating Symposium* vs. *Asserted Claims of U.S. Pat. No. 10,844,697*; dated Aug. 30, 2021; 17 pages.
Horizontal Wireline Services, LLC and Allied Wireline Services, LLC; *Exhibit A5 U.S. Pat. No. 9, 175,553 to Mcann, et al.* vs. *Asserted Claims of U.S. Pat. No. 10,844,697*; dated Aug. 30, 2021; 26 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Dynaenergetics Europe; Complaint and Demand for Jury Trial, Civil Action No. 6:20-cv-01201; dated Dec. 30, 2020; 12 pages.
G&H Diversified Manufacturing, LP; Complaint for Declaratory Judgement for Civil Action No. 3:20-cv-00376; dated Dec. 14, 2020; 7 pages.
Yellow Jacket Oil Tools; Tandem Sub; 2019; 3 pages.
Parrott, Robert; Declaration for IPR2021-00082; dated Oct. 20, 2020; 110 pages.
Parrott, Robert; Declaration for PGR No. 2021-00078; dated May 10, 2021; 182 pages.
Patent Trial and Appeal Board; Decision Granting Patent Owner's Request for Rehearing and Motion to Amend for IPR2018-00600; dated Jul. 6, 2020; 27 pages.
Patent Trial and Appeals Board; Decision Granting Institution of Post Grant Review, PGR No. PGR2021-00097; dated Jan. 6, 2022; 92 pages.
PCT Search Report and Written Opinion, mailed May 4, 2015: See Search Report and Written opinion for PCT Application No. PCT/EP2014/065752, 12 pgs.
Perfx Wireline Services, LLC; PerfX Wireline Services, LLC's Preliminary Invalidity Contentions for Civil Action No. 1:20-CV-03665; dated Jul. 2, 2021; 4 pages.
Perfx Wireline Services, LLC; Defendant PerfX Wireline Services, LLC's Opening Claim Construction Brief; dated Oct. 18, 2021; 23 pages.
Perfx Wireline Services, LLC; Invalidity Chart for U.S. Pat. No. 10,844,697 in view of the Dynawell Gun System Exhibit A; dated Jul. 2, 2021; 42 pages.
Perfx Wireline Services, LLC; Invalidity Chart for U.S. Pat. No. 10,844,697 in view of the LRI Gun System Exhibit B; dated Jul. 2, 2021; 33 pages.
Perfx Wireline Services, LLC; Invalidity Chart for U.S. Pat. No. 10,844,697 in view of the Owen Oil Tools System Exhibit C; dated Jul. 2, 2021; 64 pages.LLC

(56) References Cited

OTHER PUBLICATIONS

Perfx Wireline Services, LLC; Invalidity Chart for U.S. Pat. No. 10,844,697 in view of the Select Fire System Exhibit D; dated Jul. 2, 2021; 49 pages.
Perfx Wireline Services, LLC; Invalidity Chart for U.S. Pat. No. 10,844,697 in view of U.S. Pat. No. 10,077,641 Exhibit H; dated Jul. 2, 2021; 41 pages.
Perfx Wireline Services, LLC; Invalidity Chart for U.S. Pat. No. 10,844,697 in view of U.S. Pat. No. 4,007,796 Exhibit F; dated Jul. 2, 2021; 40 pages.
Perfx Wireline Services, LLC; Invalidity Chart for U.S. Pat. No. 10,844,697 in view of U.S. Pat. No. 5,042,594 Exhibit E; dated Jul. 2, 2021; 38 pages.
Perfx Wireline Services, LLC; Invalidity Chart for U.S. Pat. No. 10,844,697 in view of U.S. Pat. No. 9,145,764 Exhibit G; dated Jul. 2, 2021; 58 pages.
Perfx's Wireline Services, LLC; Exhibit A: Invalidity Chart for U.S. Pat. No. 10,844,697 in view of the Dynawell Gun System; dated Aug. 30, 2021; 42 pages.
Perfx's Wireline Services, LLC; Exhibit A-2: Invalidity Chart for U.S. Pat. No. 10,844,697 in view of the LRI Gun System; dated Aug. 30, 2021; 29 pages.
Perfx's Wireline Services, LLC; Exhibit A-3: Invalidity Chart for U.S. Pat. No. 10,844,697 in view of the Owen Oil Tools System; dated Aug. 30, 2021; 42 pages.
Perfx's Wireline Services, LLC; Exhibit A-4: Invalidity Chart for U.S. Pat. No. 10,844,697 in view of the Select Fire System; dated Aug. 30, 2021; 32 pages.
Perfx's Wireline Services, LLC; Exhibit A-5: Invalidity Chart for U.S. Pat. No. 10,844,697 in view of U.S. Pat. No. 5,042,594; dated Aug. 30, 2021; 27 pages.
Perfx's Wireline Services, LLC; Exhibit A-6: Invalidity Chart for U.S. Pat. No. 10,844,697 in view of U.S. Pat. No. 4,007,796; dated Aug. 30, 2021; 23 pages.
Perfx's Wireline Services, LLC; Exhibit A-7: Invalidity Chart for U.S. Pat. No. 10,844,697 in view of U.S. Pat. No. 9,145,764; dated Aug. 30, 2021; 36 pages.
Perfx's Wireline Services, LLC; Exhibit A-8: Invalidity Chart for U.S. Pat. No. 10,844,697 in view of U.S. Pat. No. 10,077,6414; dated Aug. 30, 2021; 29 pages.
Perfx's Wireline Services, LLC; Exhibit A-9: Invalidity Chart for U.S. Pat. No. 10,844,697 in view of the SafeJet System; dated Aug. 30, 2021; 18 pages.
Perfx's Wireline Services, LLC; Exhibit B-1: Invalidity Chart for U.S. Pat. No. D904,475 in view of the Dynawell Tandem Sub; dated Aug. 30, 2021; 10 pages.
Perfx's Wireline Services, LLC; Exhibit B-2: Invalidity Chart for U.S. Pat. No. D904,475 in view of the LRI Tandem Subassembly; dated Aug. 30, 2021; 12 pages.
Perfx's Wireline Services, LLC; Exhibit B-3: Invalidity Chart for U.S. Pat. No. D904,475 in view of the Owen Oil Tools Tandem Sub; dated Aug. 30, 2021; 10 pages.
Perfx's Wireline Services, LLC; Exhibit B-4: Invalidity Chart for U.S. Pat. No. D904,475 in view of the XConnect Tandem Sub; dated Aug. 30, 2021; 1 page.
Perfx's Wireline Services, LLC; Exhibit B-5: Invalidity Chart for U.S. Pat. No. D904,475 in view of the SafeJet Disposable Bulkhead; dated Aug. 30, 2021; 15 pages.
Perfx's Wireline Services, LLC; Exhibit B-6: Invalidity Chart for U.S. Pat. No. D904,475 in view of Chinese Patent Application No. CN110424930A; dated Aug. 30, 2021; 9 pages.
Perfx's Wireline Services, LLC; Exhibit B-7: Invalidity Chart for U.S. Pat. No. D904,475 in view of U.S. Patent Publication No. 2020/0308938; dated Aug. 30, 2021; 8 pages.
Perfx's Wireline Services, LLC; Xconnect, LLC's Preliminary Invalidity Contentions for Civil Action No. 6:21-cv-00371-ADA; dated Aug. 30, 2021; 7 pages.
Preiss Frank et al.; Lowering Total Cost of Operations Through Higher Perforating Efficiency while simultaneously enhancing safety; May 10, 2016; 26 pages.
Repeat Precision, LLC; Plaintiff Repeat Precision, LLC's Responsive Claim Construction Brief for Civil Action No. 6:21-cv-104-ADA, Public Version; dated Oct. 27, 2021; 21 pages.
Resilience Against Market Volatility Results Presentation; Exhibit 2015 of PGR No. 2020-00080; dated Jun. 30, 2020; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Claim Construction Declaration for Civil Action No. 3:21-cv-00185; dated Sep. 28, 2021; 41 pages.
Rodgers, John; Claim Construction Declaration for Civil Action No. 3:21-cv-00188; dated Sep. 28, 2021; 42 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR No. 2021-00089; dated Sep. 16, 2021; 93 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Rodgers, John; Declaration for PGR2021-00078; dated Aug. 19, 2021; 137 pages.
Rodgers, John; Declaration of John Rodgers, Ph.D for PGR Case No. PGR2021-00097; dated Oct. 28, 2021; 124 pages.
Rodgers, John; Videotaped Deposition of John Rodgers; dated Jul. 29, 2021; 49 pages.
Salt Warren et al.; New Perforating Gun System Increases Safety and Efficiency; dated Apr. 1, 2016; 11 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Scharf Thilo; Declaration for PGR2020-00080; dated Nov. 16, 2020; 16 pages.
Scharf, Thilo; Declaration for PGR No. 2021-00089; dated Sep. 16, 2021; 8 pages.
International Searching Authority; International Search Report and Written Opinion for PCT App. No. PCT/EP2015/059381; Nov. 23, 2015; 14 pages.
International Searching Authority; International Search Report and Written Opinion for PCT App. No. PCT/EP2019/072064; Nov. 20, 2019; 15 pages.
International Searching Authority; International Search Report and Written Opinion for PCT App. No. PCT/US2015/018906; Jul. 10, 2015; 12 pages.
International Searching Authority; International Search Report and Written Opinion for PCT Application No. EP2020066327; mailed on Jan. 11, 2021; 17 pages.
International Searching Authority; International Search Report and Written Opinion of the International Searching Authority for PCT/EP2020/085622; mailed on Apr. 1, 2021; 10 pages.
International Searching Authority; International Search Report and Written Opinion of the International Searching Authority for PCT/EP2021/057570; mailed on Sep. 13, 2021; 21 pages.
International Searching Authority; International Search Report and Written Opinion of the International Searching Authority for PCT/EP2021/057148; mailed on Jul. 5, 2021; 11 pages.
International Searching Authority; International Search Report and Written Opinion of the International Searching Authority for PCT/EP2021/058182; mailed on Aug. 26, 2021; 16 pages.
International Searching Authority; International Search Report and Written Opinion of the International Searching Authority for PCT/EP2020/085624; mailed on Apr. 12, 2021; 11 pages.
International Searching Authority; International Searching Authority Partial Search Report and Invitation to Pay Additional Search Fees for PCT/EP2021/057570; mailed on Jul. 22, 2021; 17 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.

(56) References Cited

OTHER PUBLICATIONS

Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Lehr, Doug; Declaration of Doug Lehr in Supprt of Repeat Precision's Response Claim Construction Brief; dated Oct. 27, 2021; 35 pages.
Logan, et al.; International Patent Application No. PCT/CA2013/050986; dated Dec. 18, 2013; 54 pages.
Markel, Dan; Declaration regarding the SafeJet System for PGR2021-00097; dated Jul. 15, 2021; 21 pages.
McNelis et al.; High-Performance Plug-and-Perf Completions in Unconventional Wells; Society of Petroleum Engineers Annual Technical Conference and Exhibition; Sep. 28, 2015.
Meehan, Nathan; Declaration of D. Nathan Meehan, Ph.D, P.E; dated Oct. 18, 2021; 86 pages.
Merriam-Webster.Com, Insulator Definition, https://www.merriam-webster.com/dictionary/insulator, Jan. 31, 2018, 4 pages.
Nextier Completion Solutions Inc .; Defendant NexTier Completion Solution Inc.'s Opening Claim Construction Brief; dated Oct. 18, 2021; 26 pages.
Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.
Nextier Completion Solutions Inc.; Defendant's Preliminary Invalidity Contentions for Civil Action No. 6:20-cv-01201-ADA; dated Aug. 30, 2021; 21 pages.
Nextier Completion Solutions Inc.; Exhibit A-9 Selective perforation: A Game Changer in Peforating Technology—Case Study; dated Aug. 30, 2021; 13 pages.
Nextier Completion Solutions; Plaintiffs Preliminary Invalidity Contentions for Civil Action No. 4:21-cv-01328; dated Jun. 30, 2021; 19 pages.
Nextier Oilfield Solutions Inc; Petition for Inter Partes Review No. IPR2021-00082; dated Oct. 21, 2020; 111 pages.
Nexus Perforating LLC; Answer to DynaEnergetics Europe GMBH and DynaEnergetics US Inc/'s Complaint and Counterclaims; dated Apr. 15, 2021; 10 pages.
Nexus Perforating LLC; Complaint and Demand for Jury Trial for Civil Case No. 4:20-cv-01539; dated Apr. 30, 2020; 11 pages.
Nexus Perforating LLC; Invalidity Contentions for Civil Action No. 4:21-cv-00280; dated Jun. 30, 2021; 44 pages.
Nexus Perforating LLC; Nexus Perforating LLC's Responsive Claim Construction Brief for Civil Action No. 4:21-cv-00280; dated Nov. 3, 2021; 31 pages.
Nexus Perforating LLC; Nexus Preliminary Claim Construction and Extrinsic Evidence for Civil Action No. 4:21-cv-00280; dated Aug. 4, 2021; 6 pages.
Norwegian Industrial Property Office; Notice of Allowance for NO Application No. 20171759; dated Apr. 23, 2021; 2 pages.
Norwegian Industrial Property Office; Office Action and Search Report for NO App. 20160017; Jun. 15, 2017; 5 pages.
Norwegian Industrial Property Office; Office Action and Search Report for NO App. 20171759; Jan. 14, 2020; 6 pages.
Norwegian Industrial Property Office; Office Action for NO Appl. No. 20160017; mailed Dec. 4, 2017; 2 pages.
Norwegian Industrial Property Office; Office Action for NO Appl. No. 20171759; mailed Oct. 30, 2020; 2 pages.
Norwegian Industrial Property Office; Office Action for NO Appl. No. 20210799; dated Oct. 30, 2021; 2 pages.
Norwegian Industrial Property Office; Opinion for NO Appl. No. 20171759; mailed Apr. 5, 2019; 1 page.
Oilfield Glossary; Definition of Perforating Gun; dated Feb. 26, 2013; 2 pages.
oilgasglossary.com; Definition of "sub"; dated Nov. 20, 2008; 1 page.
Olsen, Steve; Declaration regarding the SafeJet System for PGR2021-00097; dated Jul. 16, 2021; 25 pages.
Oso Perforating, LLC; Defendant's Preliminary Invalidity Contentions for Civil Action No. 3:21-cv-00188-M; dated Aug. 4, 2021; 23 pages.
Oso Perforating, LLC; *Exhibit A1 U.S. Pat. No. 5,155,293 to Barton* vs. *Asserted Claims of U.S. Pat. No. 10,844,697*; dated Aug. 4, 2021; 21 pages.
Owen Oil Tools & Pacific Scientific; RF-Safe Green Det, Side Block for Side Initiation, Jul. 26, 2017, 2 pgs.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
International Searching Authority; International Preliminary Report on Patentability of the International Searching Authority for PCT/EP2021/058182; mailed on Oct. 13, 2022, 9 pages.
International Searching Authority; International Search Report and Written Opinion of the International Searching Authority for PCT/EP2021/079019; mailed on Feb. 28, 2022; 14 pages.
International Searching Authority; International Search Report and Written Opinion of the International Searching Authority for PCT/EP2021/058182; mailed on Oct. 13, 2022, 12 pages.
United States Patent and Trademark Office; Notice of Allowance for U.S. Appl. No. 17/206,416; dated Dec. 29, 2021; 8 pages.
Norwegian Patent Office; Office Action issued for NO Application No. 20210799 dated Jan. 17, 2024, 3 pages.
Norwegian Patent Office; Approval for Grant of NO Application No. 20170507 dated Oct. 18, 2023, 2 pages.
United States Patent and Trademark Office; Ex Parte Quayle Action issued for U.S. Appl. No. 17/223,899 dated Aug. 29, 2023; 6 pages.
Norwegian Patent Office; Office Action issued for NO Application No. 20171759 dated Jan. 14, 2020, 4 pages.
Norwegian Patent Office; Search Report issued for NO Application No. 20171759 dated Jan. 14, 2020, 2 pages.
Norwegian Patent Office; Office Action issued for NO Application No. 20180507 dated Jan. 23, 2023; 3 pages.
Norwegian Patent Office; Search Report issued for NO Application No. 20180507 dated Jan. 13, 2023; 2 pages.
United States Patent and Trademark Office; Non-Final Office Action issued for U.S. Appl. No. 17/951,606 dated Jan. 17, 2023; 11 pages.
United States Patent and Trademark Office; Notice of Allowance issued for U.S. Appl. No. 16/540,484 dated Jan. 5, 2023; 7 pages.
United States Patent and Trademark Office; Requirement for Restriction / Election issued for U.S. Appl. No. 17/223,899 dated Mar. 17, 2023; 5 pages.
United States Patent and Trademark Office; Final Written Decision on PGR2021-00097; issued Jan. 3, 2023; 112 pages.
United States District Court for the Southern District of Texas; Memorandum Opinion and Order for Civil Action No. H-20-2123 dated Sep. 19, 2022; 115 pages.
United States Patent and Trial Appeal Board; Final Written Decision on PGR2021-00078; issued Oct. 28, 2022; 139 pages.
Inpi Argentina; Office Action for Application No. 20190101834 dated Aug. 22, 2022; 3 pages.
Norwegian Patent Office; Search Report issued for NO Application No. 20180507 dated Sep. 29, 2022; 2 pages.

(56) References Cited

OTHER PUBLICATIONS

United States Patent and Trademark Office; Notice of Allowance for U.S. Appl. No. 16/809,729 dated Sep. 21, 2022; 7 pages.
United States Patent and Trademark Office; Notice of Allowance for U.S. Appl. No. 17/007,574 dated Sep. 26, 2022; 8 pages.
United States Patent and Trademark Office; Notice of Allowance for U.S. Appl. No. 17/352,728 dated Sep. 21, 2022; 8 pages.
D&H Diversified Manufacturing LP; Petitioner's Oral Argument Presentation for PGR No. PGR2021-00078 dated Jul. 26, 2022; 65 pages.
International Searching Authority; International Preliminary Report on Patentability of the International Searching Authority for PCT/EP2020/085624; mailed on Jun. 23, 2022; 6 pages.
SWM International, LLC and Nextier Completion Solutions Inc; Petitioner's Reply to Patent Owner's Response to Petition for Case No. PGR2021-0097 dated Jul. 29, 2022; 36 pages.
3M, CTC Medical Repair, Inc.; Threaded Retaining Ring for 3M K220 Sagittal Saw Attachment; dated Jul. 12, 2010; 1 page; URL: http://www.ctcmedrepair.com/sales/index.php?main_page=product_info&cPath=2_3&products_id=323.
Amit Govil, Selective Perforation: A Game Changer in Perforating Technology—Case Study, presented at the 2012 European and West African Perforating Symposium, Schlumberger, Nov. 7-9. 2012, 14 pgs.
ANU Industries; Retainer Ring—Metal Retainer Ring Manufacturer from Coimbatore; dated Jun. 28, 2012; 3 pages; URL: https://www.indiamart.com/anuindustries-coimbatore/retainer-ring.html.
Core Lab, ZERO180™ Gun SystemAssembly and Arming Procedures, 2015, 33 pgs., https://www.corelab.com/owen/CMS/docs/Manuals/gunsys/zero180/MAN-Z180-000.pdf.
Dynaenergetics Europe Gmbh; Patent Owner's Preliminary Response for PGR2020-00072; dated Oct. 23, 2020; 108 pages.
Dynaenergetics Europe Gmbh; Patent Owner's Preliminary Response for PGR2020-00080; dated Nov. 18, 2020; 119 pages.
Dynaenergetics Europe; Complaint and Demand for Jury Trial, Civil Action No. 6:20-cv-00069; dated Jan. 30, 2020; 9 pages.
Dynaenergetics Europe; Complaint and Demand for Jury Trial, Civil Action No. 4:17-cv-03784; dated Dec. 14, 2017; 7 pages.
Dynaenergetics Europe; DynaEnergetics exhibition and product briefing; 2013; 15 pages.
Dynaenergetics Europe; Plaintiffs' Motion to Dismiss Defendants' Counterclaim and to strike Affirmative Defenses, Civil Action No. 4:17-cv-03784; dated Feb. 20, 2018; 9 pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiffs' Response to Defendants' Answer to Second Amended Complaint Civil Action No. 6:20-cv-00069-ADA; dated May 26, 2020; 18 pages.
GE Oil & Gas, Addressable Downhole Release Tools, Mar. 23, 2018, 5 pgs., https://www.bhge.com/upstream/evaluation/wireline-products-and-equipment/downhole-equipment/addressable-downhole-release-tools.
Hunting Titan Division, Marketing White Paper: H-1@ Perforating Gun System, Jan. 2017, 5 pgs., http://www.hunting-intl.com/media/2674690/White%20Paper%20-%20H-1%20Perforating%20Gun%20Systems_January% 202017.pdf.
Hunting Titan LTD,; Defendants' Answer and Counterclaims, Civil Action No. 4:19-cv-01611, consolidated to Civil Action No. 4:17-cv-03784; dated May 28, 2019; 21 pages.
Hunting Titan LTD.; Petition for Inter Partes Review of U.S. Pat. No. 9,581,422 Case No. IPR2018-00600; dated Feb. 16, 2018; 93 pages.
Hunting Titan LTD.; Defendants' Answer and Counterclaims, Civil Action No. 6:20-cv-00069; dated Mar. 17, 2020; 30 pages.
Hunting Titan LTD.; Defendants' Answer to First Amended Complaint and Counterclaims, Civil Action No. 6:20-cv-00069; dated Apr. 6, 2020; 30 pages.
Hunting Titan LTD.; Defendants' Answer to Second Amended Complaint and Counterclaims, Civil Action No. 6:20-cv-00069; dated May 12, 2020; 81 pages.
Hunting Titan LTD.; Defendants Invalidity Contentions Pursuant to Patent Rule 3-3, Civil Action No. 4:17-cv-03784; dated Jul. 6, 2018; 29 pages.
Hunting Titan LTD.; Defendants' Objections and Responses to Plaintiffs' First Set of Interrogatories, Civil Action No. 4:17-cv-03784; dated Jun. 11, 2018; 22 pages.
Hunting Titan LTD.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, T-Set Setting Tool Product Catalog, 2015, 87 pgs., http://www.hunting-intl.com/media/1872254/AMG-1054.HT_T-Set_Catalog_LowRes.pdf.
Jet Research Center, Velocity™ Perforating System Plug and Play Guns For Pumpdown Operation, Ivarado, Texas, Jul. 2019, 8 pgs., https://www.jetresearch.com/content/dam/jrc/Documents/Brochures/jrc-velocity-perforating-system.pdf.
Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.
Pool Supply World; Paramount—Threaded Nozzle Retainer Ring for Pool Valet, White; dated May 9, 2021; 3 pages; URL: https://poolsupplyworld.com/301817.html#description-btn-div.
Preiss Frank et al.; Lowering Total Cost of Operations Through Higher Perforating Efficiency while simultaneously enhancing safety; 26 pages.
Scharf, Thilo; Declaration for PGR2020-00072; dated Oct. 22, 2020; 13 pages.
Schlumberger, Perforating Services Catalog, 2008, 521 pages.
Schlumberger; Selective Perforation: A Game Changer in Perforating Technology—Case Study; issued 2012; 14 pages.
Dynaenergetics Europe GMBH; Complaint and Demand for Jury Trial for Civil Action No. 4:21-cv-00280; dated Jan. 28, 2021; 55 pages.
Dynaenergetics Europe GMBH; Exposed Gun Subs & Accessories; dated May 23, 2017; https://www.dynaenergetics.com/products/hardware-and-tcp/perforating-gun-systems/exposed-gun-subs-accessories.
Dynaenergetics Europe GMBH; Patent Owner's Preliminary Response for PGR No. 2021-00089; dated Sep. 16, 2021; 106 pages.
Dynaenergetics Europe GMBH; Patent Owner's Preliminary Response for PGR2021-00078; dated Aug. 19, 2021; 114 pages.
Dynaenergetics Europe GMBH; Plaintiff's Preliminary Infringement Contentions for Civil Action No. 6:21-cv-01110; dated Jul. 6, 2021; 6 pages.
Dynaenergetics Europe GMBH; Principal and Response Brief of Cross-Appellant for United States Court of Appeals case No. 2020-2163, -2191; dated Jan. 11, 2021; 95 pages.
Dynaenergetics Europe GMBH; Reply Under 37 C.F.R. §1.111 Amendment Under 37 C.F.R. §1.121 for U.S. Appl. No. 16/585,790; dated Feb. 20, 2020; 18 pages.
Dynaenergetics Europe, GMBH; DynaEnergetics' Preliminary Claim Construction and Extrinsic Evidence for Civil Action No. 4:21-cv-00280; dated Aug. 4, 2021; 10 pages.
Dynaenergetics Europe, GMBH; Patent Owner's Preliminary Response for PGR No. 2021-00097; dated Oct. 29, 2021; 110 pages.
Dynaenergetics Europe; Defendants' Preliminary Infringement Contentions for Civil Action No. 3:20-CV-00376; dated Mar. 25, 2021; 22 pages.
Dynaenergetics Europe; DynaEnergetics Celebrates Grand Opening of DynaStage Manufacturing and Assembly Facilities in Blum, Texas; dated Nov. 16, 2018; 3 pages.
Dynaenergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.

(56) References Cited

OTHER PUBLICATIONS

Dynaenergetics Europe; Exhibit B Invalidity Claim Chart for Civil Action No. 4:19-cv-01611; dated May 2, 2019; 52 pages.
Dynaenergetics Europe; Petition to Correct Inventorship in Patent under 37 C.F.R § 1.324; dated Oct. 13, 2020; 21 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Pending Motion For Reconsideration for Civil Action No. 4:17-cv-03784; dated Jan. 21, 2021; 4 pages.
Dynaenergetics Europe; Plaintiff's Preliminary Infringment Contentions Civil Action No. 3:21-cv-00192-M; dated Jun. 18, 2021; 15 pages.
Dynaenergetics Europe; Plaintiffs' Reply in Support of Motion to Dismiss and Strike for Civil Action No. 6:20-cv-00069-ADA; dated Apr. 29, 2020; 15 pages.
Dynaenergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
DynaEnergetics exhibition and product briefing; Exhibit 2006 of PGR No. 2020-00072; dated 2013; 15 pages.
Dynaenergetics GMBH & CO. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, No Debris Gun System (NDG), Hamburg, Germany, Feb. 6, 2008, 26 pgs.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Dynaenergetics; DynaStage Solution—Factory Assembled Performance-Assured Perforating Systems; 6 pages.
DynaStage Gun System; Exhibit 2009 of PGR No. 2020-00080; dated May 2014; 2 pages.
Entchev et al., Autonomous Perforating System for Multizone Completions, SPE International, 2011, 7 pgs., https://www.onepetro.org/conference-paper/SPE-147296-MS.
European Patent Office; Office Action for EP App. No. 15721178.0; issued Sep. 6, 2018; 5 pages.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; issued Dec. 13, 2016; 2 pages.
G&H Diversified Manufacturing, LP; Defendant G&H Diversified Manufacturing, LP's Answer to Counter-Claim Plaintiffs' Counter-Claims for Civil Action No. 3:20-cv-00376; dated Apr. 19, 2021; 13 pages.
Fayard, Alfredo; Declaration of Alfredo Fayard; dated Oct. 18, 2021; 13 pages.
Federal Institute of Industrial Property; Decision of Granting for RU Appl. No. 2016104882/03(007851); May 17, 2018; 15 pages (English translation 4 pages).
Federal Institute of Industrial Property; Decision on Granting a Patent for Invention Russian App. No 2016139136/03(062394); issued Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
G&H Diversified Manufacturing LP; Petition for Post Grant Review PGR No. 2021-00078; dated May 10, 2021; 122 pages.
G&H Diversified Manufacturing, LP and Dynaenergetics Europe Gmbh; Joint Claim Construction Statement for Civil Action No. 3:20-cv-00376; dated Jul. 8, 2021; 14 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger Technology Corporation, Defendant Schlumberger Technology Corporation's Opening Claim Construction Brief for Civil Action No. 6:21-cv-00225-ADA; dated Oct. 6, 2021; 27pages.
Schlumberger Technology Corporation; Defendant Schlumberger Technology Corporation's Reply To Plaintiffs' Responsive Claim Construction Brief; dated Nov. 10, 2021; 17 pages.
Schlumberger Technology Corporation; Defendant's Preliminary Invalidity Contentions; dated Aug. 19, 2021; 213 pages.
Schlumberger Technology Corporation; Exhibit A-01 to Defendant's Preliminary Invalidity Contentions Invalidity of U.S. Pat. No. 10,844,696 over WO20190148009; dated Aug. 19, 2021; 267 pages.
Schlumberger Technology Corporation; Exhibit A-02 to Defendant's Preliminary Invalidity Contentions Invalidity of U.S. Pat. No. 10,844,696 over U.S. Pat. No. 4,598,775; dated Aug. 19, 2021; 178 pages.
Schlumberger Technology Corporation; Exhibit A-03 to Defendant's Preliminary Invalidity Contentions Invalidity of U.S. Pat. No. 10,844,696 over U.S. Pat. No. 4,753,301; dated Aug. 19, 2021; 178 pages.
Schlumberger Technology Corporation; Exhibit A-04 to Defendant's Preliminary Invalidity Contentions Invalidity of U.S. Pat. No. 10,844,696 over U.S. Pat. No. 10,746,003; dated Aug. 19, 2021; 186 pages.
Schlumberger Technology Corporation; Exhibit A-05 to Defendant's Preliminary Invalidity Contentions Invalidity of U.S. Pat. No. 10,844,696 over WO2017/024266; dated Aug. 19, 2021; 247 pages.
Schlumberger Technology Corporation; Exhibit A-06 to Defendant's Preliminary Invalidity Contentions Invalidity of U.S. Pat. No. 10,844,696 over U.S. Pat. No. 4,479,556; dated Aug. 19, 2021; 250 pages.
Schlumberger Technology Corporation; Exhibit A-07 to Defendant's Preliminary Invalidity Contentions Invalidity of U.S. Pat. No. 10,844,696 over US2017/0145798; dated Aug. 19, 2021; 279 pages.
Schlumberger Technology Corporation; Petitioner's Reply to Patent Owner's Preliminary Response; dated Oct. 13, 2021; 14 pages.
Schlumberger; Field Test Database Print Out Showing uses of the SafeJet System; dated May 11, 2015; 10 pages.
Schlumberger; Lina Pradilla, Wireline Efficiency in Unconventional Plays—The Argentinean Experience, including excerpted image from slide 13; dated 2013; 15 pages http://www.perforators.org/wp-content/uploads/2015/10/SLAP_47_Wireline_Efficiency_Unconventional_Plays. pdf.
Sharma, Gaurav; Hunting Plc Is Not In A Race To The Bottom, Says Oilfield Services Firm's CEO; dated Sep. 10, 2019; retrieved on Nov. 18, 2020; 6 pages.
Shelby Sullivan; Declaration of Shelby Sullivan; dated Oct. 18, 2021; 9 pages.
SIPO, Search Report dated Mar. 29, 2017, in Chinese: See Search Report for CN App. No. 201480040456.9, 12 pgs. (English Translation 3 pgs.).
Smithson, Anthony; Declaration Declaration for IPR2021-00082; dated Oct. 16, 2020; 2 pages.

(56) References Cited

OTHER PUBLICATIONS

Smylie, Tom, New Safe and Secure Detonators for the Industry's consideration, presented at Explosives Safety & Security Conference, Marathon Oil Co, Houston; Feb. 23-24, 2005, 20 pages.
State Intellectual Property Office People's Republic of China; First Office Action for Chinese App. No. 201811156092.7; issued Jun. 16, 2020; 6 pages (Eng Translation 8 pages).
State Intellectual Property Office, P.R. China; First Office Action for Chinese App No. 201580011132.7; issued Jun. 27, 2018; 5 pages (Eng. Translation 9 pages).
State Intellectual Property Office, P.R. China; First Office Action for CN App. No. 201480047092.7; issued on Apr. 24, 2017.
State Intellectual Property Office, P.R. China; First Office Action with full translation for CN App. No. 201480040456.9; issued Mar. 29, 2017; 5 pages (English translation 7 pages).
State Intellectual Property Office, P.R. China; Notification to Grant Patent Right for Chinese App. No. 201580011132.7; issued Apr. 3, 2019; 2 pages (Eng. Translation 2 pages).
State Intellectual Property Office, P.R. China; Notification to Grant Patent Right for CN App. No. 201480040456.9; Jun. 12, 2018; 2 pages (English translation 2 pages).
State Intellectual Property Office, P.R. China; Second Office Action for CN App. No. 201480040456.9; issued Nov. 29, 2017; 5 pages (English translation 1 page).
State Intellectual Property Office, P.R. China; Second Office Action for CN App. No. 201480047092.7; issued Jan. 4, 2018; 3 pages.
Stifel; Why the Big Pause? Balancing Long-Term Value with Near-Term Headwinds. Initiating Coverage of Oilfield Svcs and Equipment; dated Sep. 10, 2018; 207 pages.
SWM International, LLC and Nextier Completion Solutions LLC; Petitioner's Preliminary Reply To Patent Owner's Preliminary Response for Case No. PGR2021-00097; dated Nov. 15, 2021; 11 pages.
SWM International, LLC and Nextier Oil Completion Solutions, LLC; Petition for Post Grant Review PGR No. 2021-00097; dated Jul. 20, 2021; 153 pages.
SWM International, LLC; Defendant's P.R. 3-3 and 3-4 Preliminary Invalidity Contentions; dated Aug. 4, 2021; 28 pages.
SWM International, LLC; Defendant's P.R. 4-1 Disclosure of Proposed Terms and Claim Elements for Construction for Civil Action No. 3:21-cv-00192-M; dated Aug. 24, 2021; 5 pages.
SWM International, LLC; EX. A-1 Invalidity of U.S. Pat. No. 10,844,697 Over the SafeJet System; dated Aug. 4, 2021; 15 pages.
SWM International, LLC; EX. A-1A Invalidity of U.S. Pat. No. 10,844,697 Over the SafeJet System in view of Backhus; dated Aug. 4, 2021; 4 pages.
SWM International, LLC; EX. A-1B Invalidity of U.S. Pat. No. 10,844,697 Over the SafeJet System in view of Harrigan; dated Aug. 4, 2021; 3 pages.
SWM International, LLC; EX. A-2 Invalidity of U.S. Pat. No. 10,844,697 Over Goodman; dated Aug. 4, 2021; 11 pages.
SWM International, LLC; EX. A-2A Invalidity of U.S. Pat. No. 10,844,697 Over Goodman in view of Backhus; dated Aug. 4, 2021; 3 pages.
SWM International, LLC; EX. A-2B Invalidity of U.S. Pat. No. 10,844,697 Over Goodman in view of Harrigan; dated Aug. 4, 2021; 3 pages.
SWM International, LLC; EX. A-3 Invalidity of U.S. Pat. No. 10,844,697 Over Harrigan; dated Aug. 4, 2021; 13 pages.
SWM International, LLC; EX. A-4 Invalidity of U.S. Pat. No. 10,844,697 Over Burton; dated Aug. 4, 2021; 11 pages.
SWM International, LLC; EX. A-5 Invalidity of U.S. Pat. No. 10,844,697 Over Rogman; dated Aug. 4, 2021; 10 pages.
SWM International, LLC; Exhibit B: DynaEnergetics' Infringement of U.S. Pat. No. 11,078,762 for Civil Action No. 6:21-cv-00804; dated Aug. 3, 2021; 22 pages.
SWM International; Drawing of SafeJet System; dated Jul. 20, 2021; 1 page.
SWM International; Photographs of SafeJet System; dated Jul. 20, 2021; 9 pages.
TOLTEQ; iSeries MWD System; dated 2021; 9 pages.
U.S. Patent Trial and Appeal Board, Institution of Inter Partes Review of U.S. Pat. No. 9581422, Case IPR2018-00600,Aug. 21, 2018, 9 pages.
United States District Court for the Northern District of Texas Dallas Division; Memorandum Opinion and Order in Civil Action No. 3:21-cv-00188-M; Mar. 23, 2022; 35 pages.
United States District Court for the Northern District of Texas Dallas Division; Memorandum Opinion and Order in Civil Action No. 3:21-cv-00192-M; Mar. 23, 2022; 34 pages.

* cited by examiner

PERFORATING GUN AND ALIGNMENT ASSEMBLY

CROSS REFERENCE TO RELATED APPLICATIONS

This application is a national stage application of and claims priority to Patent Cooperation Treaty (PCT) Application No. PCT/EP2021/079019 filed Oct. 20, 2021, which claims priority to U.S. Provisional Application No. 63/093,883 filed Oct. 20, 2020, which is incorporated herein by reference in its entirety, the content of which is incorporated herein by reference in its entirety.

BACKGROUND OF THE DISCLOSURE

Wellbore tools used in oil and gas operations, including perforation guns housing shaped charges, are often sent down a wellbore in tool strings connected together to reduce time and costs associated with the operation. Sub-assemblies connect adjacent wellbore tools to one another to form the tool string.

Hydraulic fracturing produces optimal results when perforations are oriented in the direction of maximum principle stress or the preferred fracture plane (PFP). Perforations oriented in the direction of the PFP create stable perforation tunnels and transverse fractures (perpendicular to the wellbore) that begin at the wellbore face and extend far into the formation. However, if fractures are not oriented in the direction of maximum stress, tortuous, non-transverse fractures may result, creating a complex near-wellbore flow path that can affect the connectivity of the fracture network, increase the chance of premature screen-out, and impede hydrocarbon flow. A wellbore tool string including perforating guns may frequently rest on a lower horizontal surface of a wellbore casing. This positioning may result in larger perforations being formed by shaped charges oriented toward the nearby horizontal surface, and smaller perforations being formed by shaped charges oriented away from the nearby horizontal surface.

Accordingly, there is a need for an alignment sub that allows alignment of the phasing of shaped charges in two or more adjacent perforation guns connected on a tool string. Further, there is a need for an orienting alignment sub assembly for orienting a wellbore tool with aligned shaped charges in a wellbore so consistently sized perforations may be formed by shaped charges oriented in different directions.

BRIEF DESCRIPTION

Embodiments of the disclosure are associated with a perforating gun and alignment assembly. The assembly includes a perforating gun housing formed from a singular and monolithic piece of metal material. The perforating gun housing includes a first housing end portion and a second housing end portion spaced apart from the first housing end portion. The first housing end portion includes an internal thread, and the second housing end portion includes a threaded end portion that includes an external thread. The second housing end portion further includes a friction reduction portion spaced apart from the threaded end portion, and a sealing portion extending between the threaded end portion and the friction reduction portion. A chamber extends from the first end portion towards the second end portion. An alignment assembly is rotatably secured to the second end portion of the perforating gun housing.

Additional embodiments of the disclosure are associated with a perforating gun and alignment assembly including a perforating gun housing formed from a singular and monolithic piece of metal material, and including a first housing end portion including an internal thread, a second housing end portion including a friction reduction portion, and a chamber extending from the first end portion towards the second end portion. An alignment assembly is rotatably secured to the second housing end portion of the perforating gun housing. According to an aspect, a shaped charge positioning device is positioned in the chamber of the perforating gun housing. The shaped charge positioning device includes a shaped charge holder portion for housing a shaped charge. The shaped charge holder portion may be configured to arrange a shaped charge in the chamber of the perforating gun housing.

Further embodiments of the perforating gun and alignment assembly includes a perforating gun housing including a first housing end portion including an internal thread, a second housing end portion including a threaded end portion including an external thread, and a friction reduction portion spaced apart from the threaded end portion. A chamber extends from the first housing end portion towards the second housing end portion. It is contemplated that the perforating gun housing may be formed from a singular and monolithic piece of metal material. According to an aspect, a shaped charge positioning device is positioned in the chamber. The shaped charge positioning device includes a shaped charge holder portion for housing a shaped charge. An electrically contactable bulkhead assembly may be sealingly secured in the second housing end portion of the perforating gun housing. According to an aspect, a retention collar is positioned adjacent the electrically contactable bulkhead assembly. A bulkhead body of the electrically contactable bulkhead assembly may be retained by an upper wall of the retention collar. According to an aspect, an alignment assembly is secured to the second end portion of the perforating gun housing. The alignment assembly is movable between a rotatable position and a non-rotatable position.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
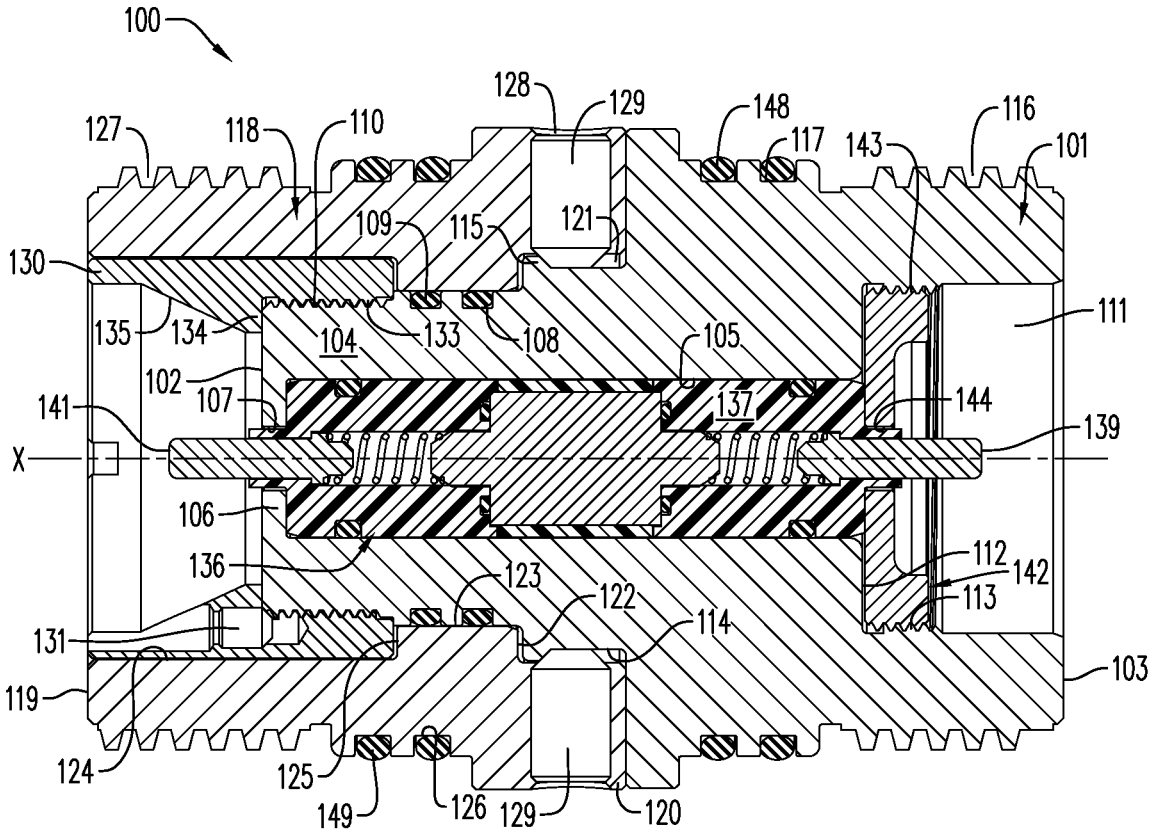
FIG. 1 is a cross-sectional view of an alignment sub according to an embodiment.
Figure 2:
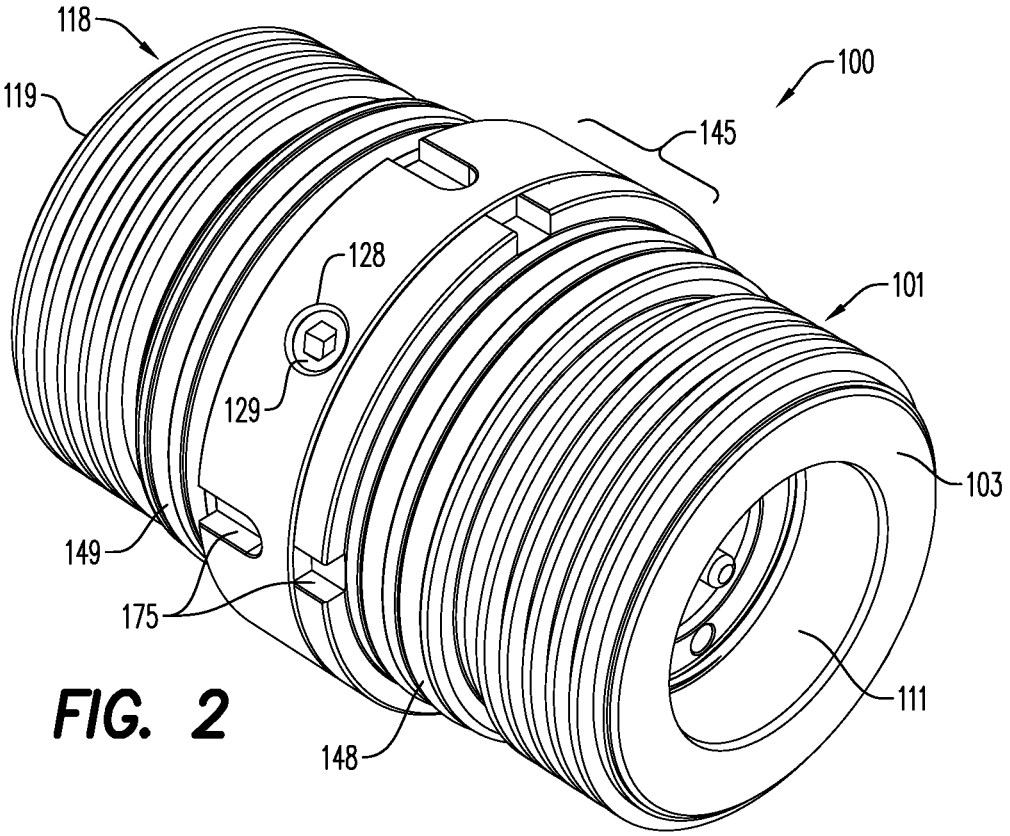
FIG. 2 is a perspective view of an alignment sub according to the embodiment shown in FIG. 1.
Figure 3:
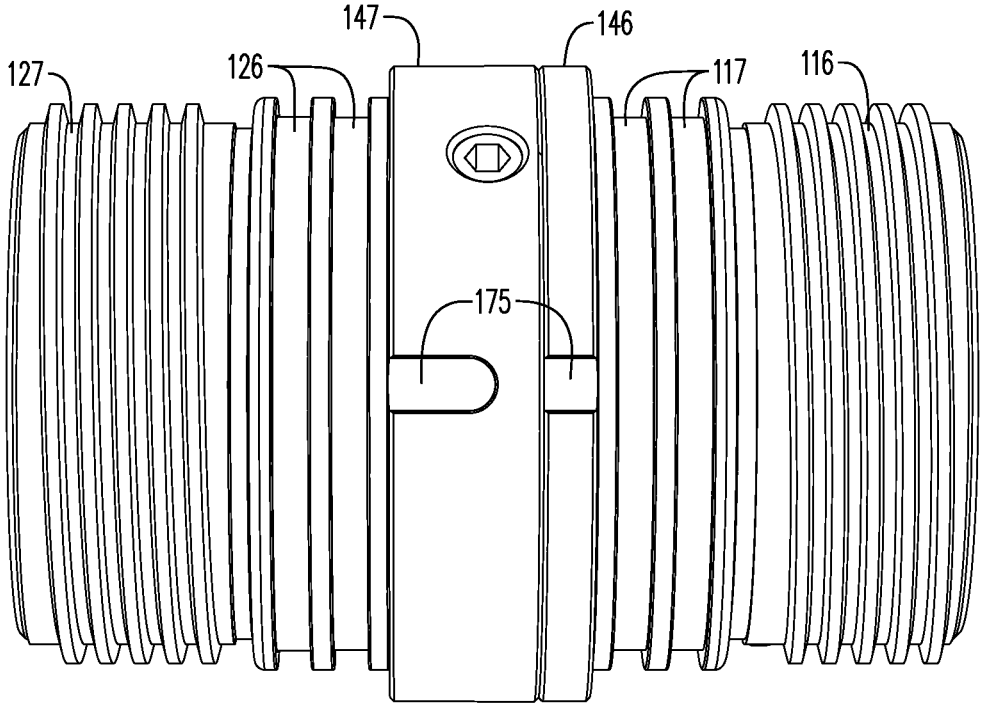
FIG. 3 is a side elevated view of an alignment sub according to the embodiment shown in FIG. 1.
Figure 4:
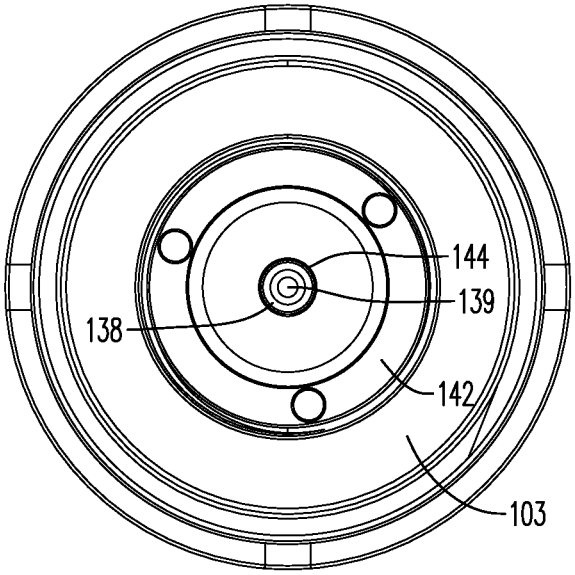
FIG. 4 is a front elevated view of an alignment sub according to the embodiment shown in FIG. 1.
Figure 5:
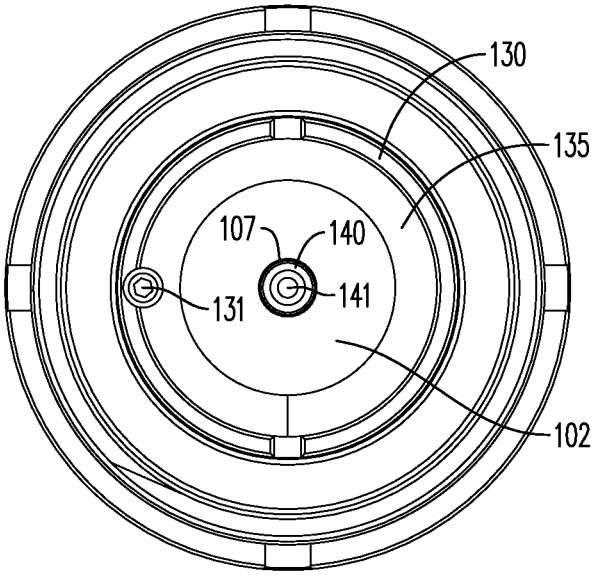
FIG. 5 is a rear elevated view of an alignment sub according to the embodiment shown in FIG. 1.
Figure 6:
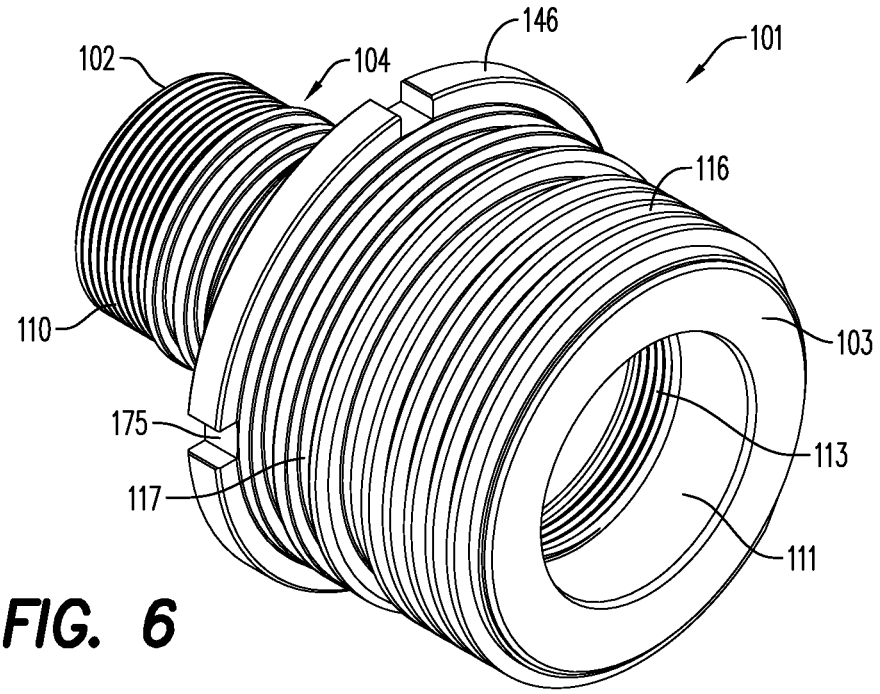
FIG. 6 is a front side perspective view of a first sub body part of an alignment sub according to an embodiment.
Figure 7:
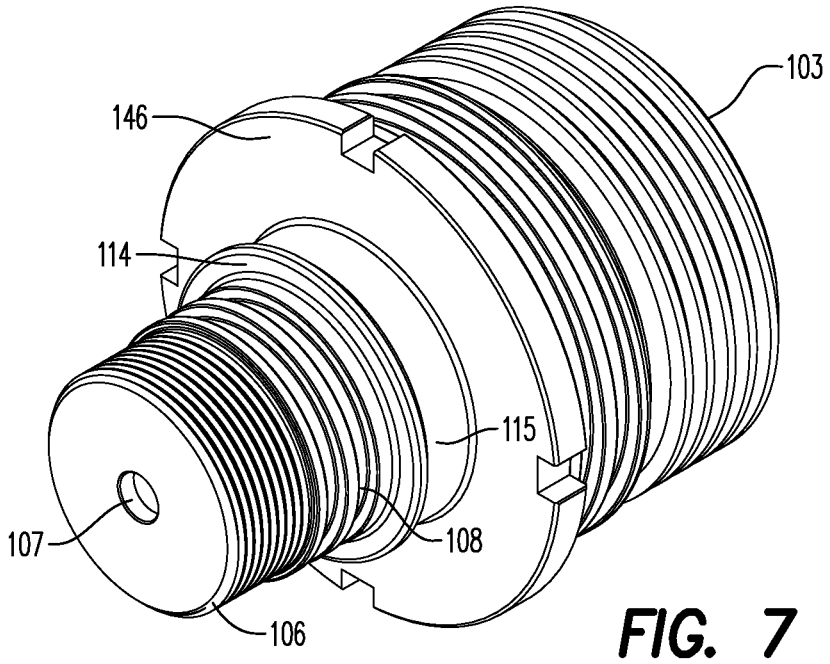
FIG. 7 is a rear side perspective view of a first sub body part of an alignment sub according to the embodiment shown in FIG. 6.
Figure 8:
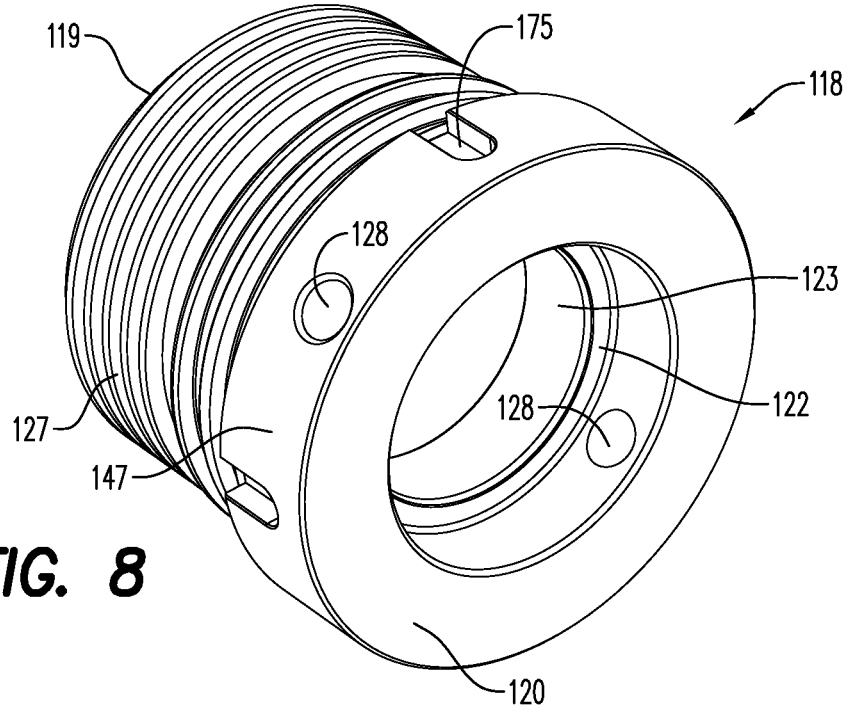
FIG. 8 is a front side perspective view of a second sub body part of an alignment sub according to an embodiment.
Figure 9:
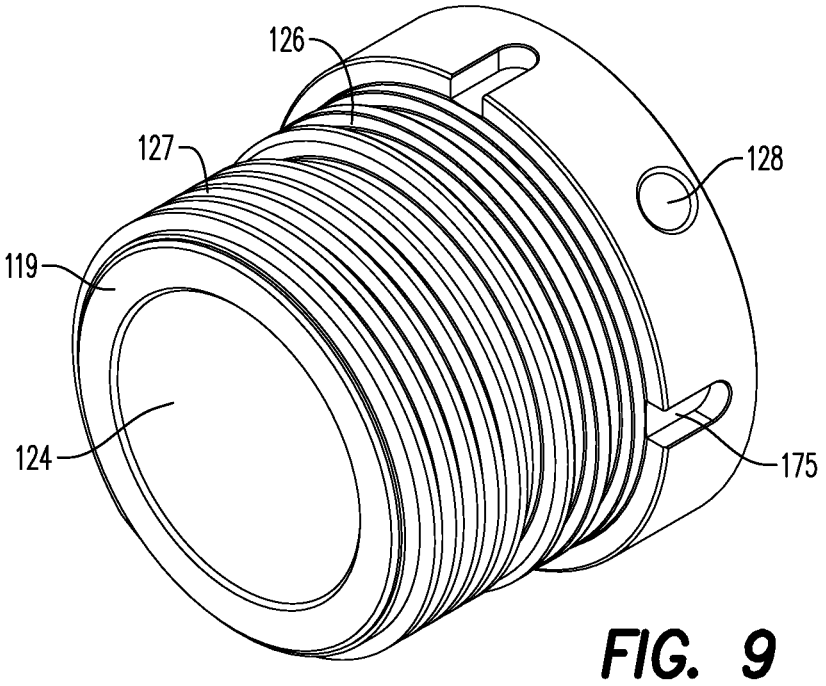
FIG. 9 is a rear side perspective view of a second sub body part of an alignment sub according to the embodiment shown in FIG. 8.
Figure 10:
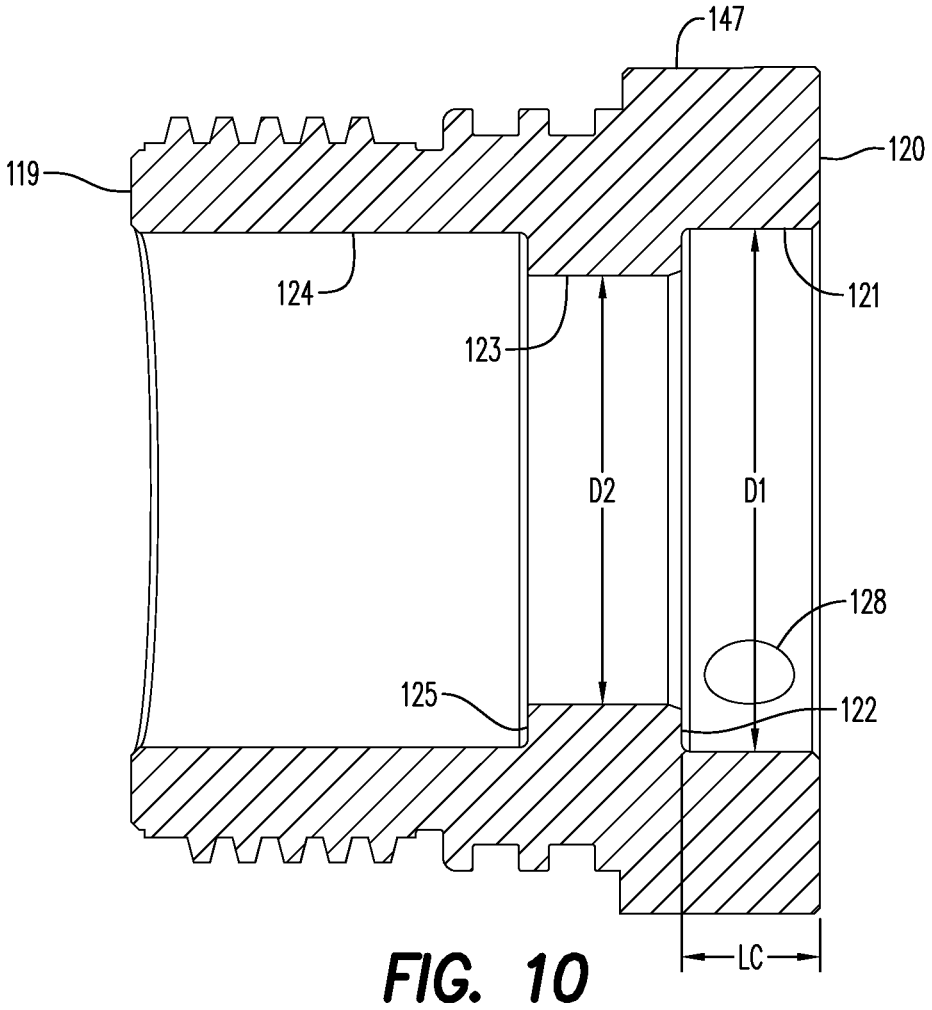
FIG. 10 is a cross-sectional side view of a second sub body part of an alignment sub according to the embodiment shown in FIGS. 8 and 9.
Figure 11:
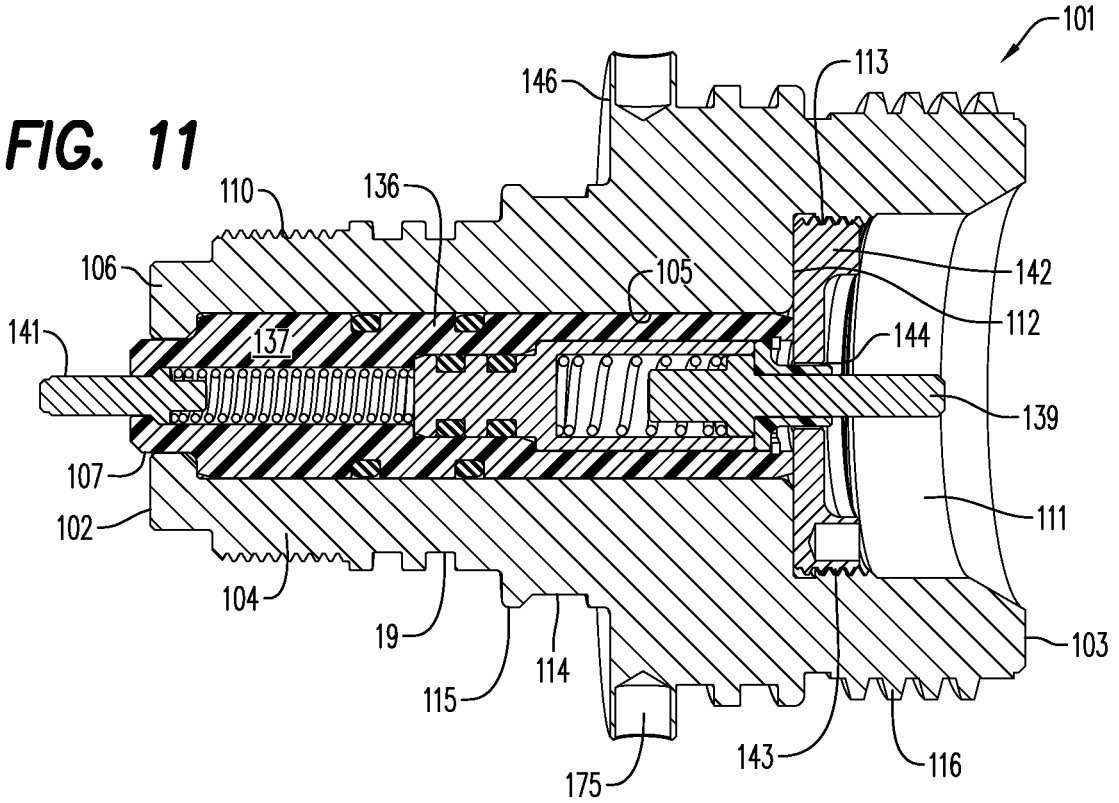
FIG. 11 is a cross-sectional side view of a partially assembled alignment sub according to an embodiment, showing a first sub body part.
Figure 12:
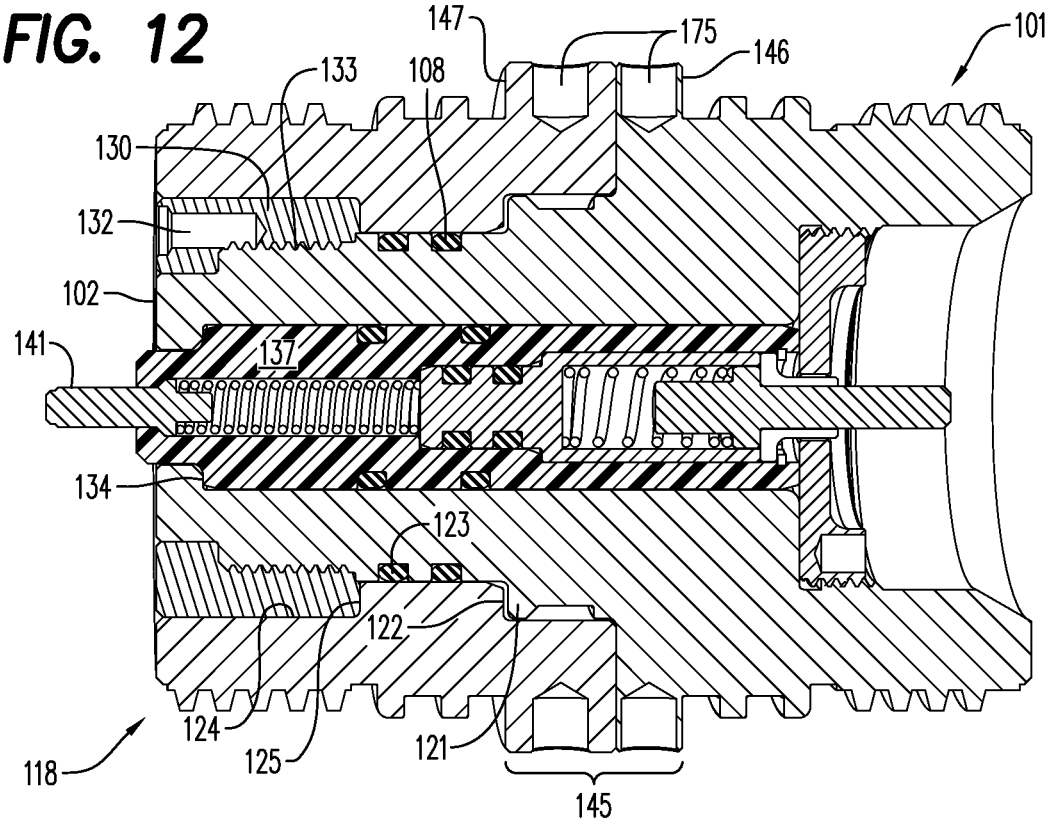
FIG. 12 is a cross-section side view of a partially assembled alignment sub according to the embodiment shown in FIG. 11, showing a first sub body part and a second sub body part.
Figure 13:
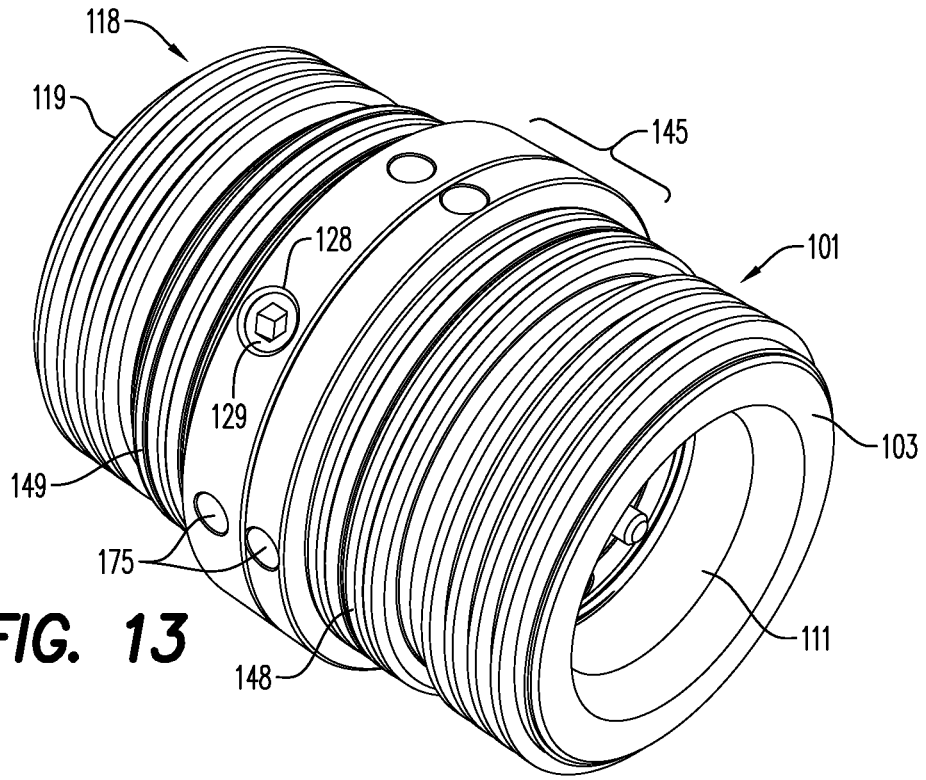
FIG. 13 is a perspective view of an alignment sub according to an embodiment.
Figure 14:
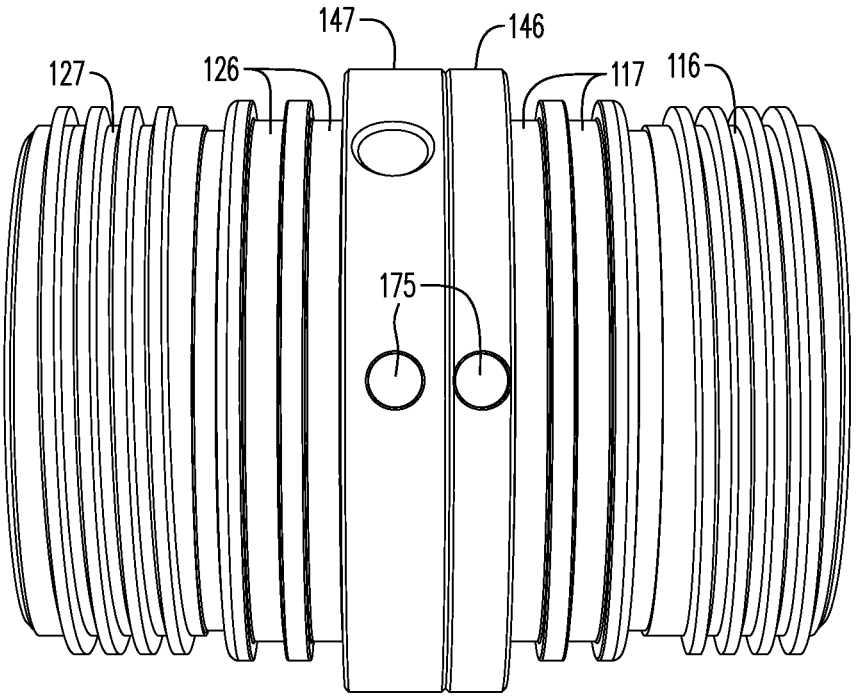
FIG. 14 is a side elevated view of an alignment sub according to the embodiment shown in FIG. 13.
Figure 15:
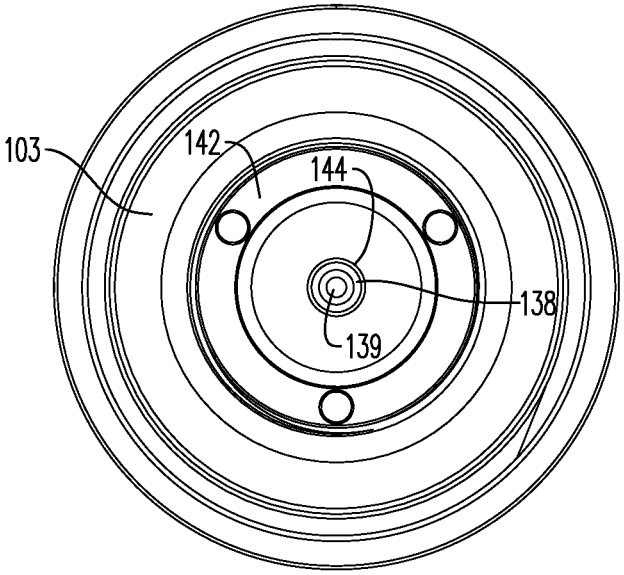
FIG. 15 is a front elevated view of an alignment sub according to the embodiment shown in FIG. 13.
Figure 16:
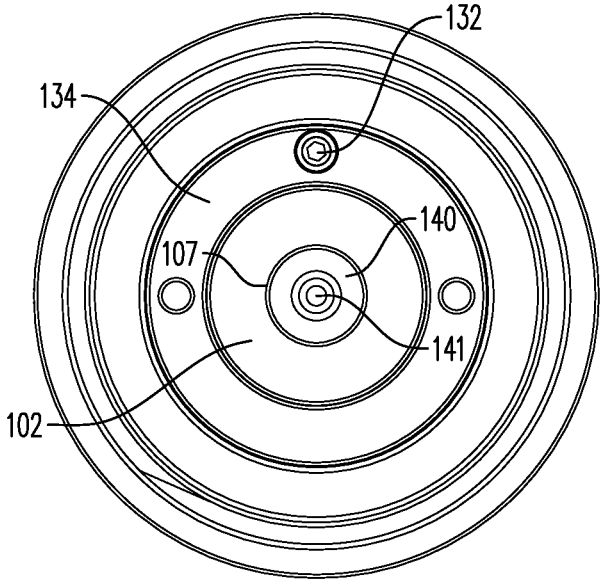
FIG. 16 is a rear elevated view of an alignment sub according to the embodiment shown in FIG. 13.
Figure 17:
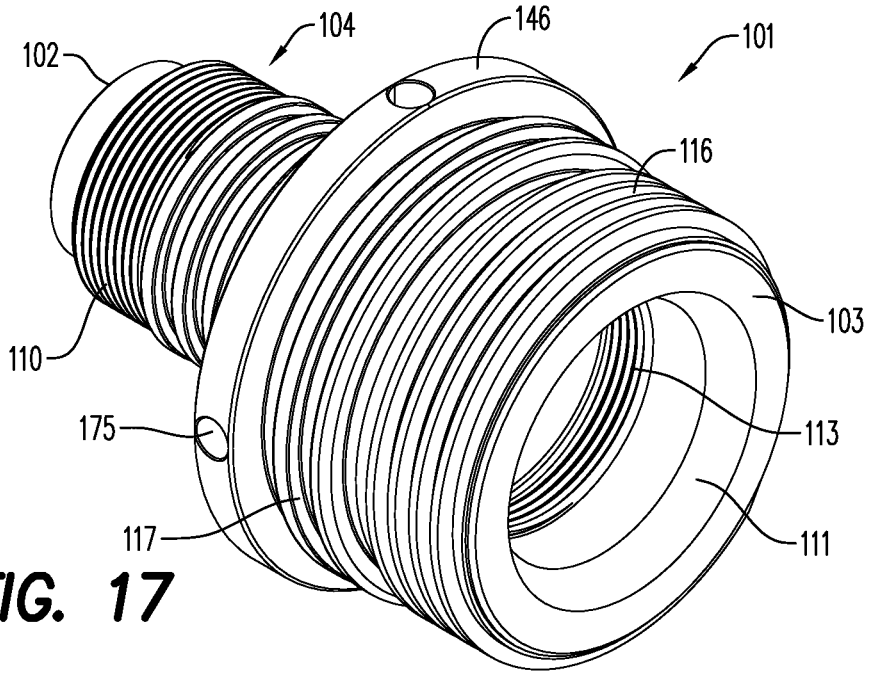
FIG. 17 is a front side perspective view of a first sub body part of an alignment sub according to an embodiment.
Figure 18:
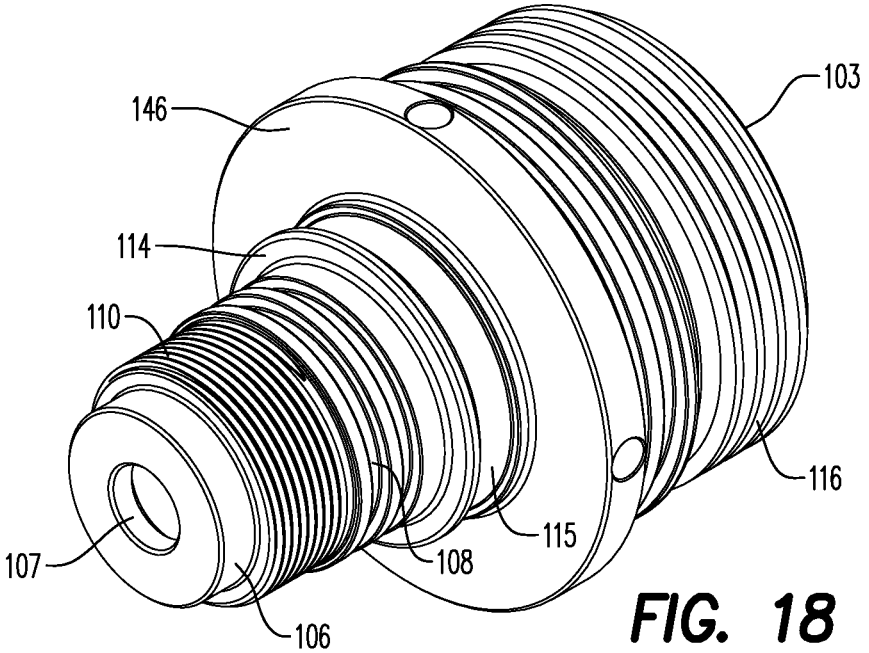
FIG. 18 is a rear side perspective view of a first sub body part of an alignment sub according to the embodiment shown in FIG. 17.
Figure 19:
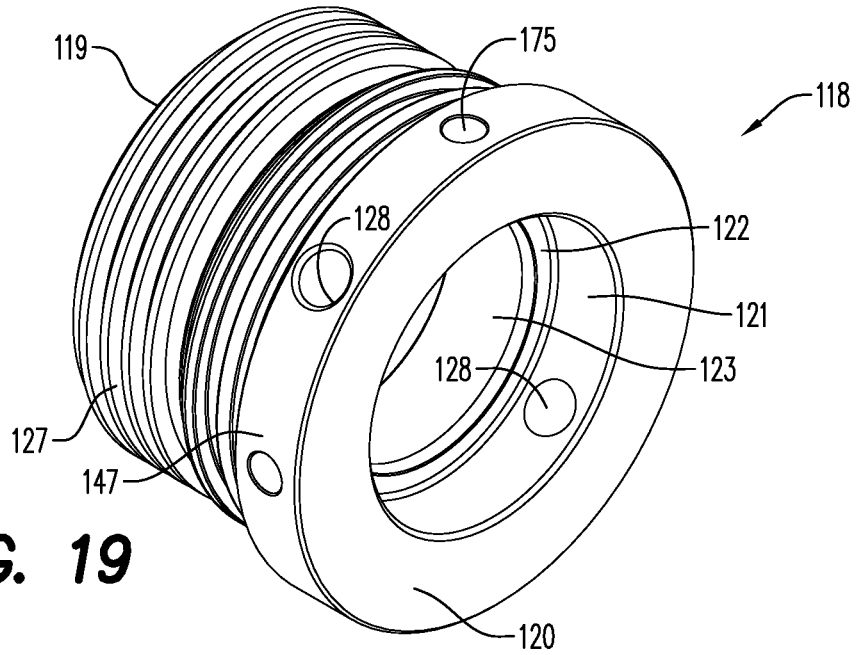
FIG. 19 is a front side perspective view of a second sub body part of an alignment sub according to an embodiment.
Figure 20:
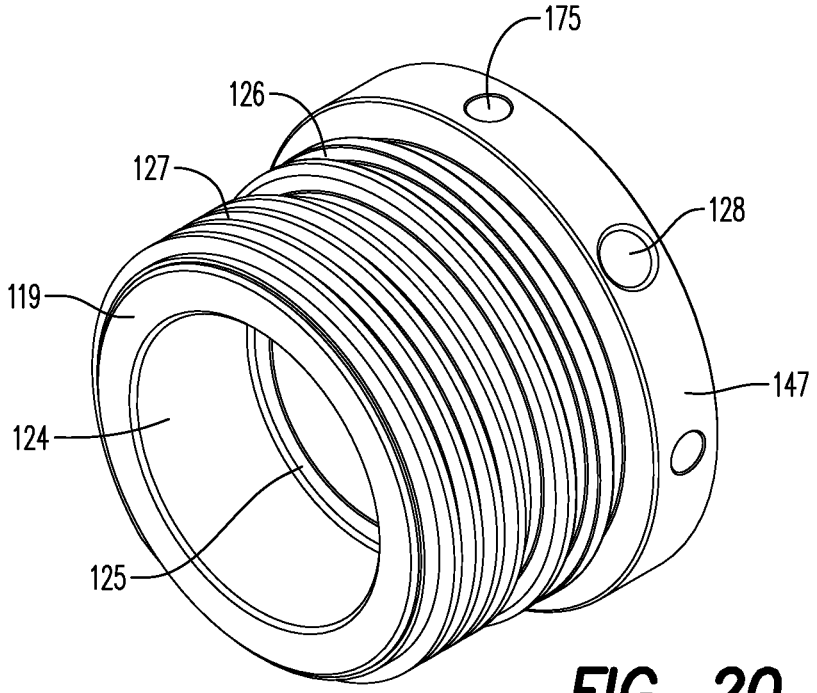
FIG. 20 is a rear side perspective view of a second sub body part of an alignment sub according to the embodiment shown in FIG. 19.
Figure 21:
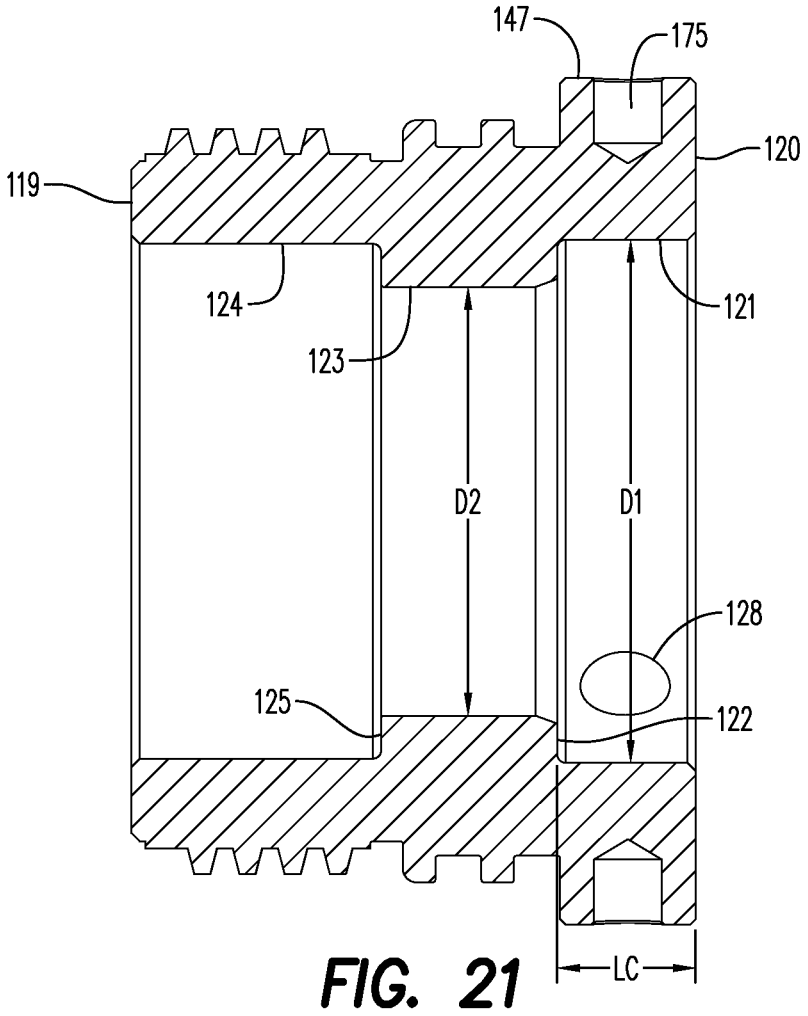
FIG. 21 is a cross-sectional side view of a second sub body part of an alignment sub according to the embodiment shown in FIGS. 19 and 20.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

FIGS. 1-10 show an exemplary embodiment of an alignment sub 100. The alignment sub 100 may include a first sub body part 101 and a second sub body part 118 rotatably coupled to the first sub body part 101.

With reference to FIGS. 1-4 and 6-7, the first sub body part 101 is shown in greater detail. The first sub body part 101 in the exemplary embodiment includes a first sub body part first end 102 and a first sub body part second end 103 spaced apart from the first sub body part first end 102. The first sub body part 101 includes an insertable portion 104 axially adjacent the first sub body part first end 102. A first sub body part bore 105 may extend in an x-direction along a central axis of rotation X (see FIG. 1) through a first sub body part insertable portion 104, between the first sub body part first end 102 and the first sub body part second end 103. According to an aspect, the first sub body part bore 105 has a bore longitudinal axis that is the central axis of rotation X of the alignment sub 100. In the exemplary embodiment shown in FIGS. 1-2, for example, a first sub body part recess 111 may extend from the first sub body part second end 103 to the first sub body part bore 105. The first sub body part bore 105 is defined on a first end by the first sub body part first end 102, and on a second end by a first sub body part recess wall 112. The first sub body part recess wall 112 extends radially between the first sub body part recess 111 and the first sub body part bore 105.

The first sub body part bore 105 may be dimensionally configured to receive an electrical assembly 136 for providing electrical conductivity through the length of the alignment sub 100. According to an aspect, the electrical assembly 136 is positioned in the first sub body part bore 105. The electrical assembly 136 may be, for example and not limitation, an electrically contactable bulkhead assembly including a bulkhead body 137 that is sealingly secured in the first sub body part bore 105. According to an aspect, the bulkhead body 137 may include a sealing element, such as a bulkhead o-ring 175, for frictionally and compressively engaging with an interior surface 177 of the first sub body part 101 radially adjacent to the first sub body part bore 105. The frictional engagement pressure seals the bulkhead body 137 in the first sub body part bore 105.

Figure 25:
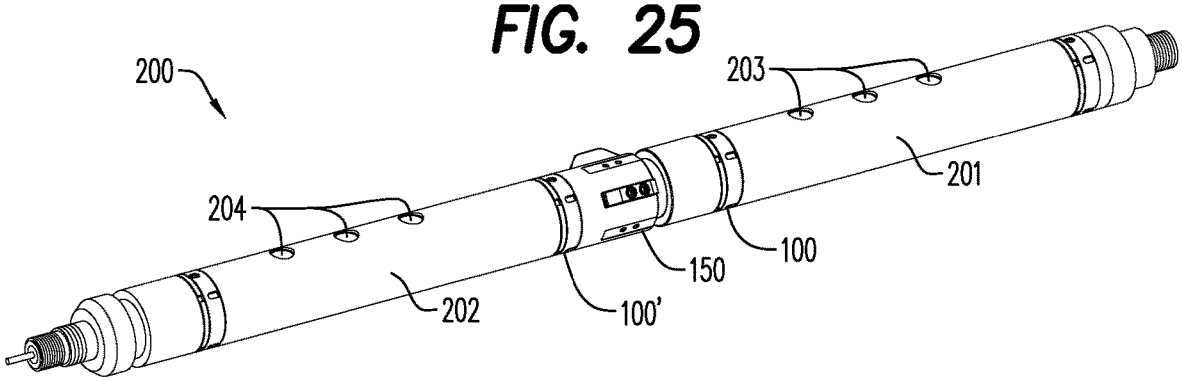
FIGS. 25 and 26 are perspective views of a perforating gun string according to an embodiment, including an orienting tandem seal adapter and alignment sub.

The electrical assembly 136, e.g., the bulkhead assembly 137, may include a bulkhead first end 138 including a first end bulkhead pin 139, and a bulkhead second end 140 including a second end bulkhead pin 141. The first end bulkhead pin 139 may be in electrical connection with the second end bulkhead pin 141. Each of the first end bulkhead pin 139 and second end bulkhead pin 141 are electrically contactable components. When used in a wellbore tool string to align a first wellbore tool 201 with a second wellbore tool 202 (see, e.g., FIG. 25), the first sub body part 101 may be non-rotatably coupled to a first wellbore tool 201, the second sub body part 118 may be non-rotatably coupled to a second wellbore tool 202, and the second sub body part 118 may be rotatably coupled to the first sub body part 101. The electrical assembly 136 positioned in the alignment sub 100 provides electrical conductivity through the alignment sub 100 from the first wellbore tool 201 to the second wellbore tool 202. The electrical assembly 136 provides electrical communication along a wellbore tool string when the first end bulkhead pin 139 is in contact with an electrically contactable component in a wellbore tool coupled to the second sub body part first end 119, and when the second end bulkhead pin 141 is in contact with an electrically contactable component in a wellbore tool coupled to the first sub body part second end 103.

Figure 26:
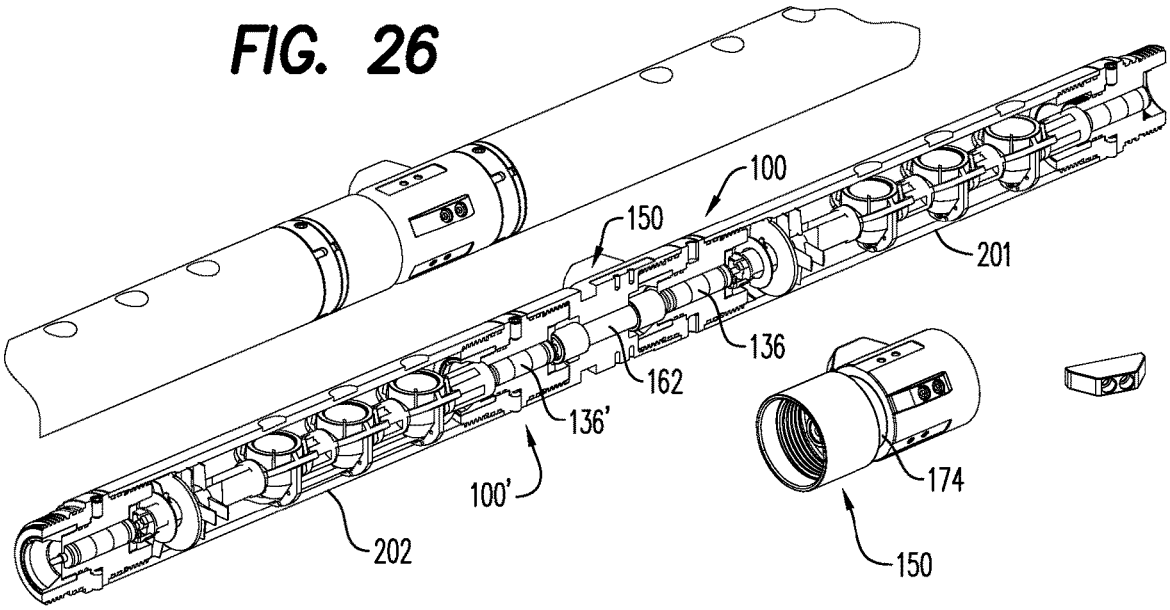

A bulkhead retainer 142 is positioned in the first sub body part recess 111 to secure the bulkhead assembly 137 in position in the first sub part bore 105. The bulkhead retainer 142 is positioned in the first sub body part recess 111 adjacent each of the first sub body part recess wall 112 and the first sub body part bore 105, and is dimensionally configured to contact an interior surface of the first sub body part 101 radially adjacent to the first sub body part recess 111. In the exemplary embodiment as shown in FIG. 1, the first sub body part 101 includes a threaded surface interior portion 113 that receives a threaded side surface 143 of the bulkhead retainer 142 in a threaded engagement so that the bulkhead retainer 142 is threadedly secured to the first sub body part 101. A bulkhead retainer aperture 144 is formed through the bulkhead retainer 142 such that the second end bulkhead pin 141 extends through the bulkhead retainer aperture 144. According to an aspect, the first sub body part recess 111 may be dimensionally configured to receive and house an end of an adjacent wellbore tool component, such as, for example and not limitation, an end of a shaped charge positioning device housed in a first wellbore tool 201 (see, e.g., FIG. 26). The second end bulkhead pin 141 of the bulkhead assembly 137 extends into the first sub body part recess 111. In the embodiment shown in FIG. 26, the first wellbore tool 201 is coupled to the first sub body part second end 103, such that an electrically contactable portion of the first wellbore tool 201 is in electrical contact with the second end bulkhead pin 141.

With continued reference to FIGS. 1-3 and 6-7, the first sub body part 101 in the exemplary embodiment includes on its first end 102 a first sub body part shoulder 106 formed adjacent the first end of the first sub body part bore 105. A first sub body part aperture 107 may be formed in the first sub body part shoulder 106, which may extend from the first sub body part bore 105 through the first sub body part shoulder 106. The first sub body part aperture 107 may have a diameter that is smaller than a diameter of the bulkhead body 137, so as to prevent the bulkhead body 137 from passing through the first sub body part bore 105. According to an aspect, the first sub body part aperture 107 is formed in the first sub body part shoulder 106 in alignment with the bulkhead first end 138, and the first end bulkhead pin 139 has a diameter that is less than the diameter of the first sub body part aperture 107 such that the first end bulkhead pin 139 extends through the first sub body part aperture 107 and into an interior of the second sub body part 118. According to an aspect, each of the bulkhead first end 138 and the first end bulkhead pin 139 may extend through the first sub body part aperture 107.

The second sub body part 118 in an exemplary embodiment is shown in FIGS. 1 and 8-10. The second sub body part 118 may include a second sub body part first end 119 and a second sub body part second end 120 spaced apart from the second sub body part first end 119. A second sub body part cavity 121 extends axially from the second sub body part second end 120 toward the second sub body part first end 119. According to an aspect, the second sub body part cavity 121 has a cavity longitudinal axis that is a central axis of rotation X of the alignment sub 100, such that the first sub body part bore 105 and the second sub body part cavity 121 are axially aligned. According to an aspect, a portion of the first sub body 101 is positioned within the second sub body part cavity 121.

In the exemplary embodiment, the second sub body part 118 may include a second sub body part medial channel 123 provided axially adjacent the second sub body part cavity 121 and away from the second sub body part second end 120. A second sub body part cavity wall 122 positioned away from the second sub body part second end 120 and extending inward in the second sub body part cavity 121 may separate the second sub body part cavity 121 from the second sub body part medial channel 123, such that the second sub body part cavity 121 has a first diameter D1, and the second sub body part medial channel 123 has a second diameter D2. According to an aspect, the first diameter D1 of the second sub body part cavity 121 is greater than the second diameter D2 of the second sub body part medial channel 123. The second sub body part 118 in an exemplary embodiment includes a second sub body part recess 124 formed adjacent the sub body part medial channel 123, extending in a x-direction from the second sub body part first end 119 toward the second sub body part second end 120 and the second sub body part cavity 121. The second sub body part recess 124 is separated from the second sub body part medial channel 123 by a second sub body part recess wall 125. According to an aspect, the diameter of the second sub body part recess 124 is greater than the second diameter D2 of the second sub body part medial channel 123. The second wellbore tool 202 is coupled to the second sub body part first end 119, such that an electrically contactable portion of the second wellbore tool 202 is in electrical contact with the first end bulkhead pin 139 (see FIG. 26).

In the exemplary embodiment, a second sub body part retainer ring 130 retains the first sub body part 101 inside the second sub body part 118. The second sub body part retainer ring 130 is engaged with an inner surface of the second sub body part 118 and with the first sub body part 101 to retain the position of the first sub body part 101 inside the second sub body part 118. The second sub body part retainer ring 130 extends from the second sub body part first end 119 to the second sub body part recess wall 125, and may include a retainer ring shoulder 134 that abuts the first sub body part first end 102. According to an aspect, the second sub body part retainer ring 130 is dimensionally configured to secure the first sub body part insertable portion 104 to the second sub body part 118. In the embodiment shown in FIGS. 1-10, the second sub body part retainer ring 130 includes a contoured inner wall 135 extending from the second sub body part first end 119 to the retainer ring shoulder 134. In a further embodiment, as shown in FIGS. 11-21, the second sub body part retainer ring shoulder 134 and the first sub body part first end 102 are abutting. According to an aspect, the first sub body part insertable portion 104 includes a threaded surface portion 110 positioned in the second sub body part recess 124.

The second sub body part retainer ring 130 includes a threaded collar 133 extending from the second sub body retainer ring shoulder 134 toward the second sub body part recess wall 125, wherein the threaded collar 133 is threadedly engaged with the threaded surface portion 110 to threadedly secure the first sub body part 101 in the second sub body part 118. With reference to FIGS. 1, 5, 12, and 16, a socket screw 131 is positioned in a second sub body part retainer ring screw socket 132 formed in the second sub body part retainer ring 130. According to an aspect, the second sub body part retainer ring screw socket 132 may rotationally fix the retainer ring 130 to the first sub body part 101. The retainer ring screw socket 132 in the exemplary embodiment at least partially abuts one of the first sub body part first end 102 and the first sub body part insertable portion 104.

A locking mechanism, such as a sub locking screw 129, in the alignment sub 100 is used to fix the relative angular/rotational position of the first sub body part 101 relative to an angular/rotational position of the second sub body part 118. According to an aspect, more than one sub locking screw 129 may be used to lock the position of the first sub body part 101 relative to the position of the second sub body part 118. According to an aspect, the sub locking screw 129 may be switchable between an unlocked state and a locked state such that, when the sub locking screw 129 is in the locked state, the angular position of the first sub body part 101 is fixed relative to an angular position of the second sub body part 118, and when the sub locking screw 129 is in the unlocked state, the second sub body part 118 is able to rotate relative to the first sub body part 101.

According to an aspect, the sub locking screw 129 is dimensionally configured to be secured in a locking screw socket 128 formed in a second sub body part rib 147. In the exemplary embodiment shown in FIG. 1, the second sub body part second end 120 is defined by a second sub body part rib 147 projecting from an outer surface of the second sub body part 118 and a sub locking screw socket 128 is formed in and extends through the second sub body part rib 147. The second sub body part second end 120/second sub body part rib 147 are positioned around a sub locking screw channel 114 formed in the first sub body part 101. The sub locking screw channel 114 in the exemplary embodiment overlaps with the sub locking screw socket 128 in an axial direction. In an unlocked state, the first sub body part 101 is able to rotate within the second sub body part cavity 121. In a locked state, the sub locking screw 129 is secured in the sub locking screw socket 128, such that an end of the sub locking screw 129 is secured in the sub locking screw channel. According to an aspect, the alignment sub 100 may include a plurality of locking screw sockets 128 spaced equidistantly about the second sub body part rib 147.

In the exemplary embodiment, the locking screw channel 114 includes a channel lip 115 that is formed on the first sub body part 101 axially adjacent to the locking screw channel 114. The channel lip 115 defines a boundary of the locking screw channel 114 in which the sub locking screw 129 is received and secured when the alignment sub 100 is in the locked state. According to an aspect, a diameter of the first sub body part 101 at the channel lip 115 is larger than a diameter of the first sub body part 101 at the locking screw channel 114. In the exemplary embodiment, the channel lip 115 extends outward from the first sub body part 101 and abuts the second sub body part cavity wall 122 to align the locking screw channel 114 with the sub locking screw socket 128 in the second sub body part rib 147 for locking the alignment sub 100 in the locked state.

The first sub body part 101 according to the exemplary embodiment is secured in the second sub body part cavity 121 and the second sub body part medial channel 123. According to an aspect, the first sub body part 101 includes an interior o-ring 109 positioned in an interior o-ring channel 108 extending around the first sub body part 101 at an axial position between the channel lip 115 and the sub body part first end 102, wherein the one o-ring 109 contacts and frictionally engages a surface of the second sub body part medial channel 123. The first sub body part 101 may also include a first sub body part rib 146 formed adjacent the locking screw channel 114, such that the first sub body part rib 146 abuts the second sub body part rib 147. The first sub body part rib 146 and second sub body part rib 147 together form a central alignment sub rib 145, and a placement tool hole 176 may be formed in each of the first sub body part rib 146 and the second sub body part rib 147 for positioning of the alignment sub 100 when coupled to adjacent wellbore tools as part of the wellbore tool string. According to an aspect, the placement tool holes 176 may be dimensioned and positioned on the first sub body part rib 146 and the second sub body part rib 147 as required by the particular application. The placement tool holes may be circular in shape, as shown in the embodiment of FIGS. 11-21. Alternatively, some or all of the placement tool holes 176 may be shaped in a horseshoe or arc-shaped configuration as shown in the embodiment of FIGS. 1-10.

In an exemplary embodiment, each of the first sub body part 101 and the second sub body part 118 include external threading for coupling to an adjacent wellbore tool to form a wellbore tool string. The first sub body part 101 includes a threaded exterior portion 116 that is dimensionally configured to couple to a first perforating gun housing of a first wellbore tool 201 (see FIG. 26). The second sub body part 118 includes a second sub body part threaded exterior portion 127 that is dimensionally configured to couple to a second perforating gun housing of a second wellbore tool 202.

In the exemplary embodiment, the first sub body part 101 includes a first sub body part external o-ring channel 117 having a first sub body part external o-ring 148 positioned therein, wherein the first sub body part external o-ring channel 117 is formed between the first sub body part rib 146 and the first sub body part threaded exterior portion 116. The second sub body part 118 may include a second sub body part external o-ring channel 126 having a second sub body part external o-ring 149 positioned therein, wherein the second sub body part external o-ring channel 126 is formed between the second sub body part rib 147 and the second sub body part threaded exterior portion 127.

Figure 22:
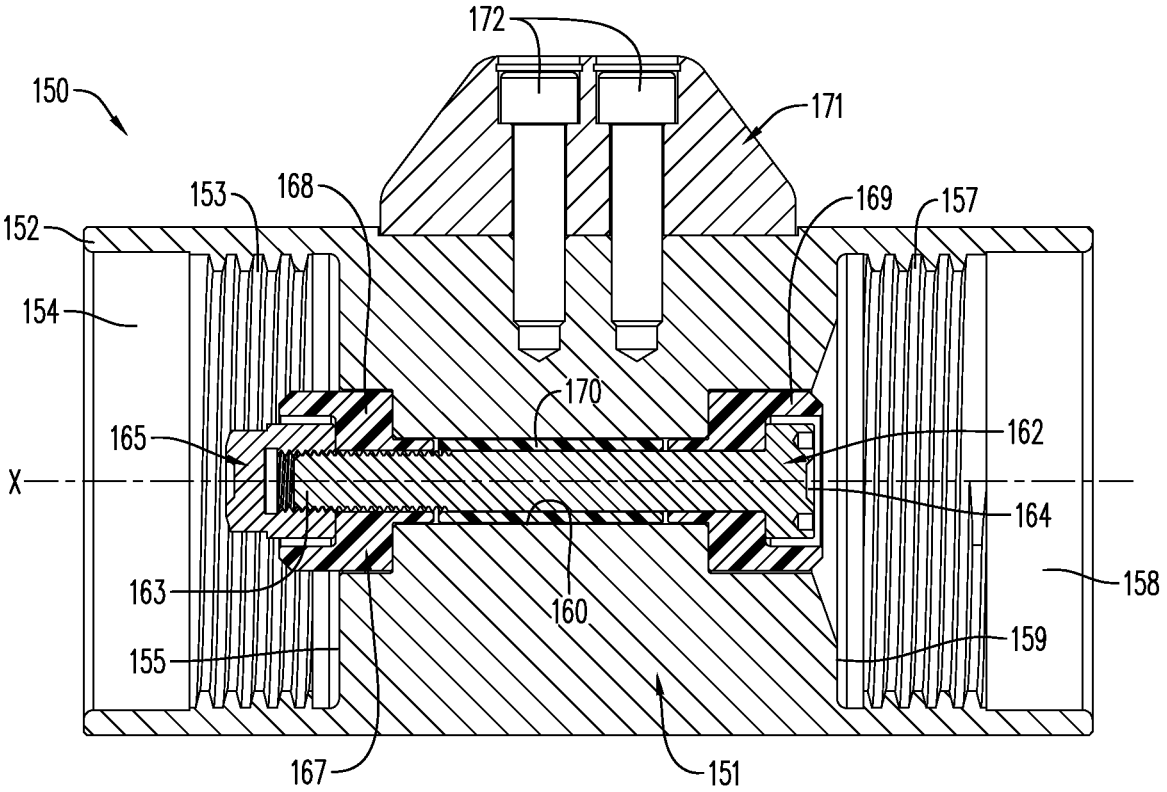
FIG. 22 is a cross-sectional side view of an orienting tandem seal adapter according to an embodiment.
Figure 23:
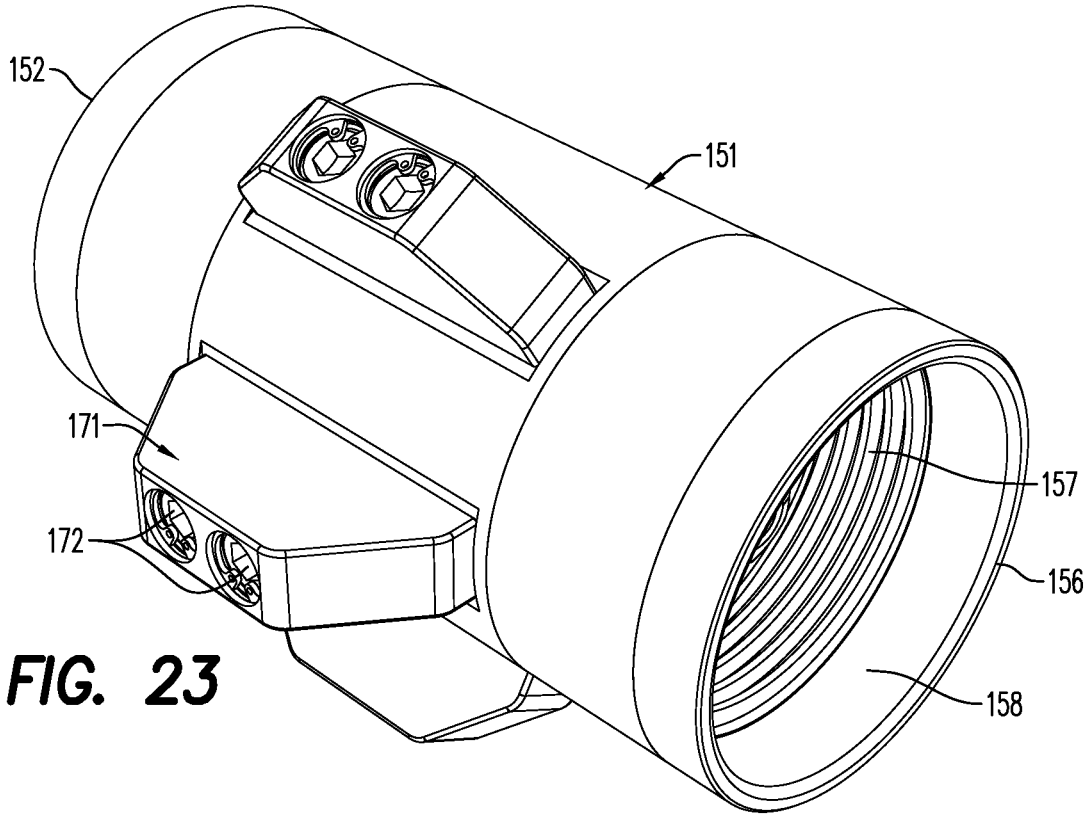
FIG. 23 is a perspective view of an orienting tandem seal adapter according to the embodiment shown in FIG. 22.
Figure 24:
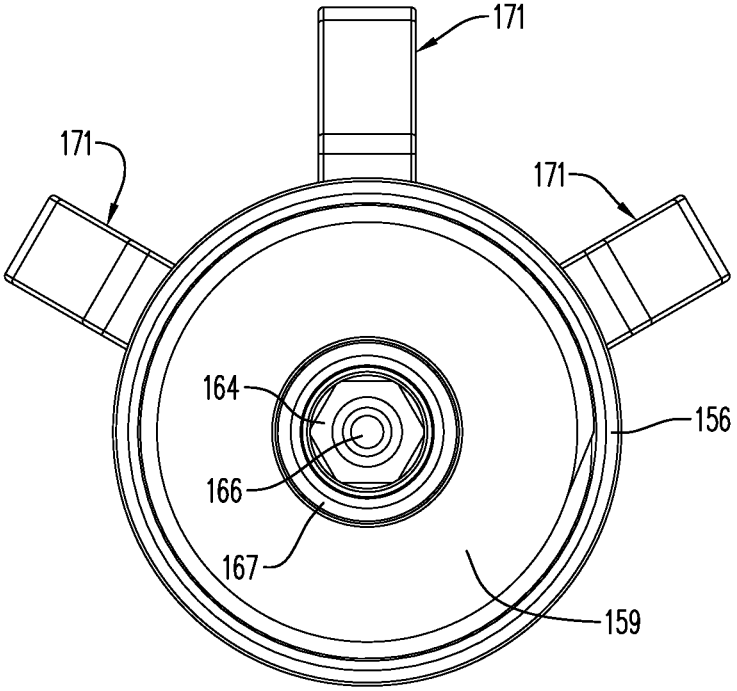
FIG. 24 is a front elevated view of an orienting tandem seal adapter according to the embodiment shown in FIG. 22.

With reference to FIGS. 22-26, a tandem seal adapter (TSA) 150 may be used in conjunction with one or more alignment subs 100, 100' in a wellbore tool string 200 to align adjacent wellbore tools 201, 202 and to provide orientation of the wellbore tool string 200 while in a wellbore. In an exemplary embodiment and as shown in FIG. 22, the TSA 150 includes an adapter body 151. The adapter body 151 may be a solid cylindrical body including a first end 152, a second end 156 spaced apart from the first end 152, and an adapter bore 160 extending axially through the adapter body 151. A first adapter body recess 154 defined by a first adapter body recess wall 155 extends inwardly from the first end 152, and a second adapter body recess 158 defined by a second adapter body recess wall 159 extends inwardly from the second end 156. The first adapter body recess 154 may have an inner threaded surface 153 for threaded engagement with an adjacent wellbore tool or sub, and the second adapter body recess 158 may have an inner threaded surface 157 for threaded engagement with an adjacent wellbore tool or sub. The adapter bore 160 extends from the first adapter body recess wall 155 to the second adapter body recess wall 159.

A feedthrough rod/contact rod 162 is positioned in the axial bore 160 of the adapter body 151. When the contact rod 162 is positioned in the bore 160, it is held in position by a retainer 165. Each of the contact rod 162 and the retainer 165 is formed from an electrically conductive material. With continued reference to FIG. 22, a contact rod first end 163 is positioned adjacent the first adapter body recess 154, and a contact rod second end 164 is positioned adjacent the second adapter body recess 158. In the exemplary embodiment shown in FIG. 24, the retainer 165 includes a retainer recess dimensionally configured to receive a bulkhead pin (e.g., a first end bulkhead pin 139 or a second end bulkhead pin 141 of the alignment sub 100) from an adjacent wellbore tool or an adjacent alignment sub 100. The contact rod second end 164 may include a contact rod recession 166 dimensionally configured to receive a bulkhead pin from an adjacent wellbore tool.

The contact rod 162 is electrically isolated from electrical contact with the adapter body 151 by a non-conductive 3-piece insulator 167 that extends around the contact rod between the contact rod first end 163 and the contact rod second end 164. The insulator/insulating jacket 167 in the exemplary embodiment includes a first end piece 168 positioned around the contact rod first end 163, a second end piece 169 positioned around the contact rod second end 164, and a medial piece 170 extending between the contact rod first end 163 and the contact rod second end 164.

Figure 27A:
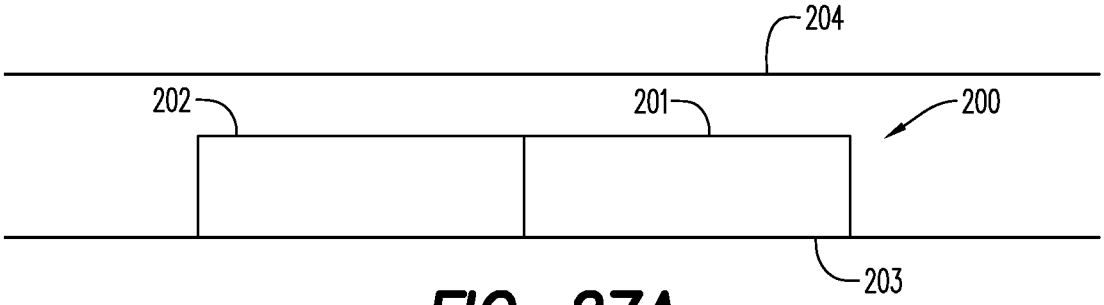
FIG. 27A shows a wellbore tool string positioned inside a wellbore casing according to an embodiment.
Figure 27B:
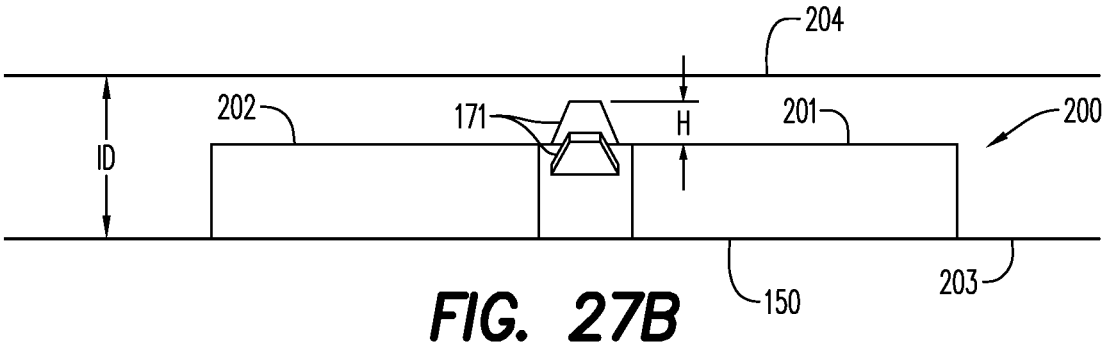
FIG. 27B shows a wellbore tool string positioned inside a wellbore casing according to an embodiment.

In an embodiment and with reference to FIGS. 27A and 27B, two or more fins 171 are secured to an outer surface of the adapter body 151 to space the wellbore tool string 200 apart from a surface of a wellbore casing and to assist in orienting the tool-string and thereby the direction of the perforations in a specific desired direction. The fins 171 orient the wellbore tool string 200 in the wellbore so that when the wellbore tool string 200 is laying horizontally in a wellbore casing 203, the wellbore tool string 200 is spaced apart from a horizontal surface 204 of the wellbore casing 203 by the fins 171 so that the tool string 200 and the shaped charges housed in the tool string 200 are oriented in a desired direction. The fins 171 adjust the axial positioning of the wellbore tool string 200 in the wellbore by moving the wellbore tool string 200 away from the horizontal surface 204 of the wellbore casing 203. According to an aspect, the fins 171 space apart the wellbore tool string 200 from the wellbore casing 203 such that an unwanted or unintentional rotation or rolling of the tool-string 200 downhole is prevented so that the perforations are always oriented or aligned in a desired specific direction within certain degrees of accuracy. The accuracy or degree of limitation which the fins can hold the tool string 200 in the desired location depends on the overall tool string 200 design, as well as the height H of the fins 171 compared to the inner-diameter ID of the wellbore casing 203.

In the exemplary embodiment, the two or more fins 171 are positioned on the outer surface of the TSA 150 on a top side of the TSA 150. The two or more fins 171 may be positioned generally in alignment with the firing path of the shaped charges housed in the housings 201, 202 of the wellbore tool string 200. In an embodiment, the firing path of the shaped charges may be aligned with a top side of the perforating gun housing and the TSA, such that the pitch of the firing path is 0 degrees. Alternatively, the firing path of the shaped charges may be aligned with a bottom side of the perforating gun housing, such that the pitch of the firing path is 180 degrees. In such an embodiment, the two or more fins 171 are positioned generally about 180 degrees from the firing path of the shaped charges, such that the two or more fins 171 maintain an orientation of the wellbore tool string 200 for firing the shaped charges in a downward direction. According to an aspect, fin screw holes 173 may be formed in the adapter body 151 extending from the outer surface of the adapter body 151 toward the center of the adapter body 151 for receiving a screw 172 that passes through the fin 171 for attachment of the fin 171 to the adapter body 151. In the exemplary embodiment, three fins are included in the TSA 150. However, any number of fins 171 in accordance with this disclosure may be used to provide the desired axial positioning of the wellbore tool string in the wellbore casing. In an embodiment, the fins 171 may be spaced apart from one another about the adapter body 151. For example, the fins 171 may be mounted at a distance of about 30 degrees to about 60 degrees from one another. In an embodiment, the TSA 150 may include a circumferential recess 174 formed around the exterior surface of the adapter body 151. According to an aspect, the circumferential recess 174 may receive a support structure, for example a lifting plate, make-up plate, or rig-up plate, for use in lifting up the tool string 200 for vertical assembly of the tool string components (e.g., gun housing 201, gun housing 202, TSA 150, and/or alignment sub 100).

The wellbore tool string 200, such as a perforating gun string, may include an orienting alignment sub assembly, which includes each of the alignment sub 100 and the TSA 150 as described above and shown in FIGS. 25-26. The first perforating gun housing 201 houses a shaped charge holder with an electrically contactable component, and includes a threaded end. The first sub body part 101 of the alignment sub 100 includes a first sub body part first end, a first sub body part insertable portion 104 axially adjacent to the first sub body part first end, and a first sub body part bore 105 extending from the first sub body part first end 102 in a x-direction through the first sub body part insertable portion 104. An electrical component 136 (e.g., an electrically contactable bulkhead assembly 137) is positioned in the first sub body part bore 105.

A second sub body part 118 is positioned around and rotatably engaged with the first sub body part insertable portion 104. The second sub body part 118 includes a second sub body part recess 124 extending in a x-direction from a second sub body part first end 119 toward a second sub body part second end 120, a second sub body part cavity 121 extending in a x-direction from the second sub body part second end 120 toward the second sub body part first end 119, and a second sub body part medial channel 123 extending from the second sub body part recess 124 to the second sub body part cavity 121, wherein the first sub body part insertable portion 104 is positioned in the second sub body part cavity 121 and the second sub body part medial channel 123.

A tandem sub assembly 150 is connected to the second sub body part 118, and includes an adapter body 151 having a first adapter body recess 154 extending in a x-direction from a first adapter body end 152, wherein the first adapter body recess 154 is defined by a first adapter body recess wall 155, a second adapter body recess 158 extending in a x-direction from a second adapter body end 156, wherein the second adapter body recess 158 is defined by a second adapter body recess wall 159, and an adapter bore 160 extending in a x-direction from the first adapter body recess wall 155 to the second adapter body recess wall 159. A contact rod 162 is positioned in the adapter bore 160 and is electrically connected to the electrical assembly 136. The tandem sub assembly 150 includes a plurality of fins 171 positioned externally on the adapter body 151.

A second alignment sub 100' as described above is coupled to the tandem sub assembly 150, and includes a second electrical assembly 136 that is electrically connected to the contact rod 162. A second perforating gun housing 202 housing a shaped charge holder with an electrically contactable component that is electrically connected to the second electrical assembly 136' has a threaded end that is coupled to the second alignment sub 100'.

According to an aspect, the first gun housing 201 includes surface scallops 203, and the second gun housing 202 includes surface scallops 204, wherein the first gun housing surface scallops 203 and the second gun housing surface scallops 204 align with a firing path of an internal shaped charge. Rotation of the first sub body part 101 in the second sub body part 118 aligns the first gun housing surface scallops 203 with the second gun housing surface scallops 204. When the first gun housing surface scallops 203 are aligned with the second gun housing surface scallops 204, the alignment sub 100 may be locked as described above with a lock screw to fix the rotational position of the first gun housing 201 relative to the second gun housing 202 or the angular position of a shaped charge in the first gun housing 201 relative to the second gun housing 202.

The two or more fins 171 orient the rotational position of the perforating gun string 200 in a wellbore (FIGS. 22-25). According to an aspect, the two or more fins 171 are positioned on the adapter body 151 in a spaced apart configuration. In the exemplary embodiment, each of the two or more fins 171 are radially offset from the surface scallops 203, 204 when the gun housing 201, 202 are aligned, such that the fins 171 are offset from the shaped charge firing path by about 30 degrees.

Embodiments of the disclosure are further associated with a method of aligning a pitch of shaped charges in a wellbore tool string. A first wellbore tool 201 is coupled to a first end 119 of an alignment sub 100 comprising a first sub body part 101 rotatably coupled to a second sub body part 118. According to an aspect, the first sub body part 101 is rotatably coupled to the second sub body part 118 by inserting an insertable portion 104 of the first sub body part 101 into a cavity 121 of the second sub body part 118. A second wellbore tool 202 is coupled to a second end 102 of the alignment sub 100. According to an aspect, the first wellbore tool 201 is coupled to the alignment sub first end 119 by threadedly coupling, and the second wellbore tool 202 is coupled to the alignment sub second end 102 by threadedly coupling.

The first wellbore tool 201 is rotated relative to the second wellbore tool 202 to align a wellbore housing scallop 203 on the first wellbore tool 201 with a wellbore housing scallop 204 on the second wellbore tool 202. The alignment sub 100 is locked to retain the alignment of the first wellbore housing scallop 203 relative to the second wellbore housing scallop 204. According to an aspect, locking the alignment sub 100 may include at least one of inserting a sub locking screw 129 through the second sub body part 118 into the second sub body part cavity 121 to contact the first sub body part insertable portion 104, and inserting a second sub body part retainer ring 130 into the recess 124 of the second sub body part to secure the first sub body part insertable portion 104 to the second sub body part recess 124 and to retain the first sub body part first end 102 within the second sub body part recess 124.

FIGS. 28A-35 show an exemplary embodiment of an alignable perforating gun assembly 300. According to an aspect, the alignable perforating gun assembly 300 may be alignable without the use of a separate sub structure. The alignable perforating gun assembly 300 includes a perforating gun housing/module 310. The perforating gun housing 310 may be formed from a singular and monolithic piece of metal material, for example, a preforged metal blank. The perforating gun housing 310 may be dimensioned to that it has a reduced length of less than about 12 inches, alternatively less than about 9 inches, alternatively less than about 8 inches. The dimensions of the perforating gun housing 310 may be selected, at least in part, based on the components to be arranged in a chamber 314 of the perforating gun housing 310.

FIGS. 36-44 illustrate additional views of the perforating gun housing 310. The perforating gun housing 310 includes a first housing end portion 311 and a second housing end portion 312 spaced apart from the first housing end portion 311. The chamber 314 extends between the first and second housing end portions 311, 312. As noted hereinabove, the chamber 314 may be configured to house perforating gun components, such as shaped charge positioning devices, shaped charge holders, shaped charges, a detonator, detonating cord, a bulkhead assembly, and the like. A plurality of sealing mechanisms 316, such as o-rings, may be used to seal the perforating gun housing 310 from the contents of the perforating gun housings of an adjacent alignable perforating gun housing assembly, as well as from the outside environment (fluid in the wellbore) from entering the chamber. According to an aspect, the second housing end portion 312 is configured to be secured within a chamber of an adjacent alignable perforating gun assembly, and the first housing end portion 312 is configured to secure a second housing end portion of another adjacent perforating gun housing.

Figure 28A:
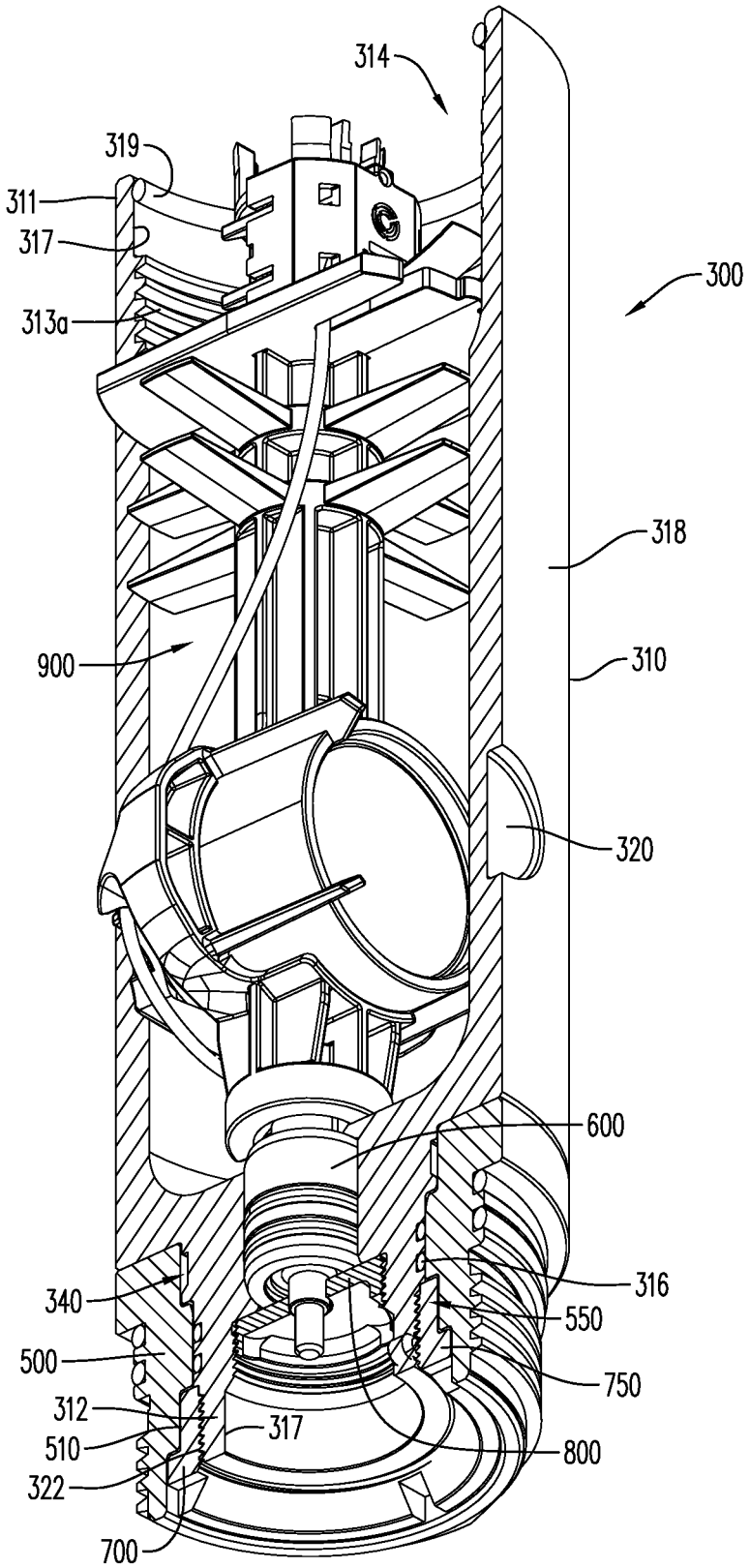
FIG. 28A is a front, top perspective view of a perforating gun and alignment assembly, including a shaped charge positioning device, according to an embodiment.
Figure 28B:
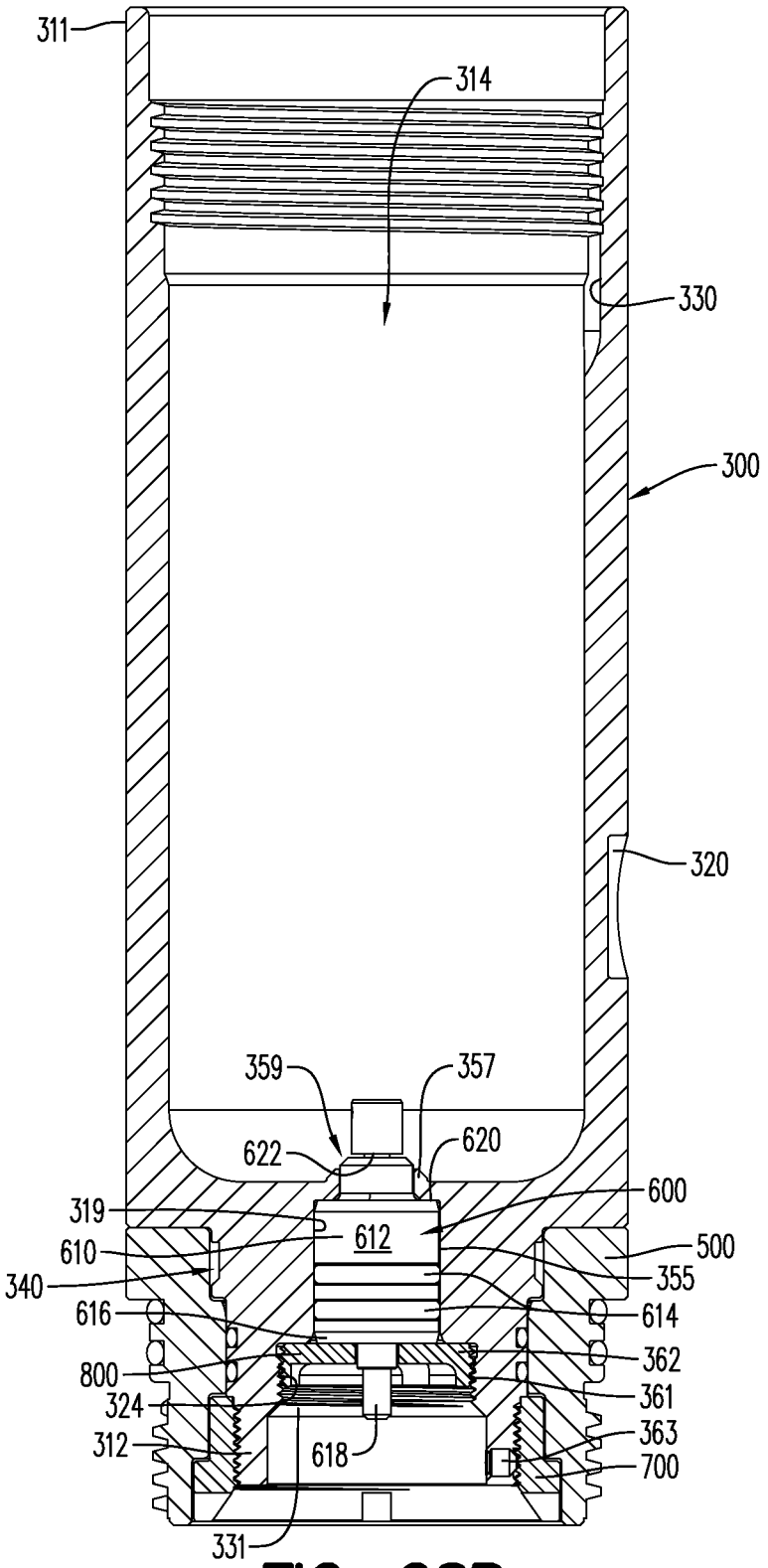
FIG. 28B is a cross-section of a perforating gun and alignment assembly, including a bulkhead assembly, according to an embodiment.

According to an aspect and with reference to FIG. 28B, the first housing end portion 311 may have an outer diameter OD1 that is larger than an outer diameter OD2 of the second housing end portion 312. The second housing end portion 312 may further include a threaded end portion 315 that has an outer diameter OD3 that is less than the outer diameters OD1, OD2 of each of the first housing end portion 311 and the second housing end portion 312.

According to an aspect and with reference to FIG. 28A, an inner surface 317 of the perforating gun housing 310, at the first housing end portion 311, includes a thread 313*a*. The thread 313*a* may facilitate the connection of a string of alignable perforating gun assemblies 300 together. The thread 313*a* may be an internal thread that is configured as a continuous thread or a plurality of threads. According to an aspect, the plurality of threads may be segmented threads or discontinuous threads. The second housing end portion 312 may include an outer surface 322 with a threaded portion 313*b* corresponding to the threaded portion 313*a* for the connection of a string of alignable perforating gun assemblies 300.

A scallop 320 may be formed into an outer surface 318 of the perforating gun housing 310. The scallop 320 may be machined into the outer surface 318 of a portion of the perforating gun housing 310. The scallop 320 may axially overlap with a shaped charge receptacle formed in the shaped charge holder positioned in the chamber 314 of perforating gun housing 310. When the shaped charge holder is positioned in the chamber 314 of the perforating gun housing 310, an open front portion of the shaped charge secured therein may be directed in any angle along the radial Y-planar firing path as defined by the scallop 320.

Figure 28C:
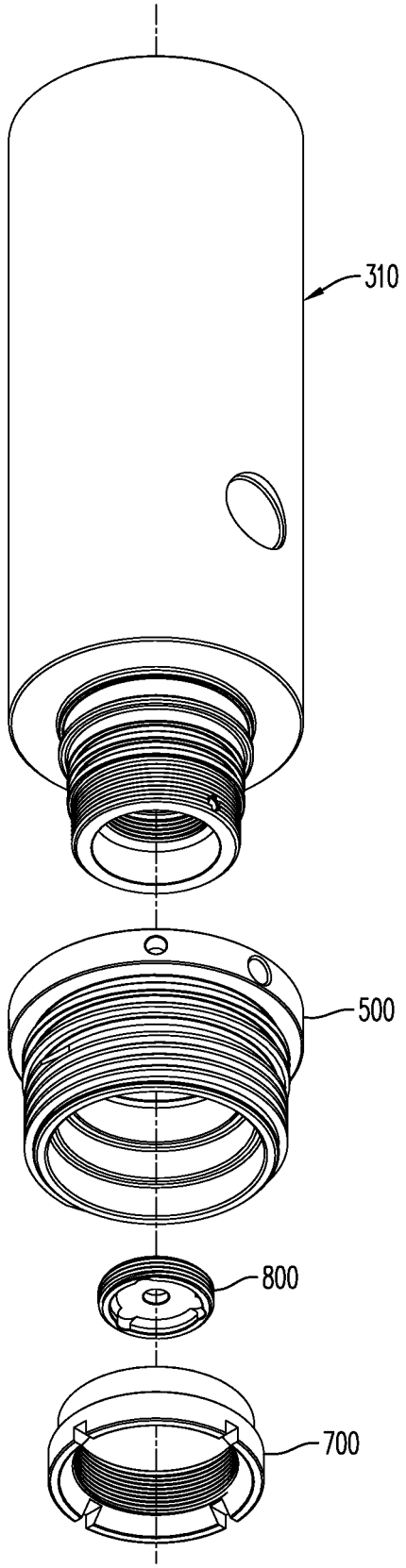
FIG. 28C is an exploded view of a perforating gun and alignment assembly, according to an embodiment.
Figure 31:
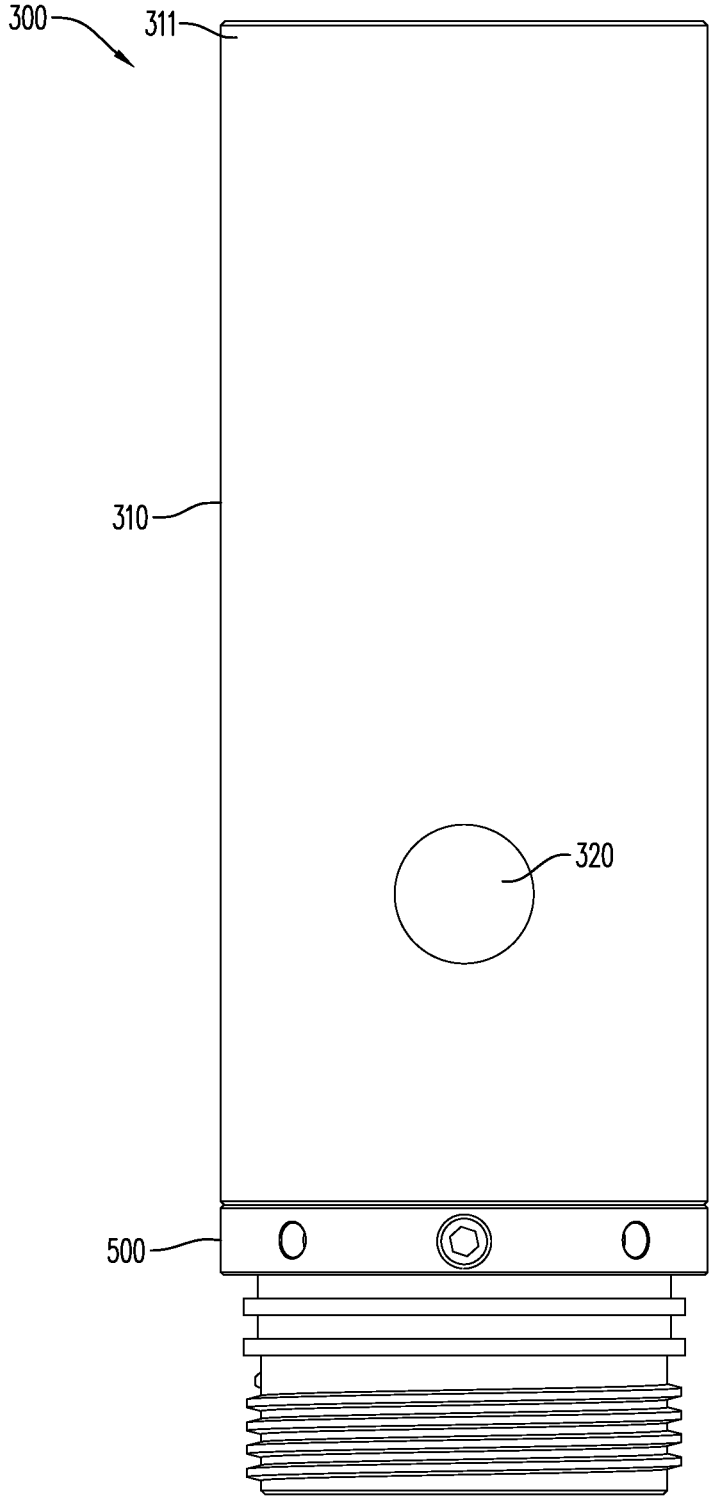
FIG. 31 is a right-side elevated view of the perforating gun and alignment assembly of FIG. 2A.
Figure 32:
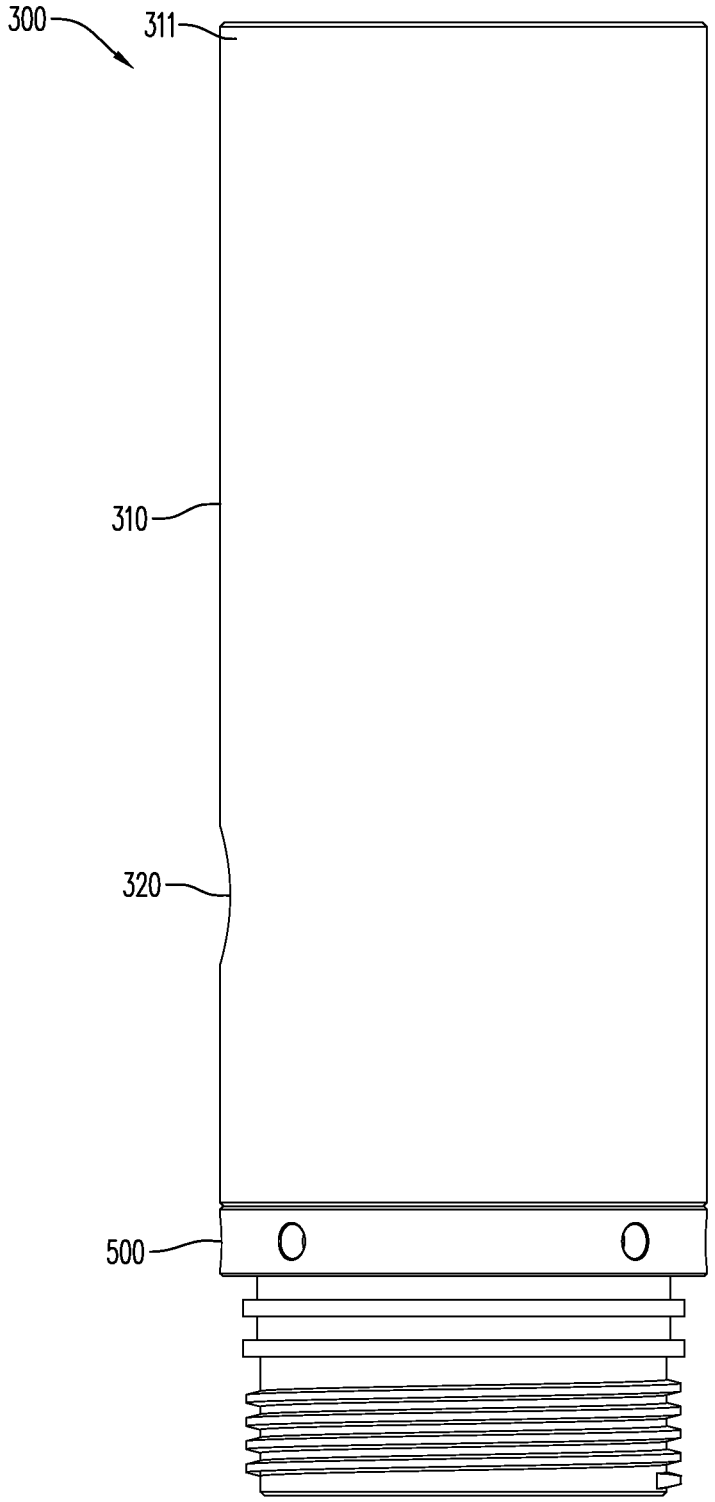
FIG. 32 is a front elevated view of the perforating gun and alignment assembly of FIG. 2A.
Figure 33:
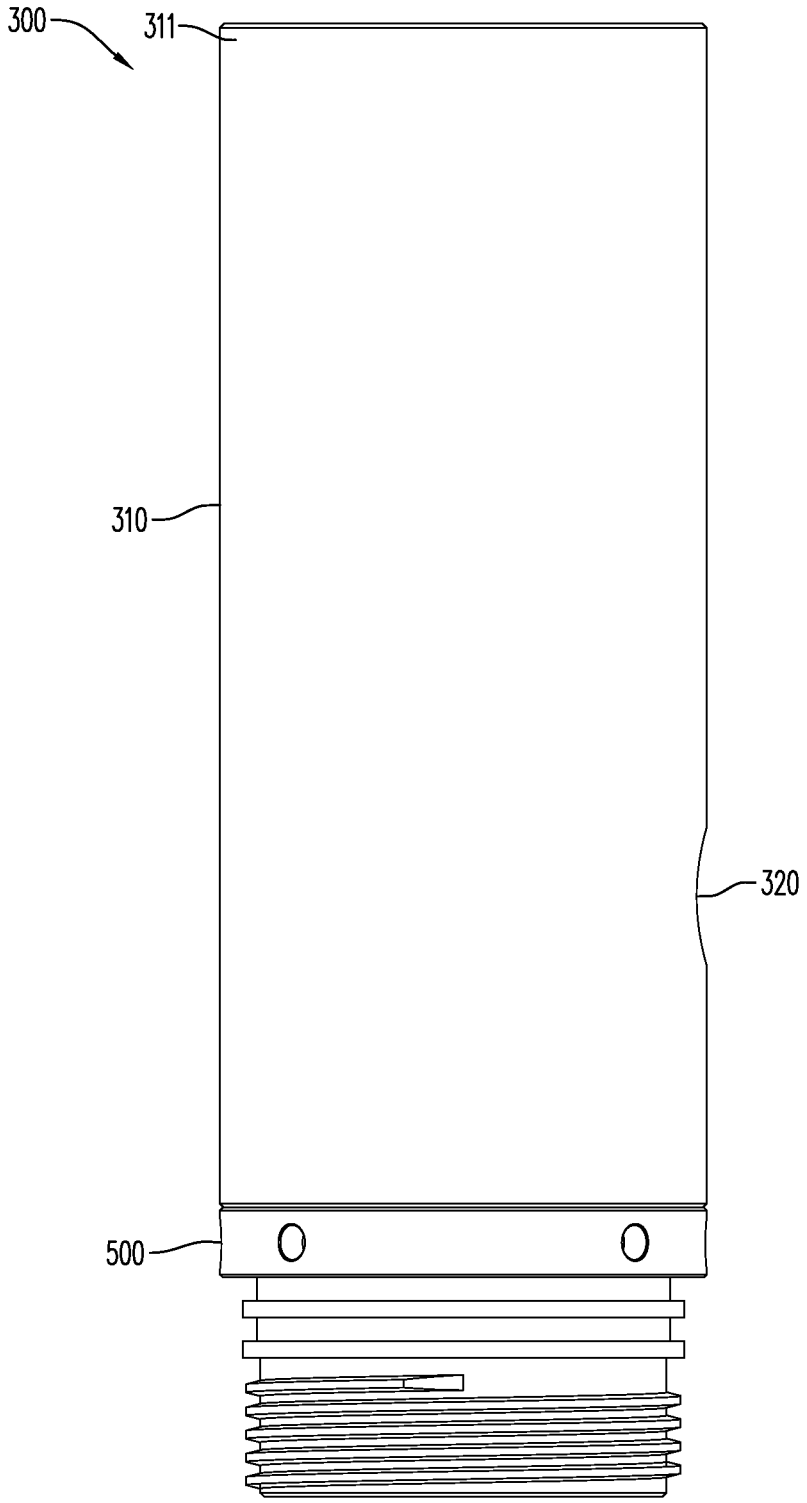
FIG. 33 is a rear elevated view of the perforating gun and alignment assembly of FIG. 2A.
Figure 34:
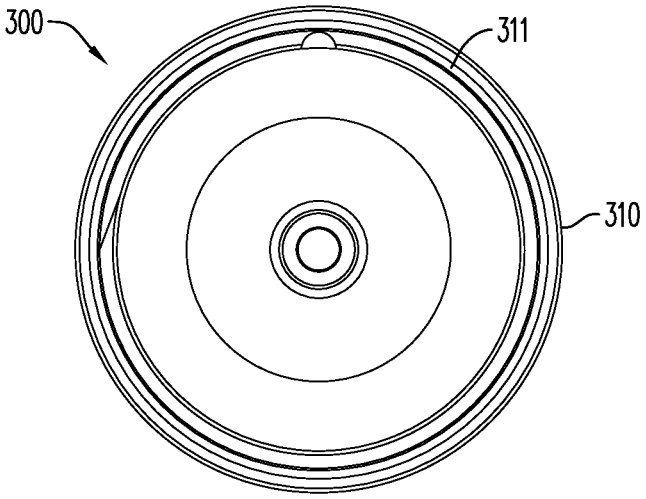
FIG. 34 is a top plan view of the perforating gun and alignment assembly of FIG. 2A.
Figure 35:
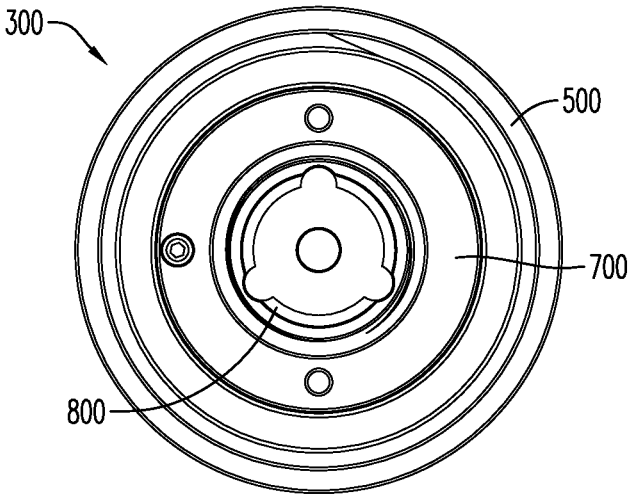
FIG. 35 is a bottom plan view of the perforating gun and alignment assembly of FIG. 2A.
Figure 36:
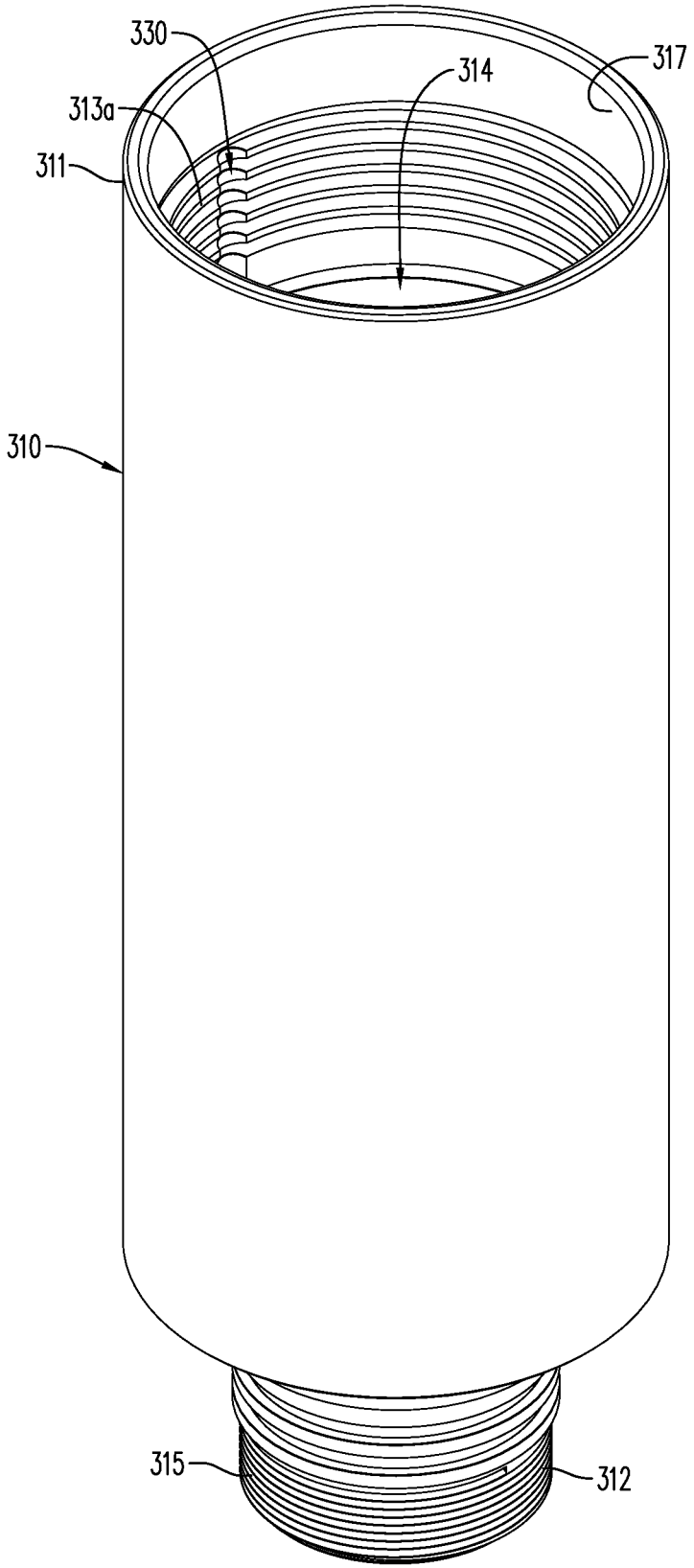
FIG. 36 is a front, top perspective view of a perforating gun module of a perforating gun and alignment assembly, according to an embodiment.
Figure 39:
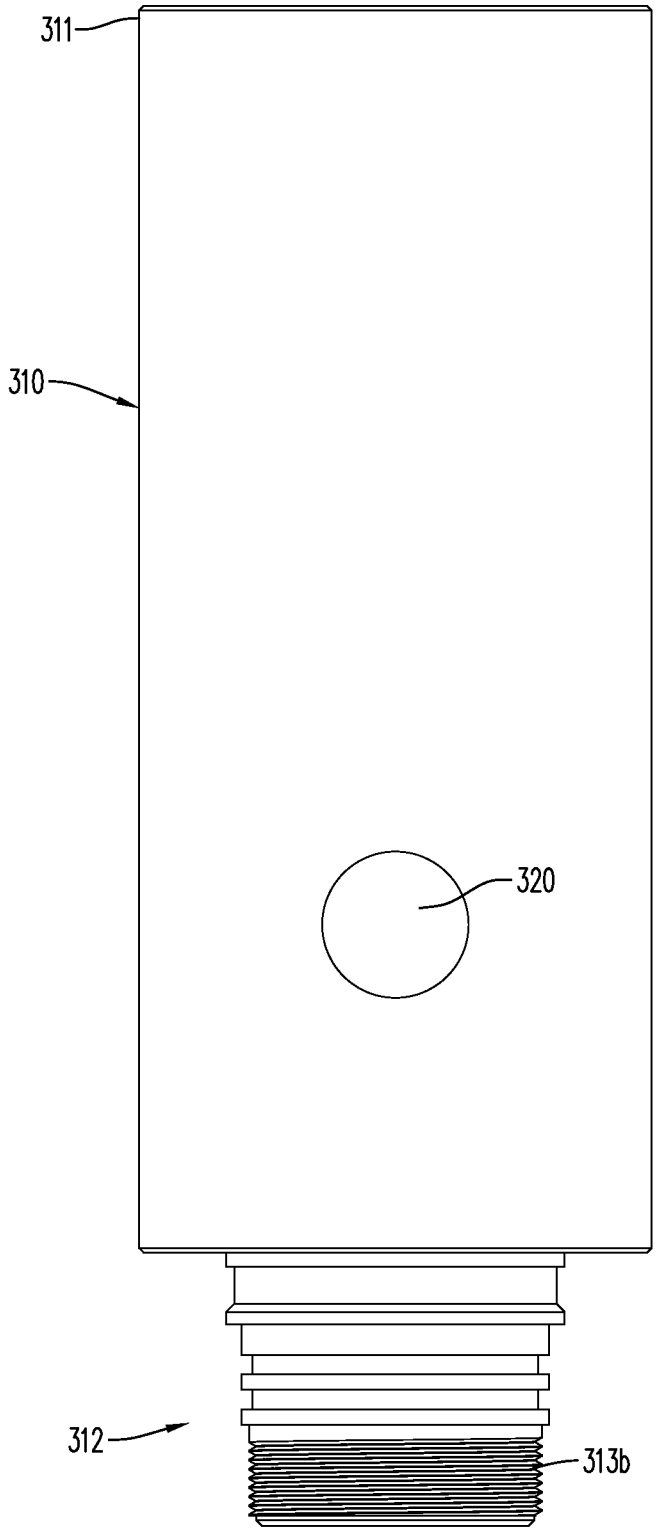
FIG. 39 is a right-side elevated view of the perforating gun module of FIG. 9.
Figure 40:
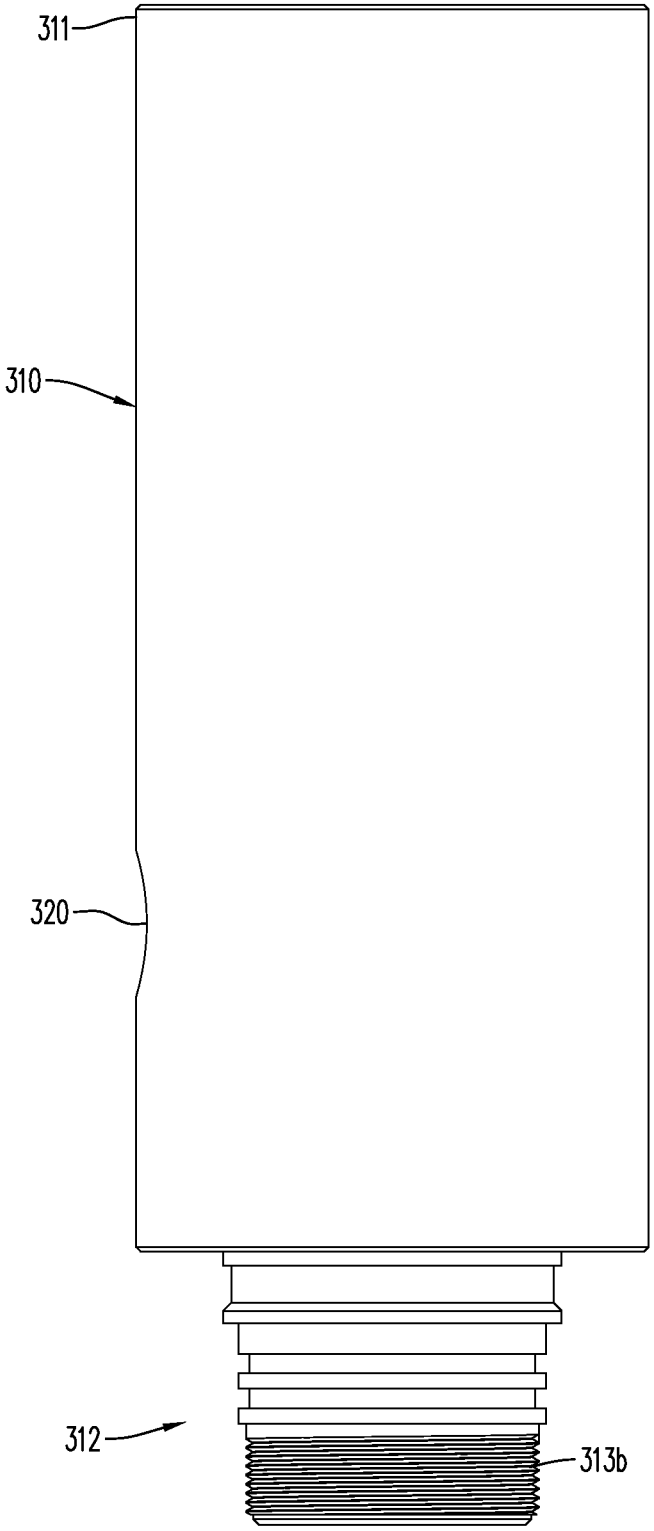
FIG. 40 is a front elevated view of the perforating gun module of FIG. 9.
Figure 41:
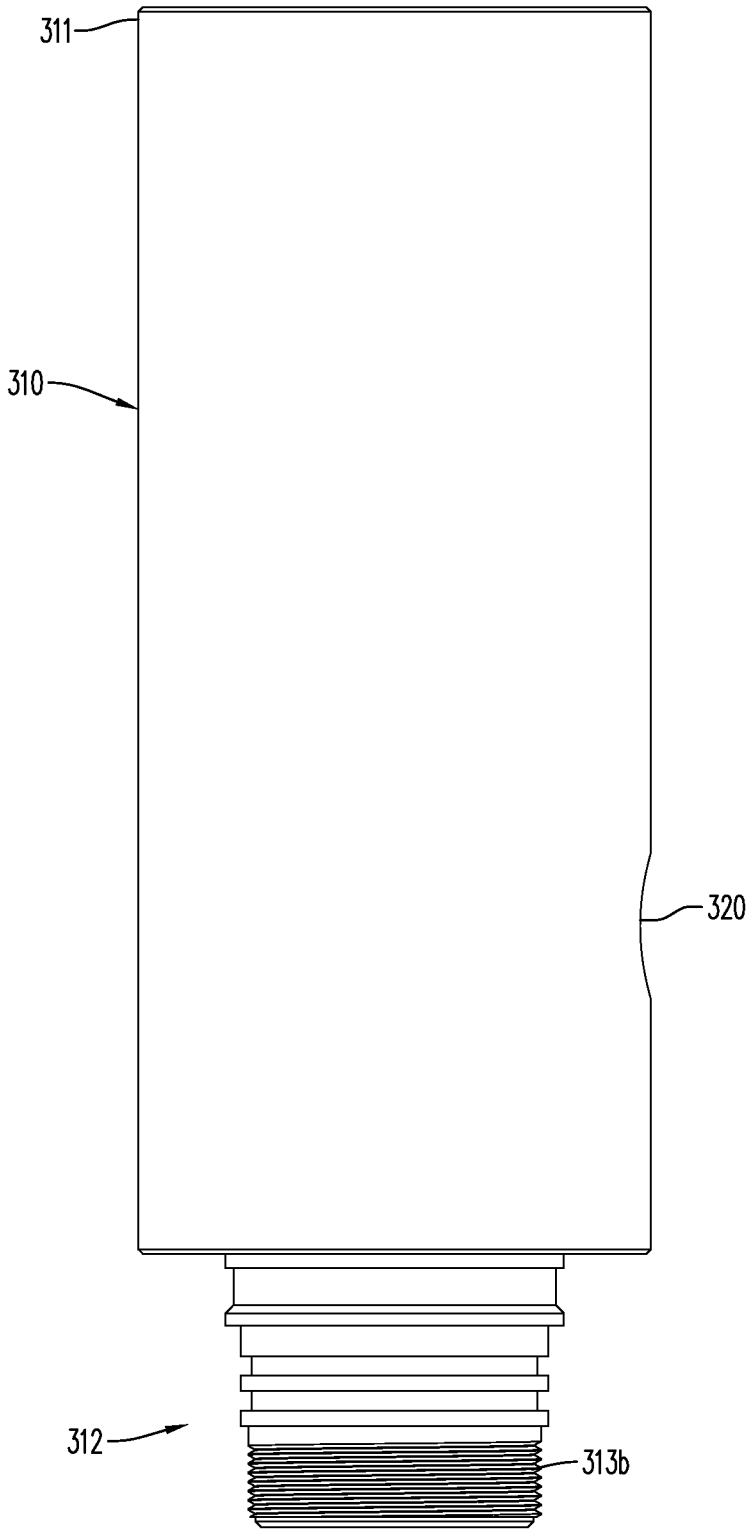
FIG. 41 is a rear elevated view of the perforating gun module of FIG. 9.
Figure 42:
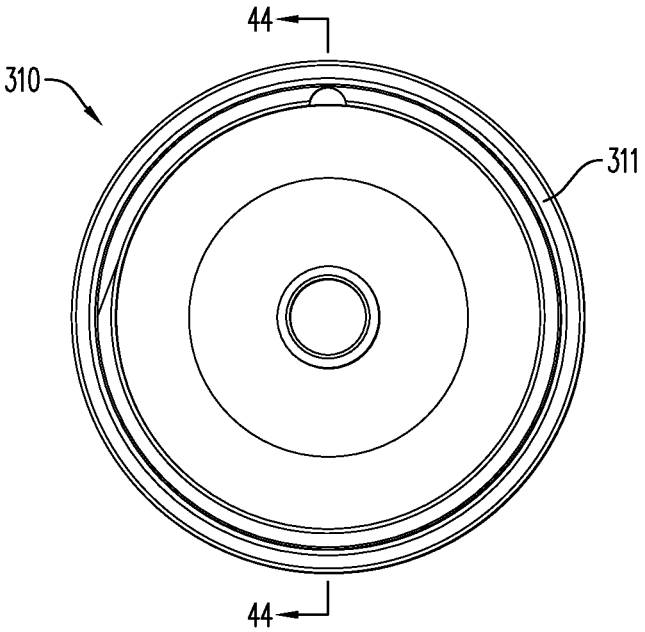
FIG. 42 is a top plan view of the perforating gun module of FIG. 9.
Figure 43:
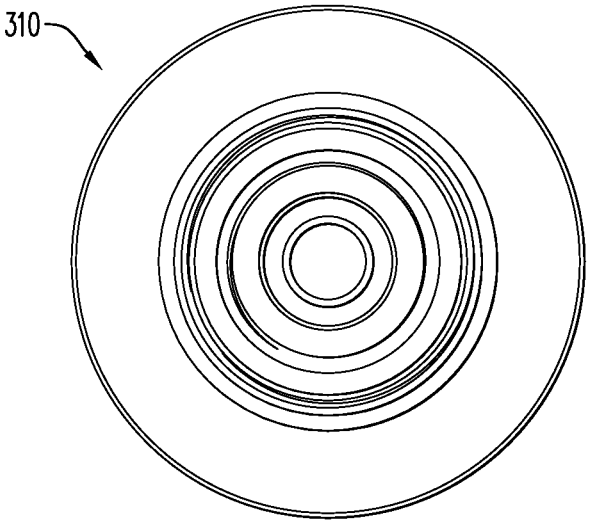
FIG. 43 is a bottom plan view of the perforating gun module of FIG. 9.

The scallop 320 may help to reduce the potential burrs that are created in the outer surface 318 of the perforating gun module 310 once a shaped charge has been detonated and a perforation hole is formed through the scallop 320. While a single circular scallop is illustrated in FIG. 28C, FIG. 31, and FIG. 39, it is contemplated that the scallop 320 may be a banded scallop, i.e., a scallop that extends around the circumference of the perforating gun housing 310.

In the exemplary embodiment illustrated in FIG. 28B, a cross section of the scallop 320 illustrates that the scallop 320 may be a recess having a rectangular profile. According to an aspect (not shown), the scallop may be defined by an arc-shaped recess formed on the external surface of the housing wall, such that the firing path of the shaped charge corresponds to a portion of the housing wall that has a reduced thickness area extending around the circumference of the wall. The reduced thickness area of the scallop reduces the force needed for the shaped charge to fire through the housing wall. According to an aspect, the scallop may be formed or created through the use of a tooling machine. The same tooling machine may be used to form the threads of the housing.

A slot 330 (FIG. 44) may also be formed in the internal surface of the perforating gun housing 310 and may extend along the internal surface of the perforating gun housing 310 in a longitudinal direction. The slot 330 may be configured to receive an anti-rotation key of a shaped charge positioning device or a shaped charge holder/positioning device to help prevent rotation of the positioning device or shaped charge holder within the perforating gun module 310. This may help to ensure, for example, that a shaped charge positioned in the shaped charge holder is properly aligned with the scallop 320 formed in the perforating gun housing 310.

Figure 37:
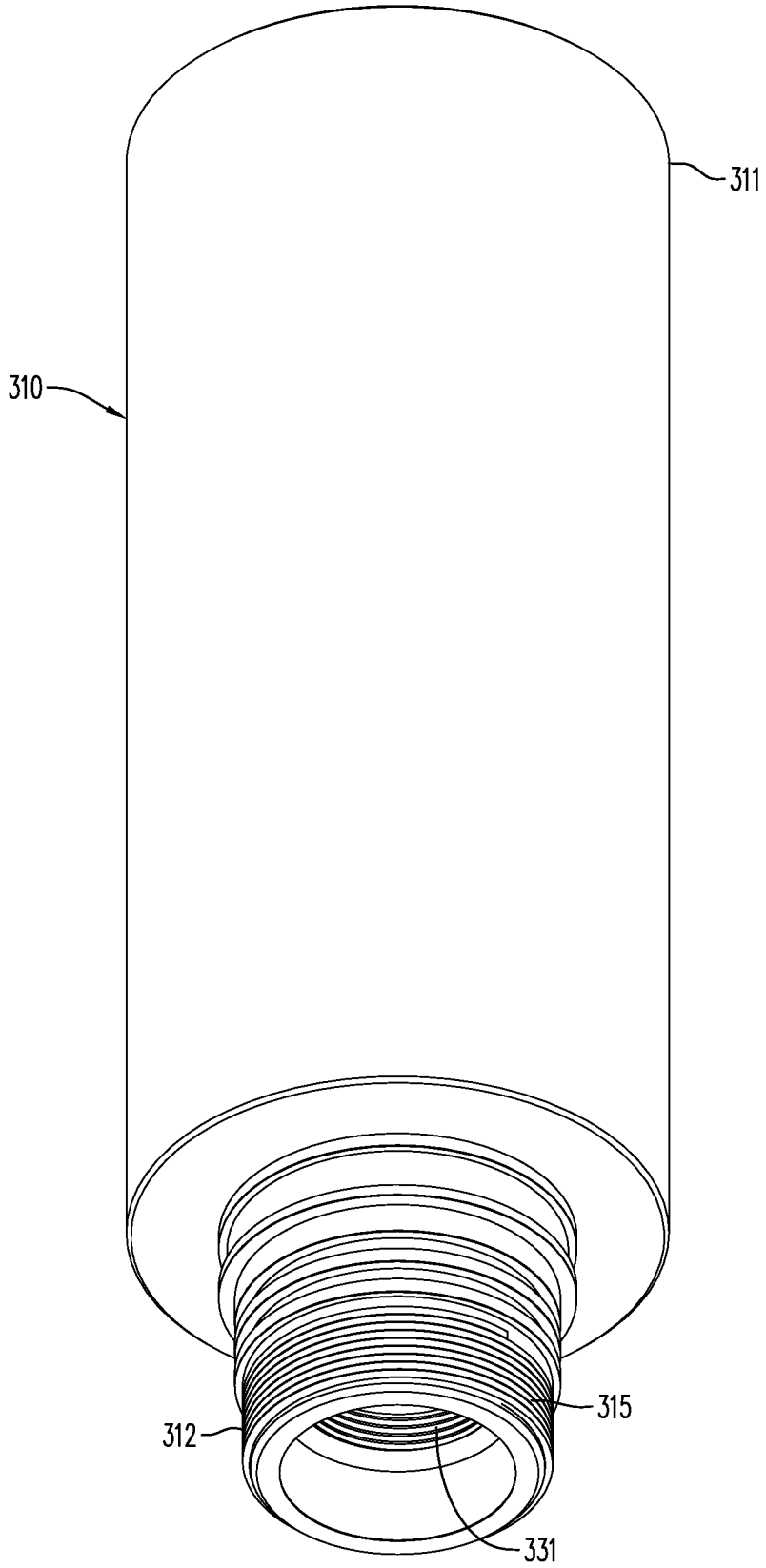
FIG. 37 is a front, bottom perspective view of the perforating gun module of FIG. 9.
Figure 38:
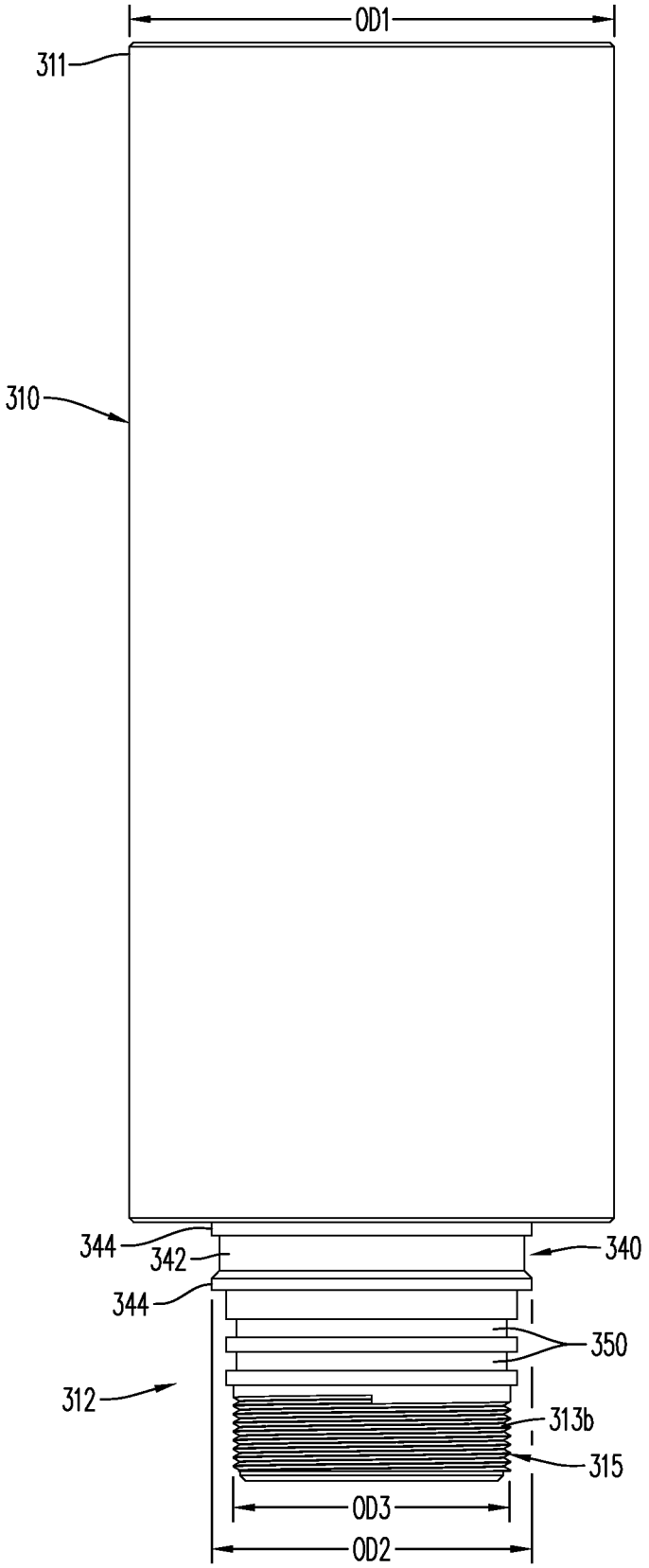
FIG. 38 is a left-side elevated view of the perforating gun module of FIG. 9.
Figure 44:
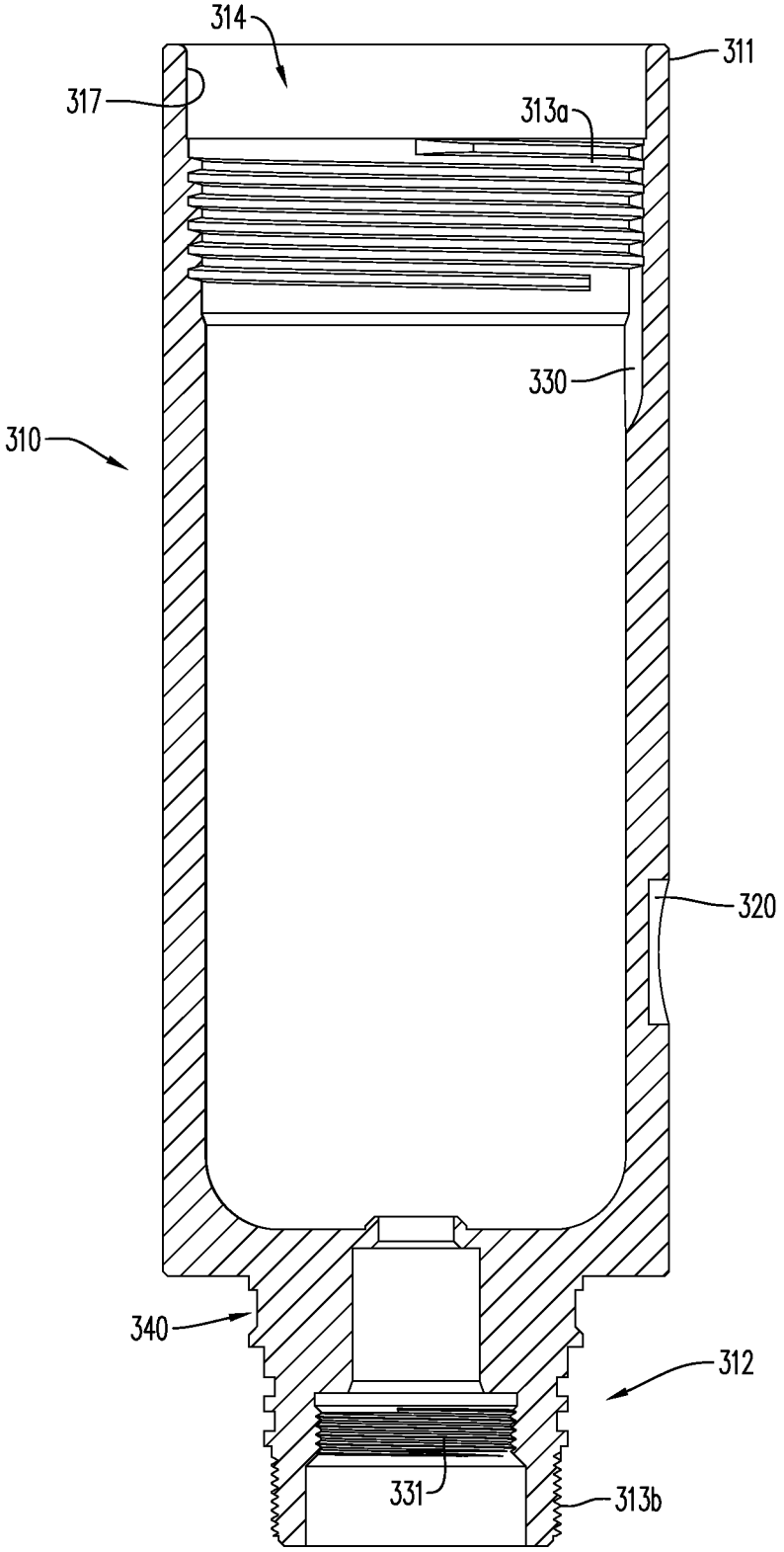
FIG. 44 is a cross-section view of the perforating gun module of FIG. 9 taken along line 17-17 of FIG. 15.
Figure 45:
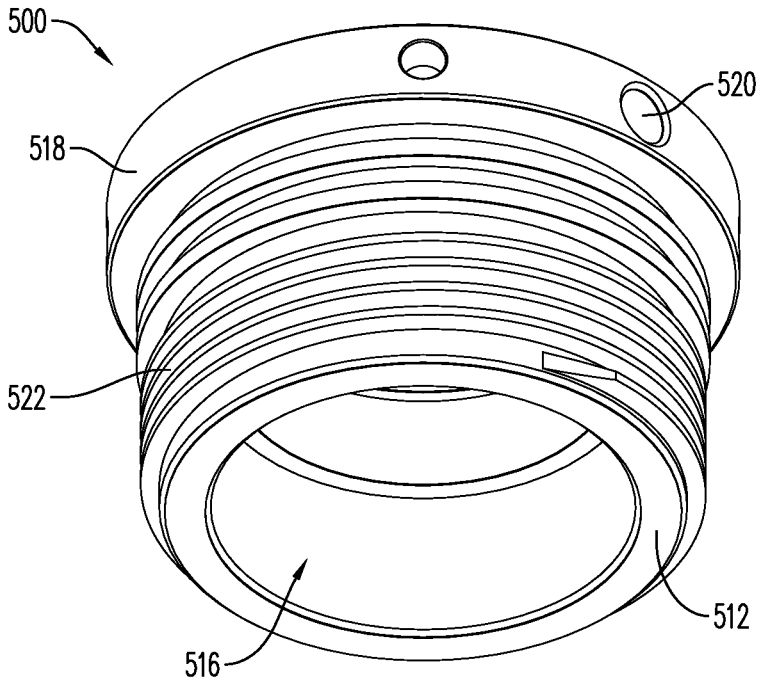
FIG. 45 is a front, top perspective view of an alignment ring of a perforating gun and alignment assembly, according to an embodiment.
Figure 46:
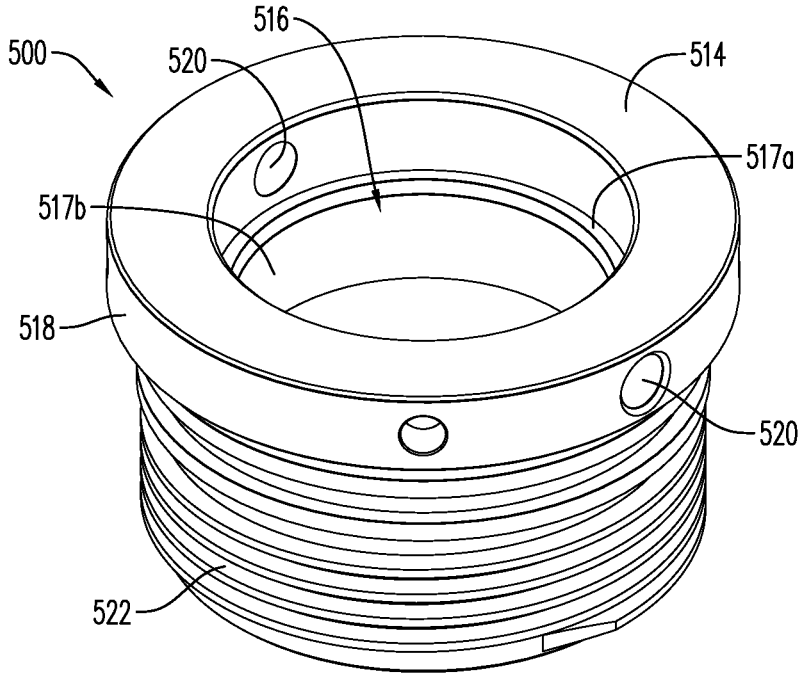
FIG. 46 is a front, bottom perspective view of the alignment ring of FIG. 18.
Figure 47:
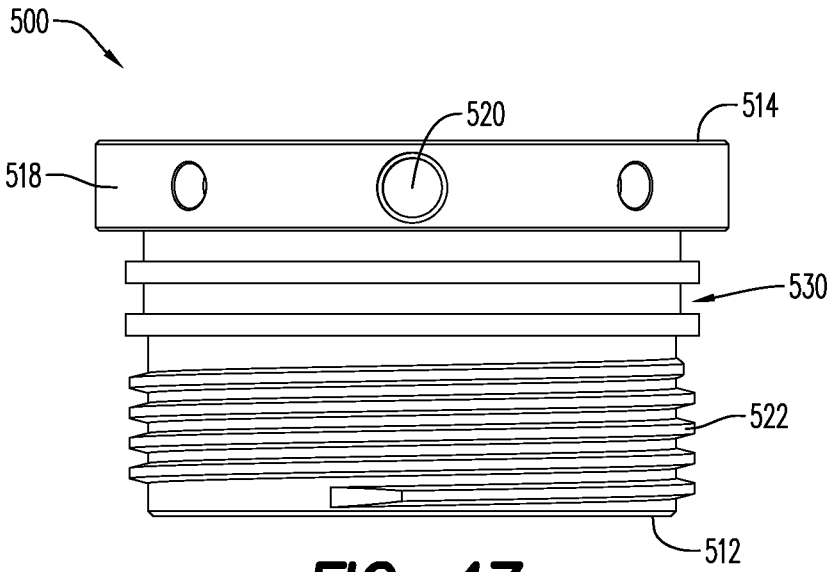
FIG. 47 is a left-side elevated view of the alignment ring of FIG. 18.
Figure 48:
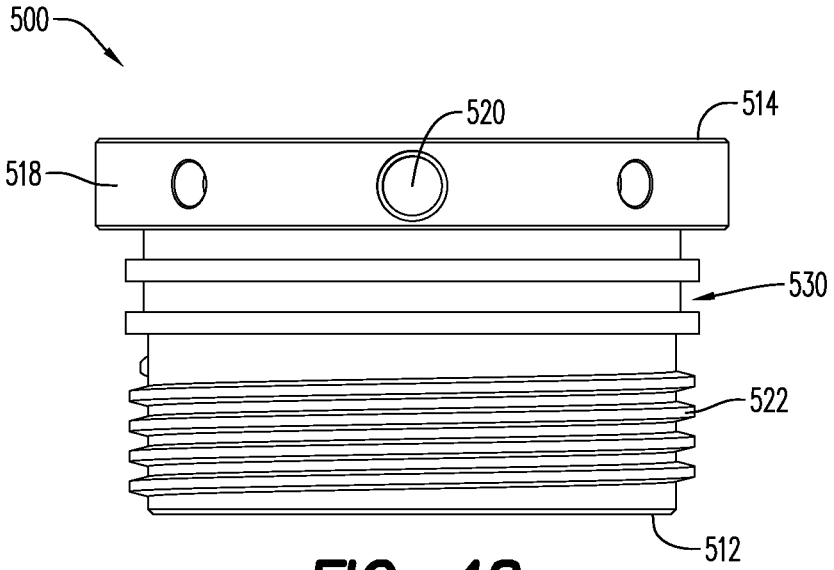
FIG. 48 is a right-side elevated view of the alignment ring of FIG. 18.
Figure 49:
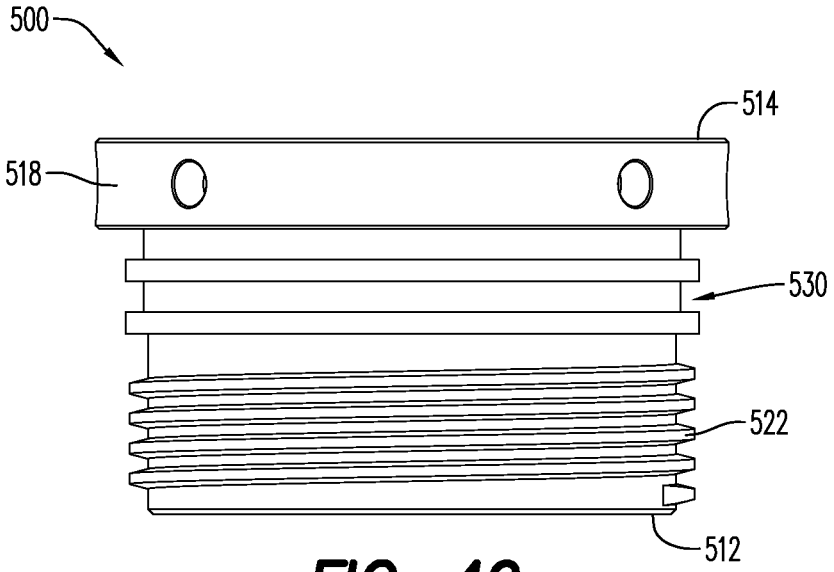
FIG. 49 is a front elevated view of the alignment ring of FIG. 18.
Figure 50:
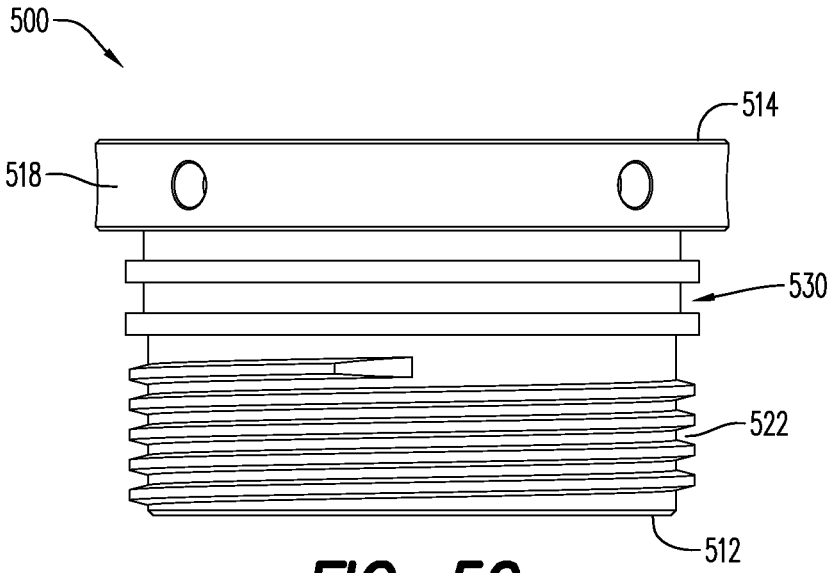
FIG. 50 is a rear elevated view of the alignment ring of FIG. 18.
Figure 51:
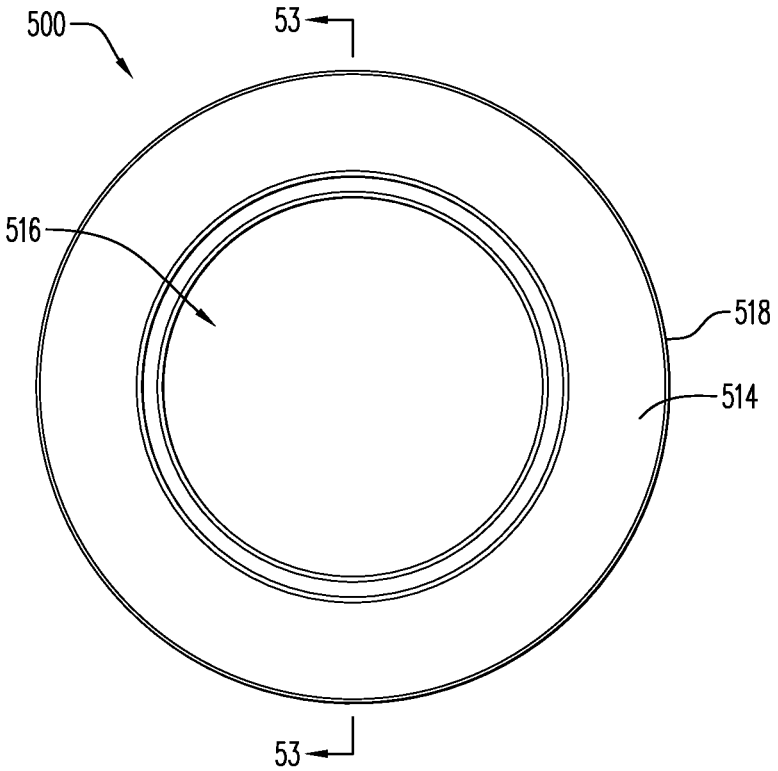
FIG. 51 is a top plan view of the alignment ring of FIG. 18.
Figure 52:
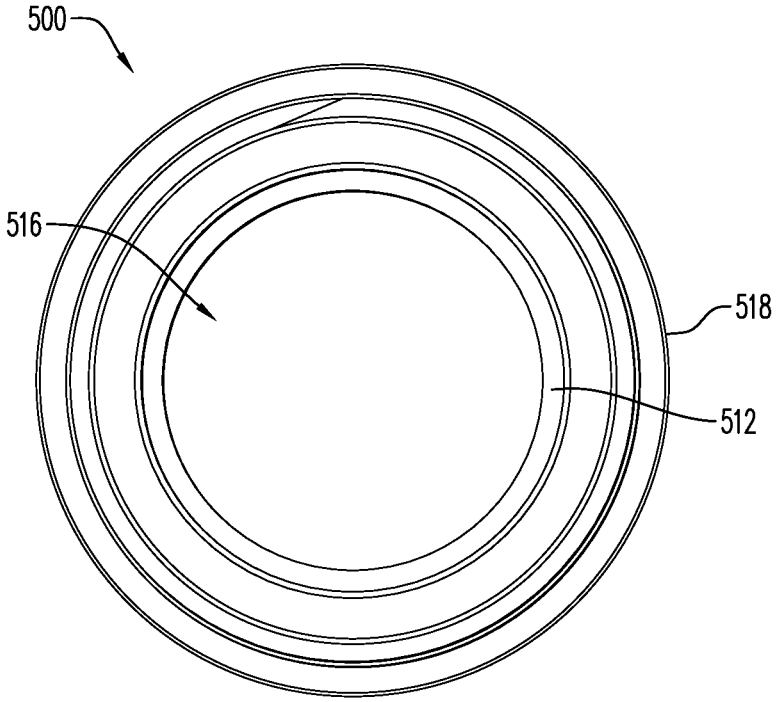
FIG. 52 is a bottom plan view of the alignment ring of FIG. 18.

With reference to FIG. 37 and FIG. 44, the perforating gun module 310 may include a friction reduction portion 340 formed at the second housing end portion 312 and spaced apart from the threaded end portion 315. As seen, for instance, in FIG. 38, the friction reduction portion 340 may include an undercut or a channel/circumferential channel 342 that extends around the circumference of the perforating gun module 310. The channel 342 may be flanked by protrusions, peaks or groove shoulders 344 that serve as the main contact surface between an alignment ring 500, described in further detail hereinbelow, and the perforating gun housing 310 (see, for example, FIGS. 28A and 28B). Both groove shoulders 344 may prevent the alignment collar ring from wobbling, mechanically canting, seizing, excessive transverse movement, and/or excessively tilting. The prevention of the "wobble" will also prevent temporarily loss of O-ring sealing function. For example, the prevention of the wobble may also prevent temporarily loss of O-ring sealing function It is also contemplated that these groove shoulders 344 may prevent excessive gun string bending. As would be understood by one of ordinary skill in the art, gun string bending typically occurs when the tool string is lifted or hoisted from the horizontal to vertical position at the wellsite. In addition, the overall geometry of the undercut 342 may enable a fastener or set screw to hold an alignment ring or collar 500 (described in further detail hereinbelow) in place more effectively once a neighboring perforating gun housing has been aligned accordingly. One of more sealer receptacles may also be formed at the second housing end portion 312 in a sealing portion extending between the threaded end portion and the friction reduction portion 340. The sealer receptacles may be configured to receive sealing mechanisms, such as O-rings.

Figure 72:
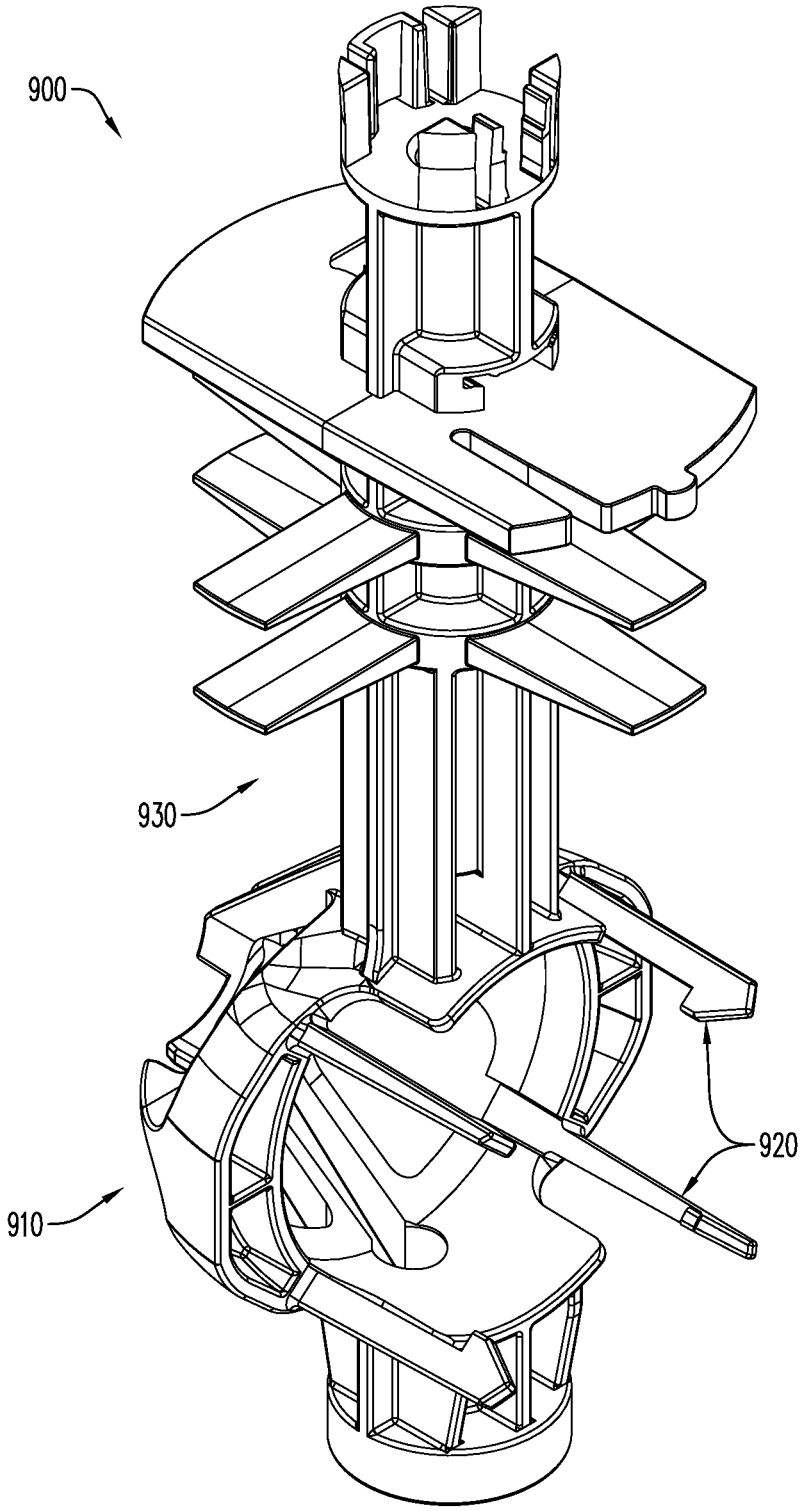
FIG. 72 is a front, perspective view of a shaped charge positioning device, according to an embodiment.
Figure 73:
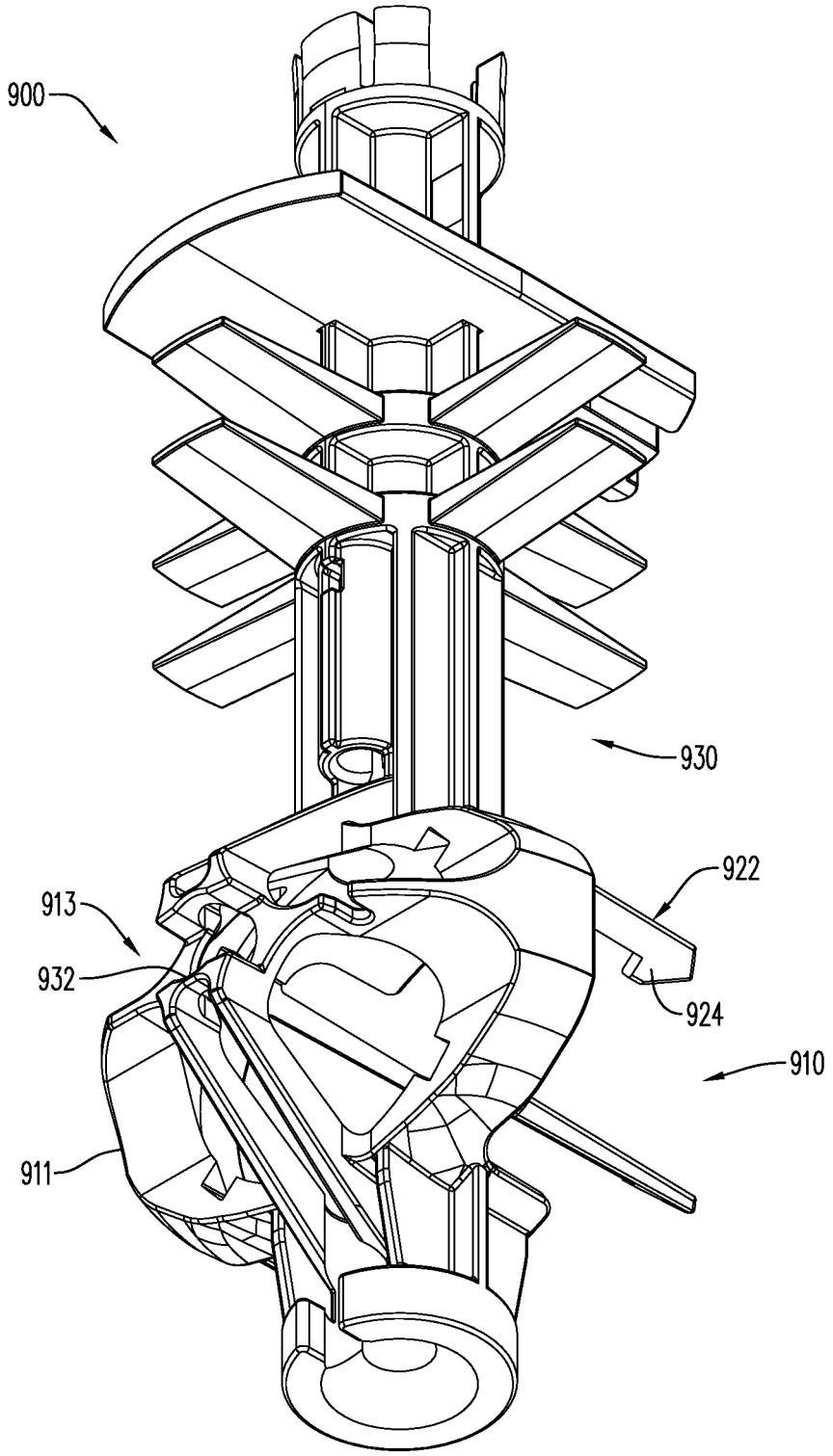
FIG. 73 is a rear, perspective view of the shaped charge positioning device of FIG. 72.
Figure 74:
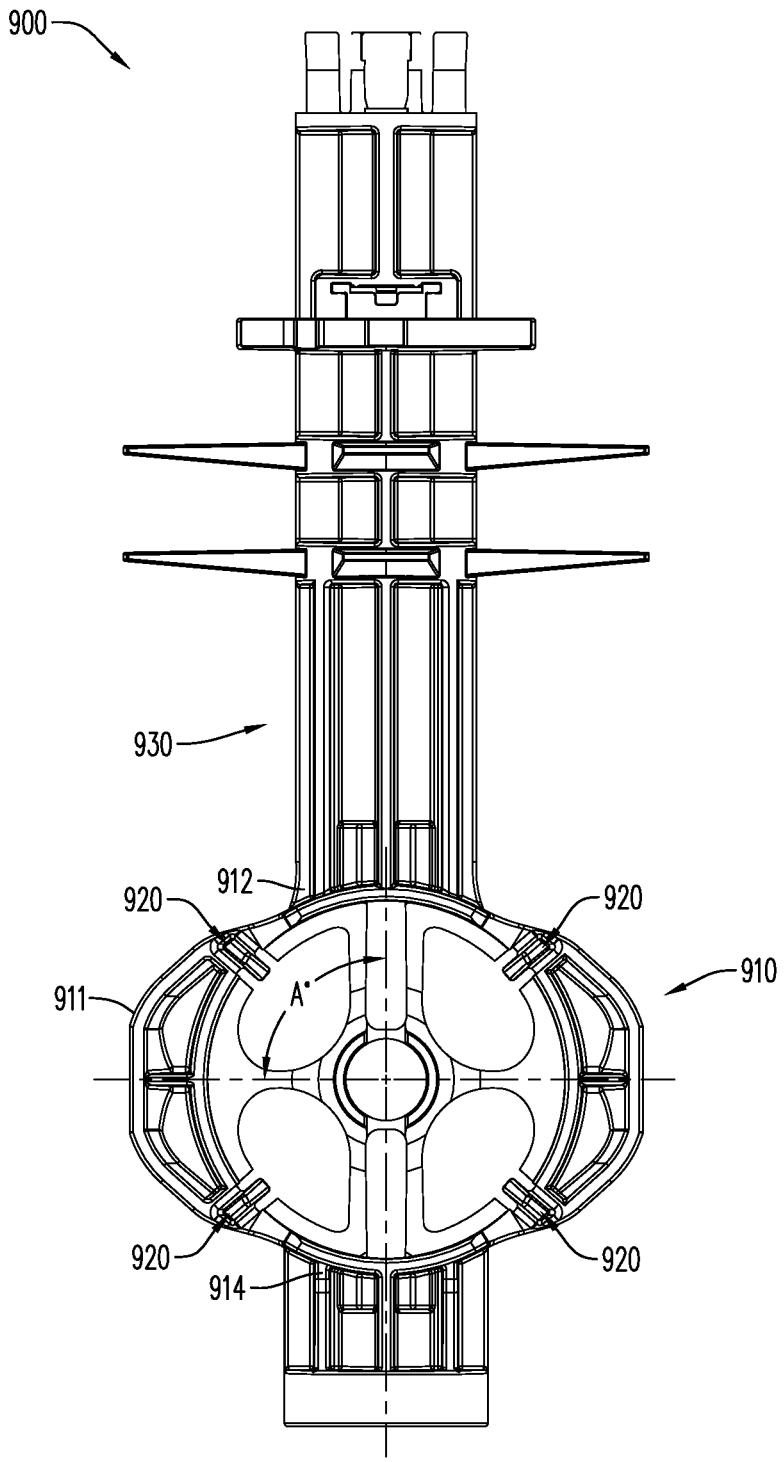
FIG. 74 is a front plan view of the shaped charge positioning device of FIG. 72.

As illustrated in FIG. 28A, a shaped charge positioning device 900 is positioned in the chamber 314 of the perforating gun module. FIGS. 72-74 illustrate views of the shaped charge positioning device 900. The shaped charge positioning device 900 may be configured substantially as described in U.S. Pat. No. 10,920,543 issued Feb. 16, 2021, which is commonly owned by DynaEnergetics Europe GmbH, and is incorporated herein by reference in its entirety to the extent that it is consistent with this disclosure.

The shaped charge positioning device 900 includes a shaped charge holder portion 910 for housing a shaped charge (not shown) secured therein. According to an aspect, the shaped charge positioning device 900 may include a single shaped charge holder portion 910 for housing a single shaped charge. The shaped charge holder portion 910 includes a first end 912 and a second end 914 spaced apart from the first end. The shaped charge holder portion 910 includes a plurality of retention mechanisms 920 outwardly extending from a frame or lattice-like structure 911 of the shaped charge holder portion 910. Each retention mechanism 920 may include an elongated shaft 922 and hook portion 924 to help secure a shaped charge in or to the frame 911. According to an aspect, four retention mechanisms are provided with each retention mechanism being spaced apart from each other at a 90° angle.

According to an aspect, a detonator holder portion 930 for housing a detonator assembly may be provided adjacent to the shaped charge holder portion 910. The detonator holder portion 930 includes a detonating cord holder 932 (FIG. 73) that extends from at least a portion of the detonator holder portion. The detonator cord holder 932 may be configured to help guide a detonating cord (not shown) towards a rear portion 913 of the shaped charge holder portion 910, so that the detonating cord can be appropriately aligned at an initiation point of the shaped charge.

An electrical assembly 600 may be positioned within the second housing end portion 312 of the perforating gun housing 310. The electrical assembly 600 provides electrical conductivity through the length of the alignable perforating gun assembly 300. As seen for instance, in FIG. 28B, the electrical assembly 600 may be, for example and not limitation, an electrically contactable bulkhead assembly 610.

The bulkhead assembly 610 is illustrated in detail in FIG. 28A and FIG. 28B. The bulkhead assembly 610 may include a bulkhead body 612 that is sealingly secured in the second housing end portion 312 (e.g., in a bore/gun housing bore 355 formed in the second housing end portion 312 adjacent to the housing chamber 314). According to an aspect and as illustrated in FIG. 28B), the bulkhead body 612 may include a sealing element 614, such as an o-ring, for frictionally and compressively engaging with an interior surface 319 (FIG. 28B), which defines the bore 355 of the perforating gun housing. The frictional engagement pressure seals the bulkhead body 612 in the perforating gun housing 310. The bulkhead assembly 610 may include a first end 616 including a first bulkhead pin 618, and a second end 620 including a second bulkhead pin 622. The first bulkhead pin 618 may be in electrical connection with or electrically connected to the second bulkhead pin 622 through the bulkhead body 612. Each of the first bulkhead pin 618 and the second bulkhead pin 622 are electrically contactable components. The electrical assembly 600 positioned in the alignable perforating gun assembly 300 provides electrical conductivity/connectivity through the alignable perforating gun assembly 300 from a first wellbore tool to a second wellbore tool, as described in detail hereinabove.

A gun housing shoulder 357 is provided adjacent to a first end of the gun housing bore 355, which extends between the gun housing bore and the chamber 314 of the perforating gun housing. A gun housing shoulder aperture 359 may be formed in the gun housing shoulder and extend through the gun housing shoulder 357 between the gun housing bore 355 and the gun housing chamber 314. The gun housing shoulder aperture 359 may have a diameter that is smaller than a diameter of the bulkhead body 612, so as to prevent the bulkhead second end 620 and/or bulkhead body 612 from passing through the gun housing bore 355 into the gun housing chamber 314. According to an aspect, the gun housing shoulder aperture 359 is formed in the gun housing shoulder 357 and is in alignment with the bulkhead second end 620/second bulkhead pin 622. The second bulkhead pin 622 may have a diameter that is equal to or less than the diameter of the gun housing shoulder aperture 359 such that the second bulkhead pin 622 may extend through the gun housing shoulder aperture 359 and into the gun housing chamber 314 when the bulkhead second end 620 is in a position where it abuts the gun housing shoulder 357.

With reference again to FIGS. 28A and 28B, a retention collar/bulkhead retainer 800 may be coupled to the gun housing body 310 at the second housing end portion 312 and configured to retain the bulkhead body 612 in the gun housing bore 355. The bulkhead retainer 800 may be provided in a shoulder portion 331 of a gun housing recess 361 that is formed in the second housing end portion 312 adjacent the gun housing bore 355. The gun housing recess 361 may be defined on a first end by a shoulder portion 331 including a recess wall 362 provided adjacent to the gun housing bore 355, and may extend from the recess wall 362 to the second end of the perforating gun body 310. The bulkhead retainer 800 may be threadingly coupled to an inner surface 324 defining the gun house bore of the second housing end portion 312.

FIGS. 54-62 illustrate additional views of the retention collar 800, according to an embodiment. The retention collar 800 includes an upper wall 810 with an opening or a hole 812 extending therethrough. The hole 812 may be configured to receive at least a portion of the first bulkhead pin 618. According to an aspect, the gun housing recess 361 may be dimensionally configured to receive and house an end of an adjacent wellbore tool component, such as, for example and not limitation, a detonator holder end of a shaped charge positioning device (not shown). In a toolstring assembly, the first bulkhead pin 618 may extend into the gun housing recess, such that an electrically contactable portion of the adjacent wellbore tool is in electrical contact with the first bulkhead pin 618.

A side wall or skirted portion 814 extends from a peripheral edge 811 of the upper wall 810. The skirted portion 814 includes a divot 816 formed on an inner surface 817 of the skirted portion 814. The divot 816 may extend from an inner surface 813 of the upper wall 810 along the length of the side wall 814 in a direction away from the upper wall 810. The bulkhead body 612 of the bulkhead assembly 610 may be retained by an exterior surface 820 of the upper wall 810 of the retention collar 800, which abuts the first end 616 of the bulkhead body 612 and the housing recess wall 362. The retention collar 800 may be stationary (that is, it may be non-rotatable) once it is threaded, via its external threads 823, onto the shoulder portion 331 of the gun housing recess 361.

The perforating gun and alignment assembly further includes an alignment ring 500 disposed around the second housing end portion 312 of the perforating gun housing 310 and configured to rotatably or non-rotatably connect to an adjacent wellbore tool. According to an aspect the alignment ring 500 is coupled to the perforating gun housing 310 via a retention ring 700, as described hereinbelow.

FIGS. 45-53 illustrate additional views of the alignment ring 500, according to an embodiment. The alignment ring 500 may be rotatably coupled to the second housing end portion 312 of the perforating gun housing (FIG. 28A). According to an aspect, the alignment ring 500 may be configured to be non-rotatably coupled to the second housing end portion 312 of the perforating gun housing 310, through the use of, for example, set screws/locking screws.

Figure 53:
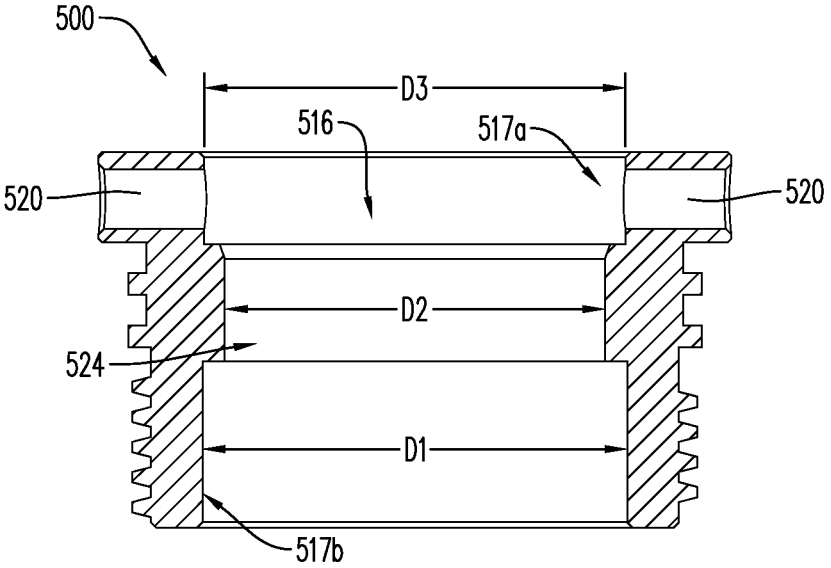
FIG. 53 is a cross-section view of the alignment ring of FIG. 18 taken along line 26-26 of FIG. 24.
Figure 54:
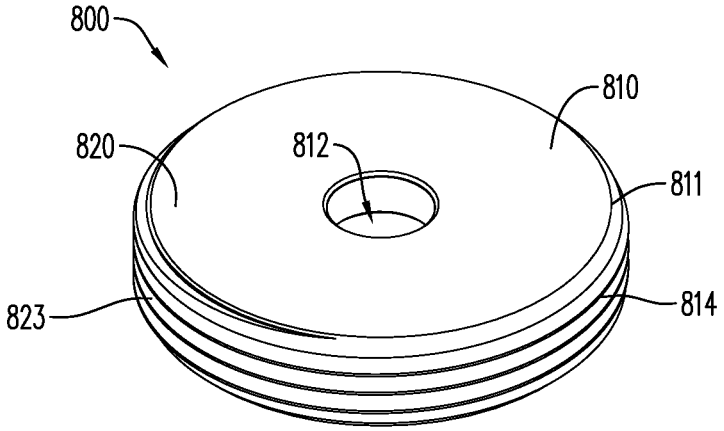
FIG. 54 is a front, top perspective view of a retention collar of a perforating gun and alignment assembly, according to an embodiment.
Figure 55:
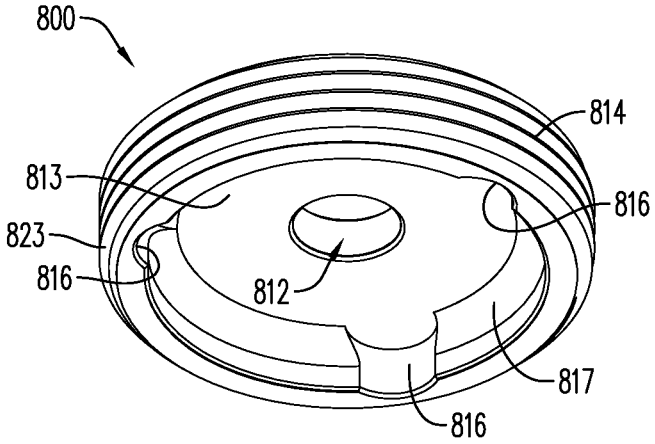
FIG. 55 is a front, bottom perspective view of the retention ring of FIG. 27.
Figure 56:
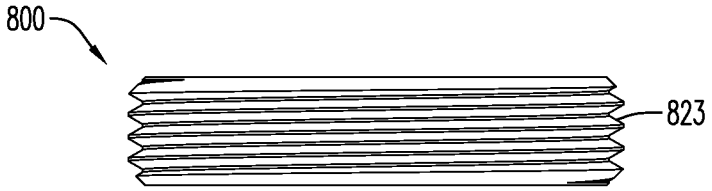
FIG. 56 is a left-side elevated view of the retention ring of FIG. 27.
Figure 57:
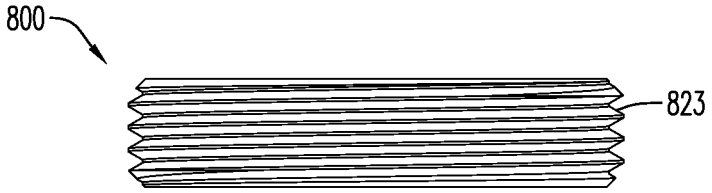
FIG. 57 is a right-side elevated view of the retention ring of FIG. 27.
Figure 58:
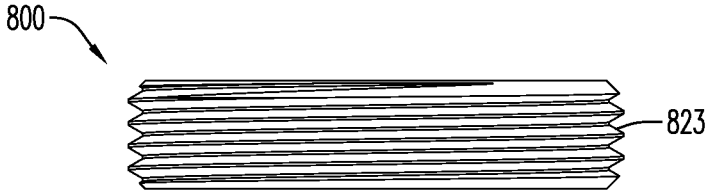
FIG. 58 is a front elevated view of the retention ring of FIG. 27.
Figure 59:
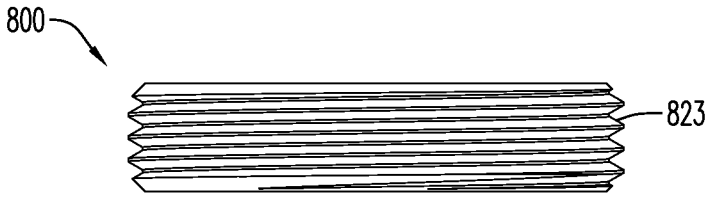
FIG. 59 is a rear elevated view of the retention ring of FIG. 27.
Figure 60:
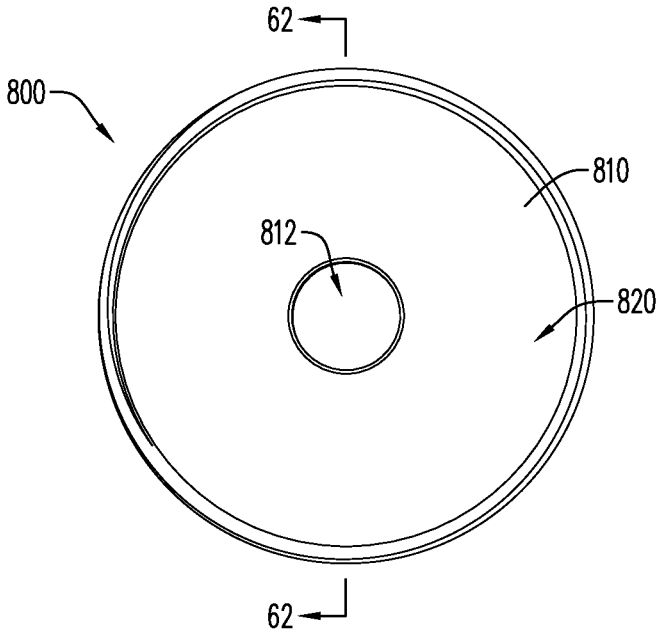
FIG. 60 is a top plan view of the retention ring of FIG. 27.
Figure 61:
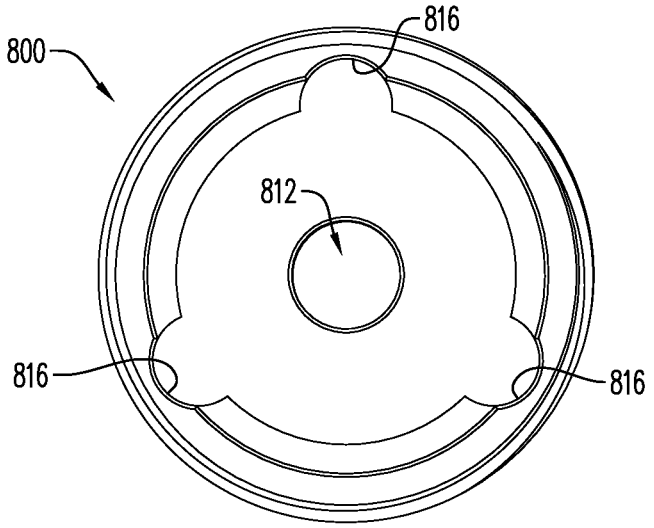
FIG. 61 is a bottom plan view of the retention ring of FIG. 27.
Figure 62:
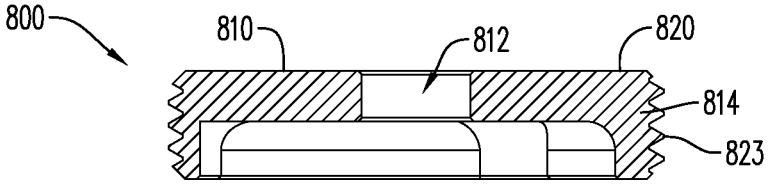
FIG. 62 is a cross-section view of the retention ring of FIG. 27 taken along line 35-35 of FIG. 33.
Figure 63:
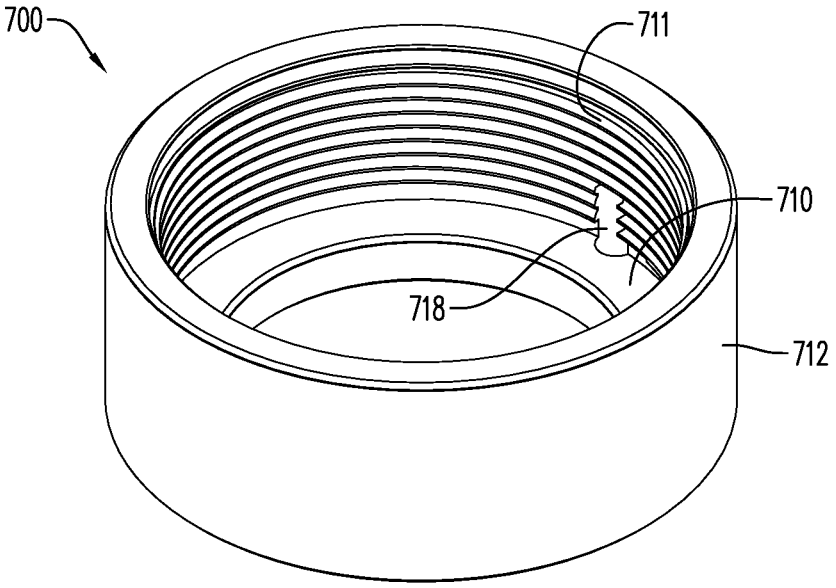
FIG. 63 is a front, top perspective view of a retention ring of a perforating gun and alignment assembly, according to an embodiment.
Figure 64:
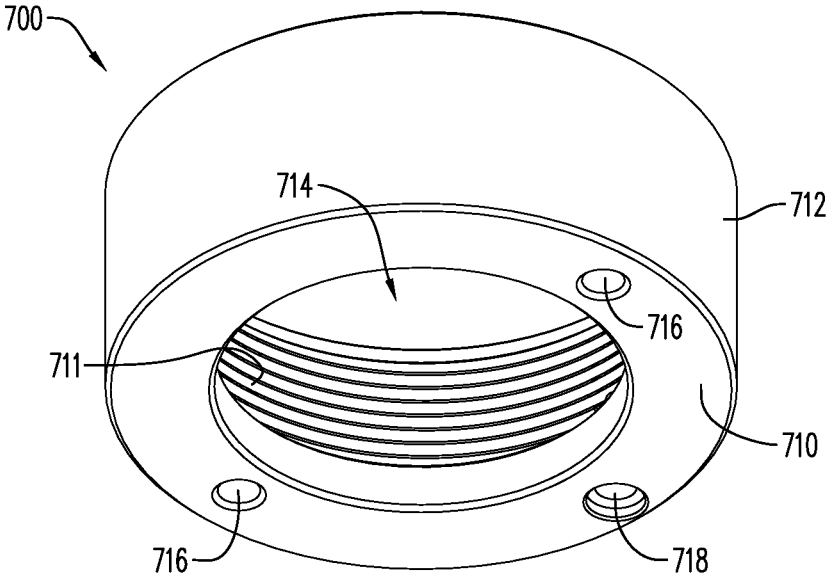
FIG. 64 is a front, bottom perspective view of the retention collar of FIG. 36.
Figure 65:
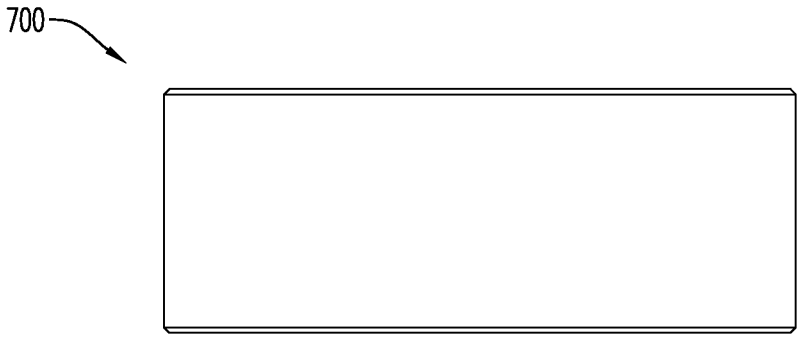
FIG. 65 is a left-side elevated view of the retention collar of FIG. 36.
Figure 66:
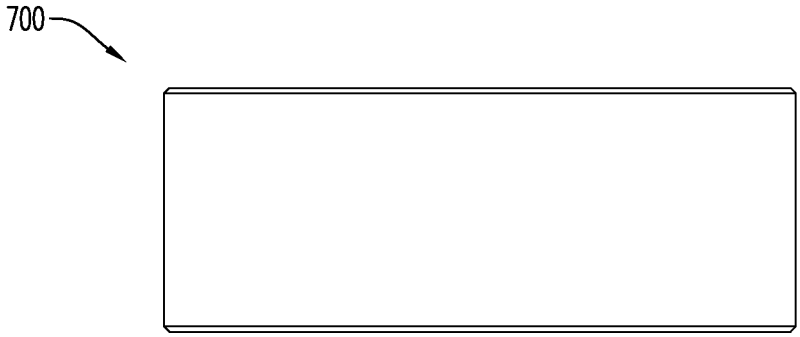
FIG. 66 is a right-side elevated view of the retention collar of FIG. 36.
Figure 67:
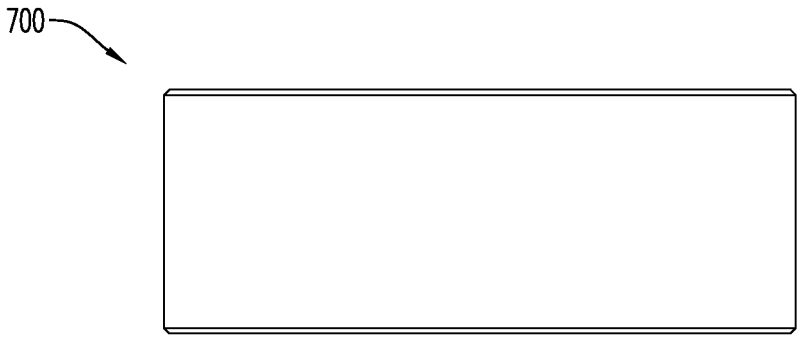
FIG. 67 is a front elevated view of the retention collar of FIG. 36.
Figure 68:
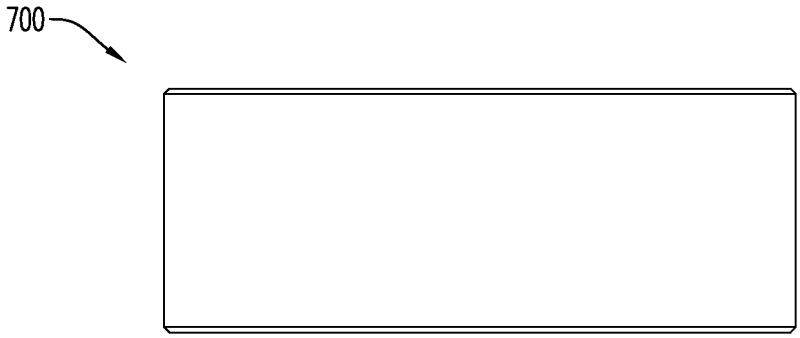
FIG. 68 is a rear elevated view of the retention collar of FIG. 36.
Figure 69:
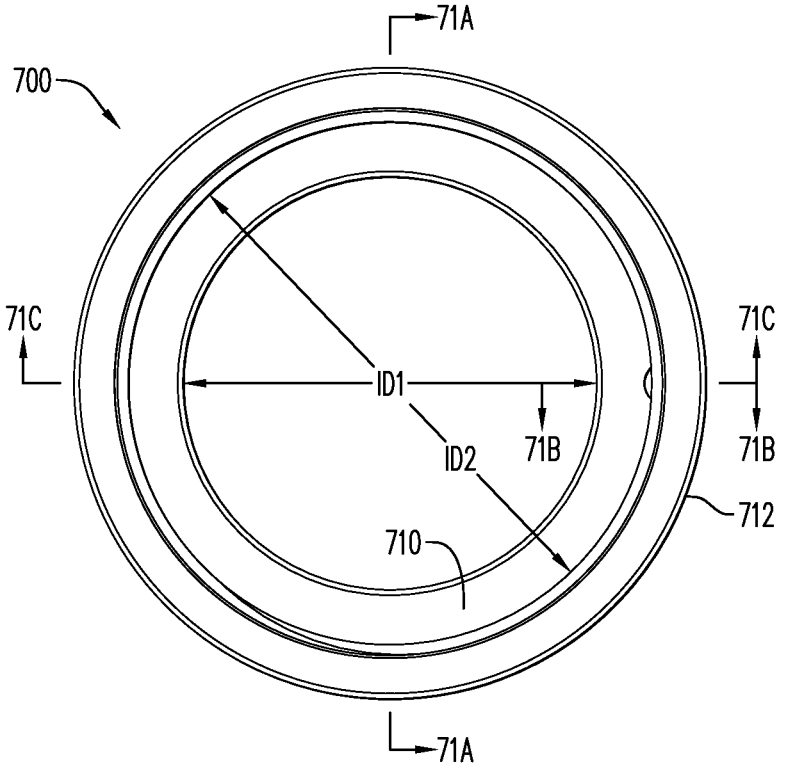
FIG. 69 is a top plan view of the retention collar of FIG. 36.
Figure 70:
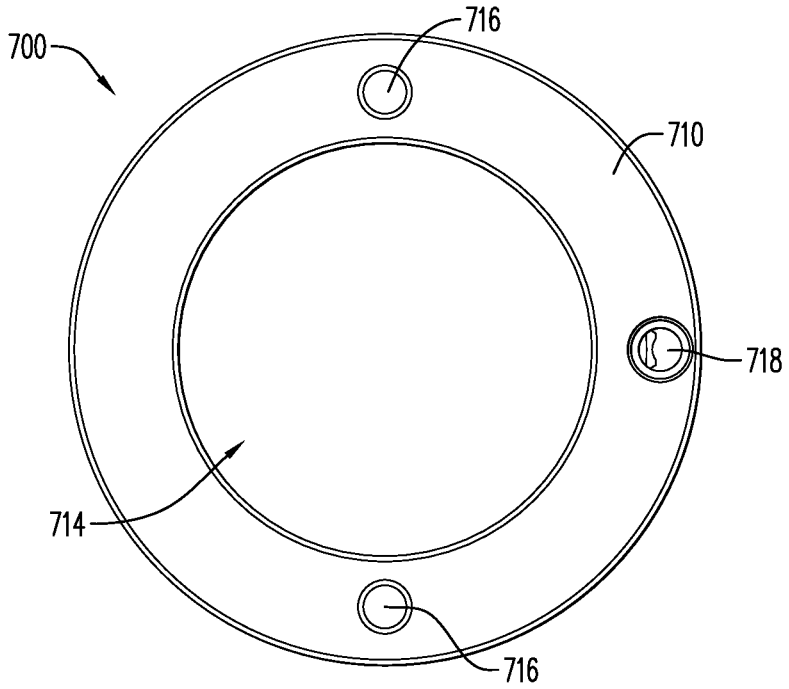
FIG. 70 is a bottom plan view of the retention collar of FIG. 36.
Figure 71A:
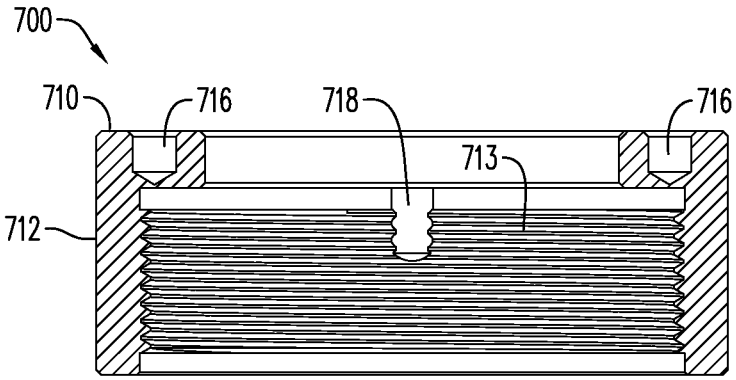
FIG. 71A is a cross-section of the retention collar of FIG. 36.
Figure 71B:
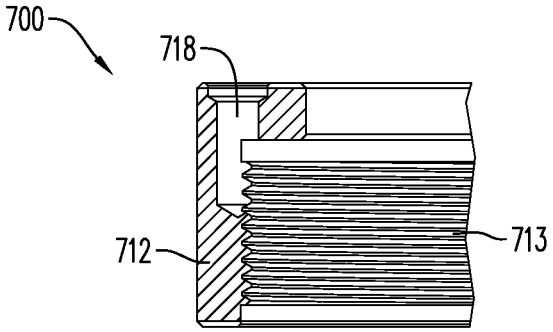
FIG. 71B is a partial cross-section of the retention collar of FIG. 36.
Figure 71C:
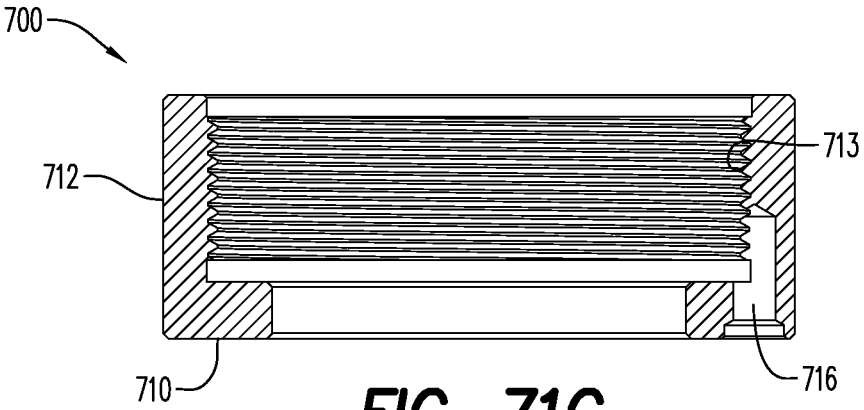
FIG. 71C is a cross-section view of the retention collar of FIG. 36 taken along line 44-44 of FIG. 42.

The alignment ring 500 includes a first end 512 (FIG. 45 and FIGS. 47-50), a second end 514 (FIG. 46 and FIGS. 47-50), and a cavity 516 extending between the first and second ends 512, 514 (FIG. 53). The second end 514 of the alignment ring includes a rib 518, and a locking screw socket 520 extending through the rib 518 and into the cavity 516. According to an aspect, the locking screw socket 520 is configured as a through hole aligned with the friction reduction portion 340, such that a screw inserted through the screw socket 520 may be partially retained in the friction reduction portion 340 to aid in engaging the alignment ring with the gun body 310. The first end 512 of the alignment ring 500 includes a threaded portion 522 that enables the alignment ring 500 to be secured to corresponding threads of an adjacent perforating gun housing (not shown) of a tool string.

As illustrated in FIG. 53, for example, the cavity 516 of the alignment ring 500 extending between the first end 512 and the second end 514 may be segmented, with a medial channel 524 formed therebetween. The medial channel 524 may have a diameter D2, that is less than the diameter D1 of the cavity 516. The cavity 516 may have an upper portion 517*a* along the rib 518, and a lower portion 517*b* spaced apart from the upper portion 517*a*, with the medial channel 524 extending between the upper portion 517*a* and the lower portion 517*b*. In an aspect, each of the upper portion 517*a* and the lower portion 517*b* may have a similar diameter D1, or the diameter of each of the upper portion 517*a* and the lower portion 517*b* may be dissimilar. For example, a diameter D3 (FIG. 53) of the upper portion 517*a* may be larger or smaller than one or each of the first diameter D1 of the lower portion 517*b* and the second diameter D2. When assembled with the perforating gun housing 310, the upper portion 517*a* is adjacent the friction reduction portion 340 of the perforating gun housing 310. The alignment ring may include an o-ring channel 530 configured to receive a retention mechanism.

As illustrated in FIG. 28A, a gap 550 extends between an inner surface 510 of the alignment ring 500 and an outer surface 322 of the second end portion 312 of the perforating gun housing 310. A portion of the retention ring 700 is positioned in the gap 550. The retention ring 700 may be threadingly connected to the outer surface 322 of the second housing end portion 312 of the perforating gun housing 310. FIGS. 28C and 63-71C illustrate additional views of the retention ring 700, according to an embodiment. The retention ring 700 may be configured for preventing the alignment ring 500 from sliding off the perforating gun module 310 by providing a solid ledge/shoulder 750 for at least a portion of the alignment ring 500 to engage with.

The retention ring 700 includes an end wall/upper wall 710 and a side wall 712 extending from the end wall 710. The side wall may include a threaded inner surface 711 for threaded engagement with threaded outer surface 322 of the gun housing second end portion 312. The end wall 710 may include a centrally-oriented opening 714 extending therethrough through which an end of an adjacent wellbore tool may pass for electrical contact with the first bulkhead pin 618. According to an aspect, the end wall 710 further includes a hole/recess 716 formed therein. The hole 716 is spaced apart from the centrally-oriented opening 714. The hole 716 may be configured to temporarily receive a mechanism that aids in the assembly of the retention ring 700 using a tool, such as plyers that may be used to rotate the retention ring 700 for coupling to the threaded outer surface 322. According to an aspect, more than one hole 716 is provided. When more than one hole 716 is provided, at least one of the holes 716 may be configured as a set screw hole 718 that receives a set screw or fastener. The set screw hole may extend through at least a portion of the end wall 710 to at least a portion of the side wall 712, and into an internal thread 713 of the side wall 712 (FIGS. 44A, 44B and 44C). Once the fastener is installed into the set screw hole, the fastener may help to prevent the retention ring 700 from being loosened, unthreaded or otherwise detached from the perforating gun module 310. In an embodiment and with reference to FIG. 28B, a hole 363 formed radially through the wall of the second end 312 of the gun housing including threaded surface 322 may receive a fastener, such as a bolt. The fastener may frictionally engage the second end of the gun housing and the threaded inner surface 711 to aid in locking the retention ring 700 in place and preventing the retention ring 700 from becoming unthreaded or otherwise detached from the perforating gun module 310.

Figure 28D:
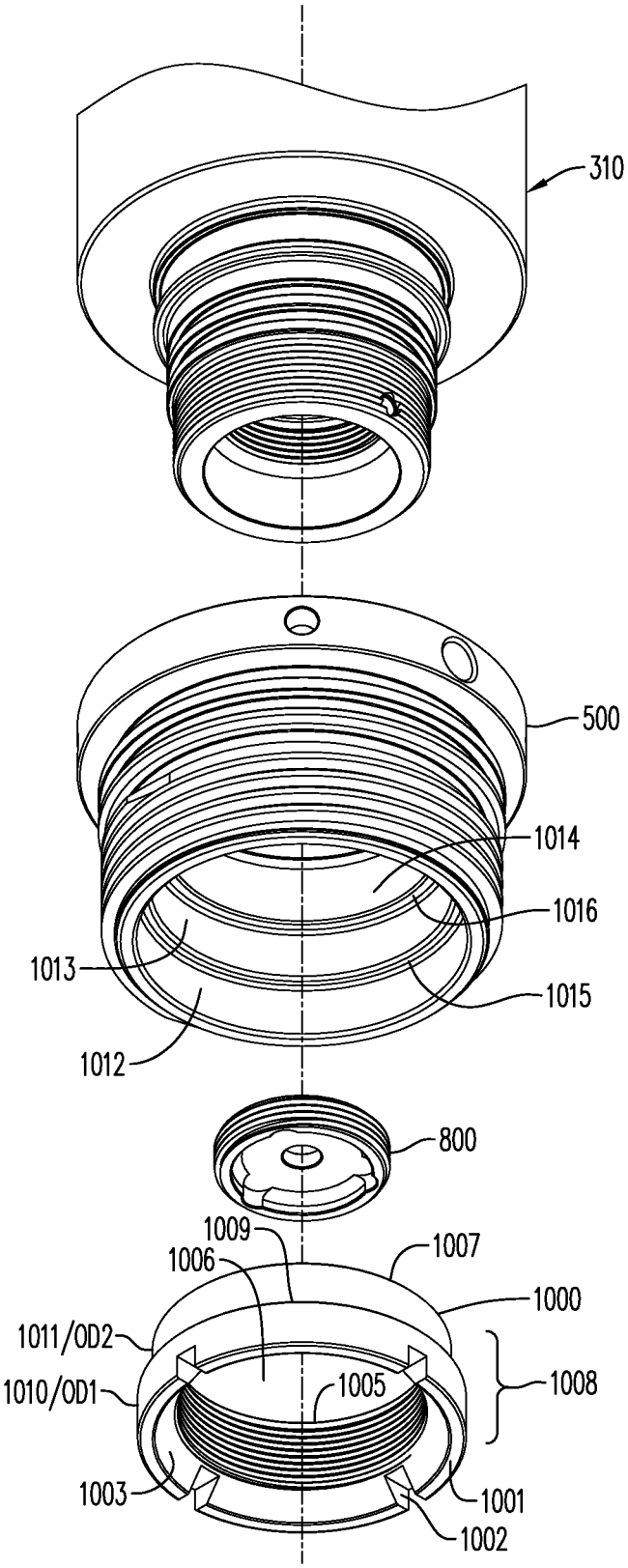
FIG. 28D is an exploded view of a perforating gun and alignment assembly, according to an embodiment
Figure 29A:
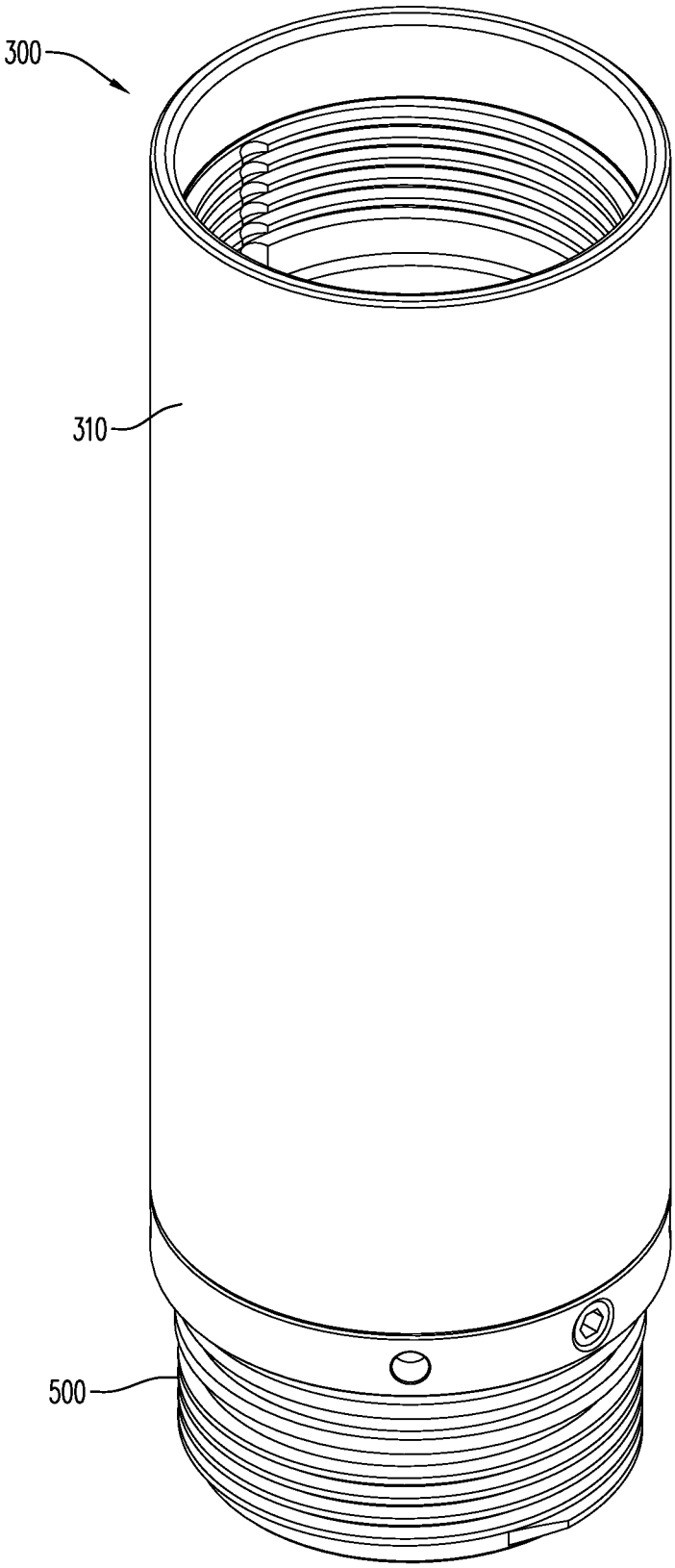
FIG. 29A is a front, top perspective view of a perforating gun and alignment assembly, according to an embodiment.
Figure 29B:
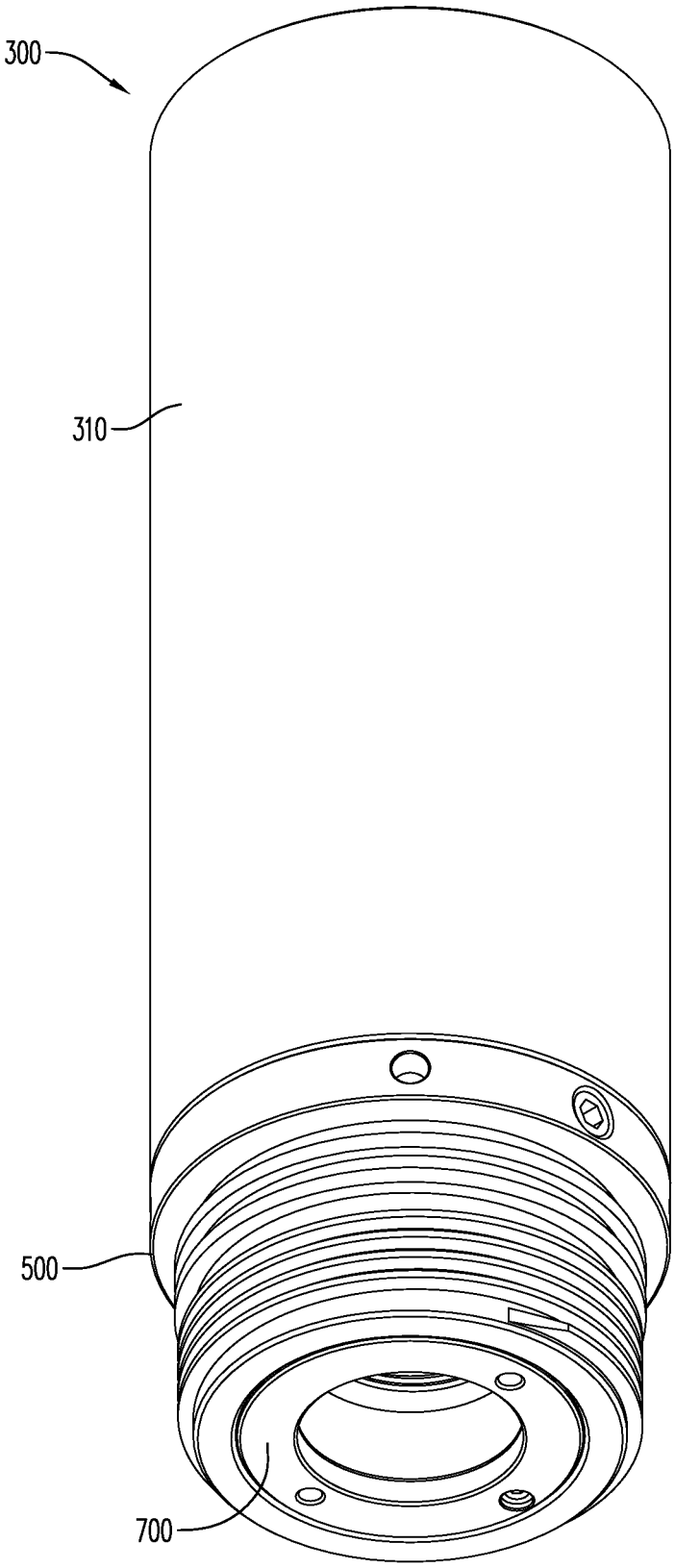
FIG. 29B is a front, bottom perspective view of the perforating gun and alignment assembly of FIG. 29A.
Figure 30:
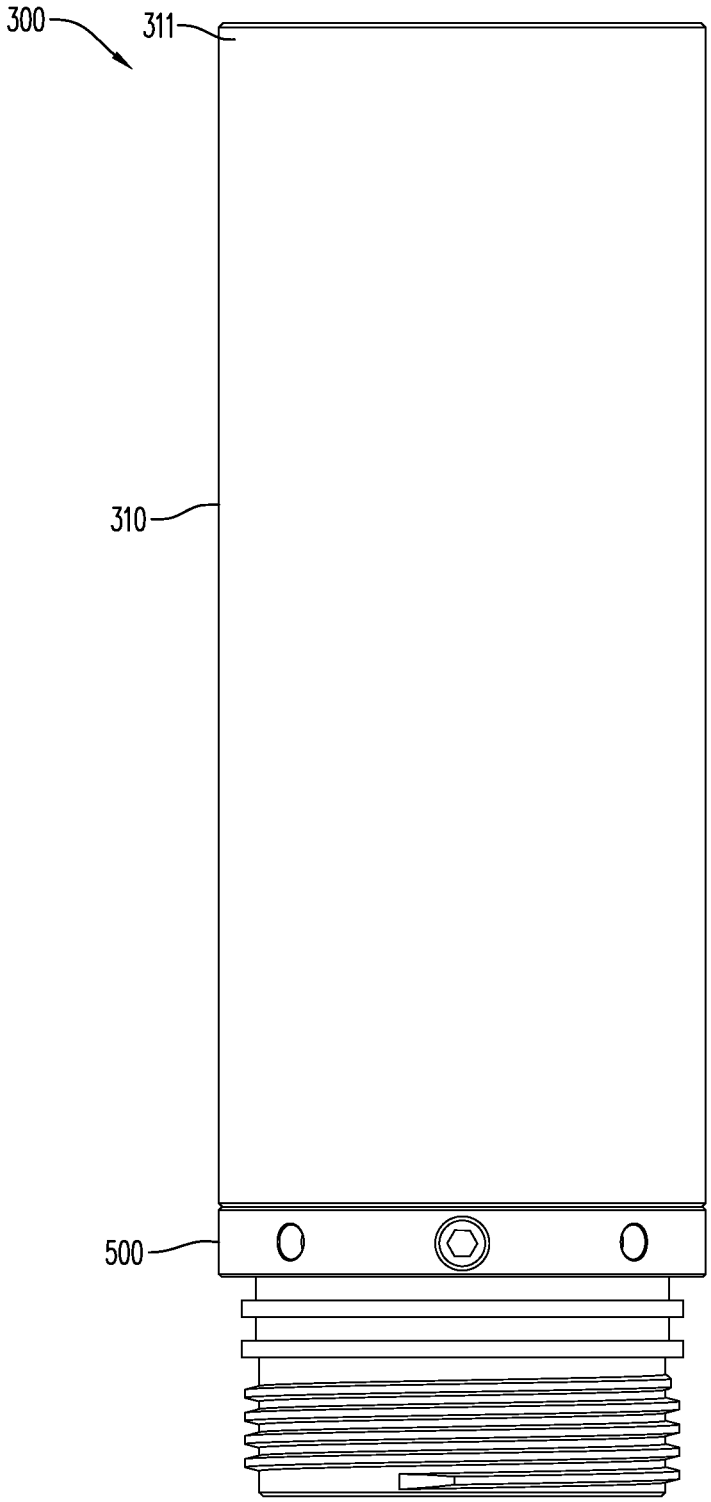
FIG. 30 is a left-side elevated view of the perforating gun and alignment assembly of FIG. 2A.

FIG. 28D shows an additional embodiment of a retention ring. The retention ring 1000 may have a first end 1001 opposite a second end 1007 and an outer wall 1008 extending between the first and second ends 1001, 1007. An inner surface 1005 may be threaded for engaging with the threaded outer surface 322 of the housing second end 312 of the perforating gun 310. The retention ring 1000 may include a centrally-oriented opening 1006 defined by the retention ring wall inner surface 1005 configured for receiving an end of an adjacent wellbore tool for electrical contact with the first bulkhead pin 618. The first end 1001 may be tapered and include a sloped wall 1003 to aid in the positioning of the adjacent wellbore tool end in the opening 1006. One or more recesses 1002 may be provided on the first end 1001 to temporarily receive a mechanism that aids in the assembly of the retention ring 1000 using a tool, such as plyers that may be used to rotate the retention ring 700 for coupling to the threaded outer surface 322 of the perforating gun housing second end 312. The outer wall 1008 may include a stepped profile including a first outer diameter portion 1010 having a first outer diameter OD1 at the first end 1001, a second outer diameter portion 1011 having a second outer diameter OD2 at the second end 1007, and a ledge/shoulder 1009 joining the first outer diameter portion and the second outer diameter portion 1011.

With reference to FIG. 28D, the stepped outer profile of the retention ring 700 is configured to engage with a correspondingly dimensioned stepped inner profile of the alignment ring 500 to prevent the alignment ring 500 from slipping off of the perforating gun housing 310. In an embodiment, the alignment ring 500 may have a first inner diameter portion 1012, a second inner diameter portion 1013, a third inner diameter portion 1014, a first shoulder 1015 joining the first inner diameter portion 1012 and second inner diameter portion 1013, and a second shoulder 1016 joining the second inner diameter portion 1013 and the third inner diameter portion 1014. When assembled, the second end 1007 of the retention ring 1000 may abut the first shoulder 1015 of the alignment ring, and the shoulder 1009 of the retention ring 1000 may abut the second shoulder 1016 of the alignment ring.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A perforating gun and alignment assembly comprising:

a perforating gun housing formed from a singular and monolithic piece of metal material, the perforating gun housing comprising:

a first housing end portion comprising an internal thread;

a second housing end portion comprising a threaded end portion including an external thread, a friction reduction portion spaced apart from the threaded end portion, and a sealing portion extending between the threaded end portion and the friction reduction portion; and a chamber extending from the first housing end portion towards the second housing end portion, wherein the friction reduction portion comprises a channel positioned between a first protrusion and a second protrusion;

an alignment assembly rotatably secured to the second end portion of the perforating gun housing, the alignment assembly comprising an alignment ring coupled to the second housing end portion;

a gap extends between an inner surface of the alignment ring and an outer surface of the second end portion of the perforating gun housing; and a retention ring threadingly connected to the outer surface of the second housing end portion, wherein a portion of the retention ring is positioned in the gap.

2. The assembly of claim 1, wherein the channel, the first protrusion and the second protrusion are circumferentially disposed around the second housing end portion.

3. The assembly of claim 1, wherein the alignment ring is disposed around the friction reduction portion.

4. The assembly of claim 1, wherein the alignment ring comprises:

a first end including a threaded exterior portion;

a second end; and a cavity extending between the first end and the second end.

5. The assembly of claim 4, wherein the cavity of the alignment ring comprises:

an upper portion;

a lower portion;

a medial channel extending between the upper portion and the lower portion, wherein the upper portion is adjacent the friction reduction portion of the perforating gun housing.

6. The assembly of claim 1, wherein the retention ring comprises:

an end wall;

a centrally-oriented opening extending through the end wall;

a hole extending through the end wall, wherein the hole is space apart from the centrally-oriented opening; and a side wall extending from the end wall, and including a threaded inner surface.

7. A perforating gun and alignment assembly comprising:

a perforating gun housing formed from a singular and monolithic piece of metal material, the perforating gun housing comprising:

a first housing end portion comprising an internal thread;

a second housing end portion comprising a friction reduction portion; and a chamber extending from the first housing end portion towards the second housing end portion;

an alignment assembly rotatably secured to the second housing end portion of the perforating gun housing, the alignment assembly comprising an alignment ring disposed around the friction reduction portion, wherein the alignment ring is coupled to the second housing end portion;

a shaped charge positioning device positioned in the chamber of the perforating gun housing, wherein the shaped charge positioning device comprises a shaped charge holder portion for housing a shaped charge;

a gap extends between an inner surface of the alignment ring and an outer surface of the second end portion of the perforating gun housing; and a retention ring threadingly connected to the outer surface of the second housing end portion, wherein:

the friction reduction portion comprises a circumferential channel positioned between a first protrusion and a second protrusion;

a portion of the retention ring is positioned in the gap; and the retention ring comprises:

an end wall;

a centrally-oriented opening extending through the end wall; and a side wall extending from the end wall, and including a threaded inner surface.

8. A perforating gun and alignment assembly comprising:

a perforating gun housing formed from a singular and monolithic piece of metal material, the perforating gun housing comprising:

a first housing end portion comprising an internal thread;

a second housing end portion comprising a threaded end portion including an external thread, and a friction reduction portion spaced apart from the threaded end portion; and a chamber extending from the first housing end portion towards the second housing end portion;

a single shaped charge positioning device positioned in the chamber, wherein the single shaped charge positioning device comprises a shaped charge holder portion for housing a shaped charge;

an electrically contactable bulkhead assembly sealingly secured in the second housing end portion;

a retention collar positioned adjacent the electrically contactable bulkhead assembly, wherein a bulkhead body of the electrically contactable bulkhead assembly is retained by an upper wall of the retention collar; and an alignment assembly secured to the second end portion of the perforating gun housing, wherein the alignment assembly is movable between a rotatable position and a non-rotatable position, wherein:

the alignment assembly comprises:

an alignment ring disposed around the friction reduction portion, wherein the alignment ring comprises:

a first end;

a second end; and a cavity extending between the first end and the second end and comprising:

an upper portion;

a lower portion; and a medial channel extending between the upper portion and the lower portion, wherein the upper portion is adjacent the friction reduction portion of the perforating gun housing.

9. The assembly of claim 8, wherein the friction reduction portion comprises:

a channel positioned between a first protrusion and a second protrusion.

10. The assembly of claim 8, wherein a gap extends between an inner surface of the alignment ring and an outer surface of the second end portion of the perforating gun housing, and a portion of a retention ring is positioned in the gap and is threadingly connected to the outer surface of the second housing end portion.

11. The assembly of claim 10, wherein the retention ring comprises:

an end wall;

a centrally-oriented opening extending through the end wall;

a hole extending through the end wall, wherein the hole is space apart from the centrally-oriented opening; and a side wall extending from the end wall, and including a threaded inner surface.

* * * * *